US008588427B2

(12) United States Patent
Uhle et al.

(10) Patent No.: US 8,588,427 B2
(45) Date of Patent: Nov. 19, 2013

(54) APPARATUS AND METHOD FOR EXTRACTING AN AMBIENT SIGNAL IN AN APPARATUS AND METHOD FOR OBTAINING WEIGHTING COEFFICIENTS FOR EXTRACTING AN AMBIENT SIGNAL AND COMPUTER PROGRAM

(75) Inventors: Christian Uhle, Erlangen (DE); Juergen Herre, Buckenhof (DE); Stefan Geyersberger, Würzburg (DE); Falko Ridderbusch, Nürnberg (DE); Andreas Walter, Bamberg (DE); Oliver Moser, Erlangen (DE)

(73) Assignee: Frauhnhofer-Gesellschaft zur Foerderung der Angewandten Forschung e.V., Munich (DE)

( * ) Notice: Subject to any disclaimer, the term of this patent is extended or adjusted under 35 U.S.C. 154(b) by 1457 days.

(21) Appl. No.: 12/055,787

(22) Filed: Mar. 26, 2008

(65) Prior Publication Data

US 2009/0080666 A1 Mar. 26, 2009

Related U.S. Application Data

(60) Provisional application No. 60/975,340, filed on Sep. 26, 2007.

(51) Int. Cl.
*H04R 5/00* (2006.01)

(52) U.S. Cl.
USPC ..... 381/17

(58) Field of Classification Search
USPC ..... 381/17
See application file for complete search history.

(56) References Cited

U.S. PATENT DOCUMENTS 6,321,200 B1 11/2001 Casey
6,829,578 B1 12/2004 Huang et al.

(Continued)

FOREIGN PATENT DOCUMENTS

CA 2 387 091 A1 5/2001
EP 0 748 143 A2 12/1996

(Continued)

OTHER PUBLICATIONS

Official Communication issued in corresponding Japanese Patent Application No. 2010-526171, mailed on Nov. 29, 2011.

(Continued)

*Primary Examiner* — Fernando L Toledo
*Assistant Examiner* — Neil Prasad
(74) *Attorney, Agent, or Firm* — Keating & Bennett, LLP

(57) ABSTRACT

An apparatus for extracting an ambient signal from an input audio signal comprises a gain-value determinator configured to determine a sequence of time-varying ambient signal gain values for a given frequency band of the time-frequency distribution of the input audio signal in dependence on the input audio signal. The apparatus comprises a weighter configured to weight one of the sub-band signals representing the given frequency band of the time-frequency-domain representation with the time-varying gain values, to obtain a weighted sub-band signal. The gain-value determinator is configured to obtain one or more quantitative feature-values describing one or more features of the input audio signal and to provide the gain-value as a function of the one or more quantitative feature values such that the gain values are quantitatively dependent on the quantitative values. The gain value determinator is configured to determine the gain values such that ambience components are emphasized over non-ambience components in the weighted sub-band signal.

46 Claims, 23 Drawing Sheets

(56) References Cited

U.S. PATENT DOCUMENTS

| | | | | |
|---|---|---|---|---|
| 7,076,071 | B2 | 7/2006 | Katz | |
| 7,412,380 | B1 * | 8/2008 | Avendano et al. | 704/216 |
| 2004/0247132 | A1 | 12/2004 | Klayman et al. | |
| 2007/0110258 | A1 | 5/2007 | Kimijima | |
| 2009/0202082 | A1 | 8/2009 | Bharitkar et al. | |

FOREIGN PATENT DOCUMENTS

| | | | |
|---|---|---|---|
| EP | 1 199 708 | A2 | 4/2002 |
| EP | 1 508 893 | A2 | 2/2005 |
| EP | 1 585 112 | A1 | 10/2005 |
| EP | 1 760 696 | A2 | 3/2007 |
| JP | 02-012299 | A | 1/1990 |
| JP | 04-296200 | A | 10/1992 |
| JP | 07-123499 | A | 5/1995 |
| JP | 2001-069597 | A | 3/2001 |
| JP | 2001-222289 | A | 8/2001 |
| JP | 2002-078100 | A | 3/2002 |
| JP | 2003-015684 | A | 1/2003 |
| JP | 2007-135046 | A | 5/2007 |
| RU | 98121130 | A | 9/2000 |
| TW | I317631 | B | 10/1997 |
| TW | 480473 | A | 3/2002 |
| TW | 526467 | A | 4/2003 |
| TW | I275314 | A | 3/2007 |
| WO | 2005/066927 | A1 | 7/2005 |
| WO | 2006/106479 | A2 | 10/2006 |

OTHER PUBLICATIONS

Official communication issued in counterpart International Application No. PCT/EP2008/002385, mailed on Jul. 31, 2008.

Avendano et al.: "Ambience Extraction and Synthesis From Stereo Signals for Multi-Channel Audio Up-Mix," ICASSP 2002 Proceedings; May 13, 2002; pp. 1957-1960.

Bai et al.: "Intelligent Preprocessing and Classification of Audio Signals," Journal of Audio Engineering Society; vol. 55, No. 5; May 2007; pp. 372-384.

Avendano et al.: "Frequency Domain Techniques for Stereo to Multichannel Upmix," AES 22nd International Conference on Virtual Synthetic and Entertainment Audio; XP007905188; Jun. 1, 2002.

Uhle et al.: "Ambience Seperation From Mono Recordings Using Non-Negative Matrix Factorization," AES 30th International Conference on Intelligent Audio Environments; Audio Engineering Society; Mar. 15-17, 2007; pp. 137-145.

Faller: "Pseudostereophony Revisited," Audio Engineering Society; XP-002469053; AES 118th; Barcelona, Spain; May 28-31, 2005; pp. 1-9.

Official communication issued in counterpart International Application No. PCT/EP2008/002385, mailed on Nov. 12, 2008.

Uhrig: "Introduction to Artificial Neural Networks," XP 010154773; Proceedings of the 1995 IEEE IECON 21st International Conference on Orlando; Nov. 6-10, 1995; pp. 33-37.

Official Communication issued in corresponding Taiwanese Patent Application No. 10121270390, mailed on Nov. 19, 2012.

* cited by examiner

- e.g. determine $\alpha_i\beta_i$ such that $g_{expected,l} = \sum_{i=1}^{K} \alpha_i m_i^{\beta_i}$ for $l=1$
- e.g. determine $\alpha_i\beta_i$ such that $\left\| \begin{pmatrix} g_{expected,l} - \sum_{i=1}^{K} \alpha_i m_{l,i}^{\beta_i} \\ \vdots \\ g_{expected,L} - \sum_{i=1}^{K} \alpha_i m_{L,i}^{\beta_i} \end{pmatrix} \right\|$ is minimized

APPARATUS AND METHOD FOR EXTRACTING AN AMBIENT SIGNAL IN AN APPARATUS AND METHOD FOR OBTAINING WEIGHTING COEFFICIENTS FOR EXTRACTING AN AMBIENT SIGNAL AND COMPUTER PROGRAM

TECHNICAL FIELD

Embodiments according to the invention relate to an apparatus for extracting an ambient signal and to an apparatus for obtaining weighting coefficients for extracting an ambient signal.

Some embodiments according to the invention are related to methods for extracting an ambient signal and to methods for obtaining weighting coefficients.

Some embodiments according to the invention are directed to a low-complexity extraction of a front signal and an ambient signal from an audio signal for upmixing.

BACKGROUND

In the following, an introduction will be given.

Introduction

Multi-channel audio material is becoming more and more popular also in the consumer home environment. This is mainly due to the fact that movies on DVD offer 5.1 multi-channel sounds and therefore even home users frequently install audio playback systems, which are capable of reproducing multi-channel audio.

Such a setup may e.g. consist of three speakers (L, C, R) in the front, two speakers (Ls, Rs) in the back and one low frequency effects channel (LFE). For convenience, the given explanations are related to 5.1 systems. They apply to any other multi-channel systems with minor modifications.

Multi-channel systems provide several well-known advantages over two-channel stereo reproduction, e.g.:

Advantage 1: Improved front image stability even off the optimal (central) listening position. Due to the center channel the "sweet-spot" is enlarged. The term "sweet-spot" denotes the area of listening positions where an optimal sound impression is perceived.

Advantage 2: An increased experience of "envelopment" and spaciousness is created by the rear channel speakers.

Nevertheless, there exists a huge amount of legacy audio content with two audio channels ("stereo") or even only one ("mono"), e.g. old movies and television series.

Recently, various methods for generating a multi-channel signal from an audio signal with fewer channels have been developed (see Section 2 for an overview of the related conventional concepts). The process of generating a multi-channel signal from an audio signal with fewer channels is called "upmixing".

Two Concepts of Upmixing are Widely Known.

1. Upmixing with additional information guiding the upmix process. The additional information may be either "encoded" in a specific way in the input signal or may be stored additionally. This concept is frequently called "guided upmix".

2. The "blind upmix", whereas a multi-channel signal is obtained from the audio signal exclusively without any additional information.

Embodiments according to the present invention are related to the latter, i.e. the blind upmix process.

In the literature, an alternative taxonomy for upmix processes is reported. Upmix processes may follow either the Direct/Ambient-Concept or the "In-the-band"-Concept or a mixture of both. These two concepts are described in the following.

A. Direct/Ambient-Concept

The "direct sound sources" are reproduced through the three front channels in a way that they are perceived at the same position as in the original two-channel version. The term "direct sound source" is used to describe a sound coming solely and directly from one discrete sound source (e.g. an instrument), with little or without any additional sounds, e.g. due to reflections from the walls.

The rear speakers are fed with ambient sounds (ambience-like sounds). Ambient sounds are those forming an impression of a (virtual) listening environment, including room reverberation, audience sounds (e.g. applause), environmental sounds (e.g. rain), artistically intended effect sounds (e.g. vinyl crackling) and background noise.

FIG. 23 illustrates the sound image of the original two-channel version and FIG. 24 shows the same for an upmix following the Direct/Ambient-Concept.

B. "In-the-Band"-Concept

Following the "In-the-band"-Concept, every sound, or at least some sounds (direct sound as well as ambient sounds) may be positioned all around the listener. The position of a sound is independent of its characteristics (i.e. whether it is a direct sound or an ambient sound) and only dependent on the specific design of the algorithm and its parameter settings. FIG. 25 illustrates the sound image of the "In-the-band"-Concept.

Apparatus and methods according to the invention relate to the direct/ambient concept. The following section gives an overview of conventional concepts in the context of upmixing an audio signal with m channels to an audio signal with n channels, with m<n.

2 Conventional Concepts in Blind Upmixing 2.1 Upmixing of Mono Recordings 2.1.1 Pseudo-Stereophonic Processing Most of the techniques to produce a so-called "pseudo-stereophonic" signal are not signal adaptive. This means that they process any mono signal in the same way, no matter what the content is. Those systems often work with simple filter structures and/or time delays to decorrelate the output signals, e.g. by processing two copies of the one-channel input signal by a pair of complementary comb filters [Sch57]. A comprehensive overview of such systems can be found in [Fa105].

2.1.2 Semi-Automatic Mono to Stereo Upmixing Using Sound Source Formation

The authors propose an algorithm to identify signal components (e.g. time-frequency bins of a spectrogram) which belong to the same sound source and should therefore be panned together [LMT07]. The sound source formation algorithm considers principles of stream segregation (derived from the Gestalt principles): continuity in time, harmonic relations in frequency and amplitude similarity. Sound sources are identified using clustering methods (unsupervised learning). The derived "time-frequency-clusters" are further grouped into larger sound streams using (a) information on the frequency range of the objects and (b) timbral similarities. The authors report the use of a sinusoidal modeling algorithm (i.e. the identification of sinusoidal components of a signal) as a front end.

After the sound source formation, the user selects sound sources and applies panning weights to them. It should be noted that (according to some conventional concepts) many of the proposed methods (sinusoidal modeling, stream segregation) do not perform reliable when processing real-world signals of average complexity.

2.1.3 Ambience Extraction Using Non-Negative Matrix Factorization

A time-frequency distribution (TFD) of the input signal is computed, e.g. by means of Short-term Fourier Transform. An estimate of the TFD of the direct signal components is derived by means of the numerical optimization method of Non-negative Matrix Factorization. An estimate of the TFD of the ambient signal is obtained by computing the difference of the TFD of the input signal and the estimate of the TFD of the direct signal (i.e. the approximation residual).

The re-synthesis of the time signal of the ambient signal is carried out using the phase spectrogram of the input signal. Additional post-processing is optionally applied in order to improve the listening experience of the derived multi-channel signal [UWHH07].

2.1.4 Adaptive Spectral Panoramization (ASP)

A method for the panoramization of a mono signal for playback using a stereo sound system is described in [VZA06]. The processing incorporates an STFT, the weighting of the frequency bins used for the re-synthesis of the left and right channel signal, and the inverse STFT. The time-varying weighting factors are derived from low-level features computed from the spectrogram of the input signal in sub-bands.

2.2 Upmixing of Stereo Recordings 2.2.1 Matrix Decoders

Passive matrix decoders compute a multi-channel signal using a time-invariant linear combination of the input channel signals.

Active matrix decoders (e.g. Dolby Pro Logic II [Dre00], DTS NEO:6 [DTS] or HarmanKardon/Lexicon Logic 7 [Kar]) apply an analysis of the input signal and perform signal-dependent adaptation of the matrix elements (i.e. the weights for the linear combination). These decoders use inter-channel differences and signal adaptive steering mechanisms to produce multi-channel output signals. Matrix steering methods aim at detecting prominent sources (e.g. dialogues). The processing is performed in the time domain.

2.2.2 A Method to Convert Stereo to Multi-Channel Sound

Irwan and Aarts present a method to convert a signal from stereo to multichannel [IA01]. The signal for the surround channels is calculated by using a cross-correlation technique (an iterative estimation of the correlation coefficient is proposed in order to reduce the computational load).

The mixing coefficients for the center channel are obtained using Principal Component Analysis (PCA). PCA is applied to calculate a vector, which indicates the direction of the dominant signal. Only one dominant signal can be detected at a time. The PCA is performed using an iterative gradient descent method (which is less demanding with respect to computational load compared to the standard PCA using an eigenvalue decomposition of the covariance matrix of the observation). The computed vector of direction is similar to the output of a goniometer if all decorrelated signal components are neglected. The direction is then mapped from a two-to a three-channel representation to create the 3 front channels.

2.2.3 An Unsupervised Adaptive Filtering Approach of 2-to-5 Channel Upmix

The authors propose an improved algorithm compared to the method by Irwan and Aarts. The originally proposed method is applied to each sub-band [LD05]. The authors assume w-disjoint orthogonality of the dominant signals. The frequency decomposition is carried out using either a Pseudo Quadrature Mirror Filterbank or a wavelet-based octave filter-bank. A further extension to the method by Irwan and Aarts is the use of an adaptive step size for the iterative computation of the (first) principal component.

2.2.4 Ambience Extraction and Synthesis from Stereo Signals for Multi-channel Audio Upmix Avendano and Jot propose a frequency-domain technique to identify and extract the ambience information in stereo audio signals [AJ02].

The method is based on the computation of an inter-channel coherence index and a non-linear mapping function that allows for the determination of the time-frequency regions that consist mostly of ambience components. Ambient signals are subsequently synthesized and used to feed the surround channels of the multi-channel playback system.

2.2.5 Descriptor Based Spatialization

The authors describe a method for one-to-n upmixing, which can be controlled by an automated classification of the signal [MPA+05]. The paper contains some errors; therefore it might be that the authors aimed at different goals than described in the paper.

The upmix process uses three processing blocks: the "upmix tool", artificial reverberation and equalization. The "upmix tool" consists of various processing blocks, including the extraction of an ambient signal. The method for the extraction of an ambient signal ("spatial discriminator") is based on the comparison of the left and right signal of a stereo recording in the spectral domain. For upmixing mono-signals, artificial reverberation is used.

The authors describe 3 applications: 1-to-2 upmixing, 2-to-5 upmixing, and 1-to-5 upmixing.

Classification of the Audio Signal

The classification process uses a supervised learning approach: Low-level features are extracted from the audio signal and a classifier is applied to classify the audio signal into one of three classes: music, voices or any other sounds.

A particularity of the classification process is the use of a genetic programming method to find optimal features (as compositions of different operations)
optimal combination of the obtained low-level features
the best classifier from a set of available classifiers
the best parameter setting for the chosen classifier 1-to-2 upmixing The upmix is done using reverberation and equalization. If the signal contains voice, the equalization is enabled and reverberation is disabled. Otherwise, the equalization is disabled and reverberation is enabled. No dedicated processing aiming at the suppression of speech in the rear channels is incorporated.

2-to-5 upmixing The authors aim at building a multi-channel soundtrack whereas detected voices are attenuated by muting the center channel.

1-to-5 upmixing The multi-channel signal is generated using reverberation, equalization and the "upmix tool" (which generates a 5.1 signal from a stereo signal. The stereo signal is the output of the reverberation and the input to the "upmix tool".). Different presets are used for music, voices and all other sounds. By controlling reverberation and equalization, a multi-channel soundtrack is build that keeps voices in the center channel and has music and other sounds in all channels.

If the signal contains voice, the reverberation is disabled. Otherwise, reverberation is enabled. Since the extraction of the rear-channel signal relies on a stereo signal, no rear-channel signal is generated when reverberation is disabled (which is the case for voices).

2.2.6 Ambience-Based Upmixing

Soulodre presents a system, which creates a multi-channel signal from a stereo signal [Sou04]. The signal is decomposed into so-called "individual source streams" and "ambience streams". Based on these streams a so-called "Aesthetic Engine" synthesizes the multi-channel output. No further technical details of the decomposition and the synthesis steps are given.

2.3 Upmixing of Audio Signals with Arbitrary Number of Channels 2.3.1 Multichannel Surround Format Conversion and Generalized Up-Mix The authors describe a method based on spatial audio coding using an intermediate mono downmix and introduce an improved method without the intermediate downmix. The improved method comprises passive matrix upmixing and principles known from Spatial Audio Coding. The improvements are gained at the expense of increased data rate of the intermediate audio [GJ07a].

2.3.2 Primary-Ambient Signal Decomposition and Vector-Based Localization for Spatial Audio Coding and Enhancement The authors propose a separation of the input signal into a primary (direct) signal and an ambient signal using Principal Component Analysis (PCA) [GJ07b].

The input signal is modeled as the sum of a primary (direct) signal and an ambient signal. It is assumed that the direct signals have substantially more energy than the ambient signal and both signals are uncorrelated.

The processing is carried out in the frequency domain. The STFT coefficients of the direct signal are obtained from the projection of the STFT coefficients of the input signal onto the first principal component. The STFT coefficients of the ambient signal are computed from the difference of the STFT coefficients of the input signal and the direct signal.

Since only the (first) principal component (i.e. the eigenvector of the covariance matrix corresponding to the largest eigenvalue) is needed, a computationally efficient alternative for the eigenvalue decomposition used in standard PCA is applied (which is an iterative approximation). The cross-correlation needed for the PCA decomposition is also estimated iteratively. The direct and ambient signal add up to the original, i.e. no information is lost in the decomposition.

SUMMARY

In view of the above, there is a need for a low-complexity extraction of an ambient signal from an input audio signal.

Some embodiments according to the invention create an apparatus for extracting an ambient signal on the basis of a time-frequency-domain representation of an input audio signal, the time-frequency-domain representation representing the input audio signal in terms of a plurality of sub-band signals describing a plurality of frequency bands. The apparatus comprises a gain-value determinator configured to determine a sequence of time-varying ambient signal gain values for a given frequency band of the time-frequency-domain representation of the input audio signal in dependence on the input audio signal. The apparatus comprises a weighter configured to weight one of the sub-band signals representing the given frequency band of the time-frequency-domain representation with the time-varying gain values to obtain a weighted sub-band signal. The gain-value determinator is configured to obtain one or more quantitative feature values describing one or more features or characteristics of the input audio signal, and to provide the gain-values as a function of the one or more quantitative feature values, such that the gain values are quantitatively dependent on the quantitative feature values. The gain-value determinator is configured to provide the gain-values such that ambient components are emphasized over non-ambient components in the weighted sub-band signal.

Some embodiments according to the invention provide an apparatus for obtaining weighting coefficients for extracting an ambient signal from an input audio signal. The apparatus comprises a weighting coefficient determinator configured to determine the weighting coefficients such, that gain values obtained on the basis of a weighted combination, using the weighting coefficients (or defined by the weighting coefficients), of a plurality of quantitative feature values describing a plurality of features of a coefficient-determination input audio signal approximate expected gain-values associated with the coefficient-determination input audio signal.

Some embodiments according to the invention provide methods for extracting an ambient signal and for obtaining weighting coefficients.

Some embodiments according to the invention are based on the finding that an ambient signal can be extracted from an input audio signal in a particularly efficient and flexible manner by determining quantitative feature values, for example a sequence of quantitative feature values describing one or more features of the input audio signal, as such quantitative feature values can be provided with limited computational effort and can be translated into gain-values efficiently and flexibly. By describing one or more features in terms of one or more sequences of quantitative feature values, gain values can easily be obtained, which are quantitatively dependent on the quantitative feature values. For example, simple mathematical mappings can be used to derive the gain-values from the feature-values. In addition, by providing the gain-values such that the gain-values are quantitatively dependent on the feature values, a fine-tuned extraction of the ambient components from the input audio signal can be obtained. Rather than making a hard decision as to which components of the input audio signal are the ambient components and which components of the input audio signal are non-ambient components, a gradual extraction of the ambient components can be performed.

In addition, the usage of quantitative feature values allows for a particularly efficient and precise combination of feature values describing different features. Quantitative feature values can, for example, be scaled or processed in a linear or a non-linear way according to mathematical processing rules.

In some embodiments in which multiple feature values are combined to obtain a gain value, details regarding the combination (for example, details regarding a scaling of different feature values) can be adjusted easily, for example by adjusting respective coefficients.

To summarize the above, a concept for extracting an ambient signal comprising a determination of quantitative feature values and also comprising a determination of gain values on the basis of the quantitative feature values may constitute an efficient and low-complexity concept of extracting an ambient signal from an input audio signal.

In some embodiments according to the invention, it has been shown to be particularly efficient to weight one or more of the sub-band signals of the time-frequency-domain representation of the input audio signal. By weighting one or more of the sub-band signals of the time-frequency-domain representation, a frequency-selective or specific extraction of ambient signal components from the input audio signal can be achieved.

Some embodiments according to the invention create an apparatus for obtaining weighting coefficients for extracting an ambient signal from an input audio signal.

Some of these embodiments are based on the finding that coefficients for an extraction of an ambient signal can be obtained on the basis of a coefficient-determination-input-audio-signal, which can be considered as a "calibration signal" or "reference signal" in some embodiments. By using such a coefficient-determination input audio signal, expected gain values of which are for example known or can be obtained with moderate effort, coefficients defining a combination of quantitative feature values can be obtained, such that the combination of quantitative feature values results in gain values which approximate the expected gain values.

According to said concept, it is possible to obtain a set of appropriate weighting coefficients, such that an ambient signal extractor configured with these coefficients may perform a sufficiently good extraction of ambient signals (or ambient components) from input audio signals, which are similar to the coefficient-determination-input-audio-signal.

In some embodiments according to the invention, the apparatus for obtaining weighting coefficients allows for an efficient adaptation of an apparatus for extracting an ambient signal to different types of input audio signals. For example, on the basis of a "training signal", i.e. a given audio signal which serves as the coefficient-determination-input-audio-signal, and which may be adapted to the listening preferences of a user of an ambient signal extractor, an appropriate set of weighting coefficients can be obtained. In addition, by providing the weighting coefficients, optimal usage can be made of the available quantitative feature values describing different features.

Further details, effects and advantages of embodiments according to the invention will be described subsequently.

BRIEF DESCRIPTION OF THE DRAWINGS

Embodiments according to the invention will subsequently be described taking reference to the enclosed Figs. in which.

DETAILED DESCRIPTION OF THE EMBODIMENTS

Apparatus for Extracting an Ambient Signal—First Embodiment

Figure 1:
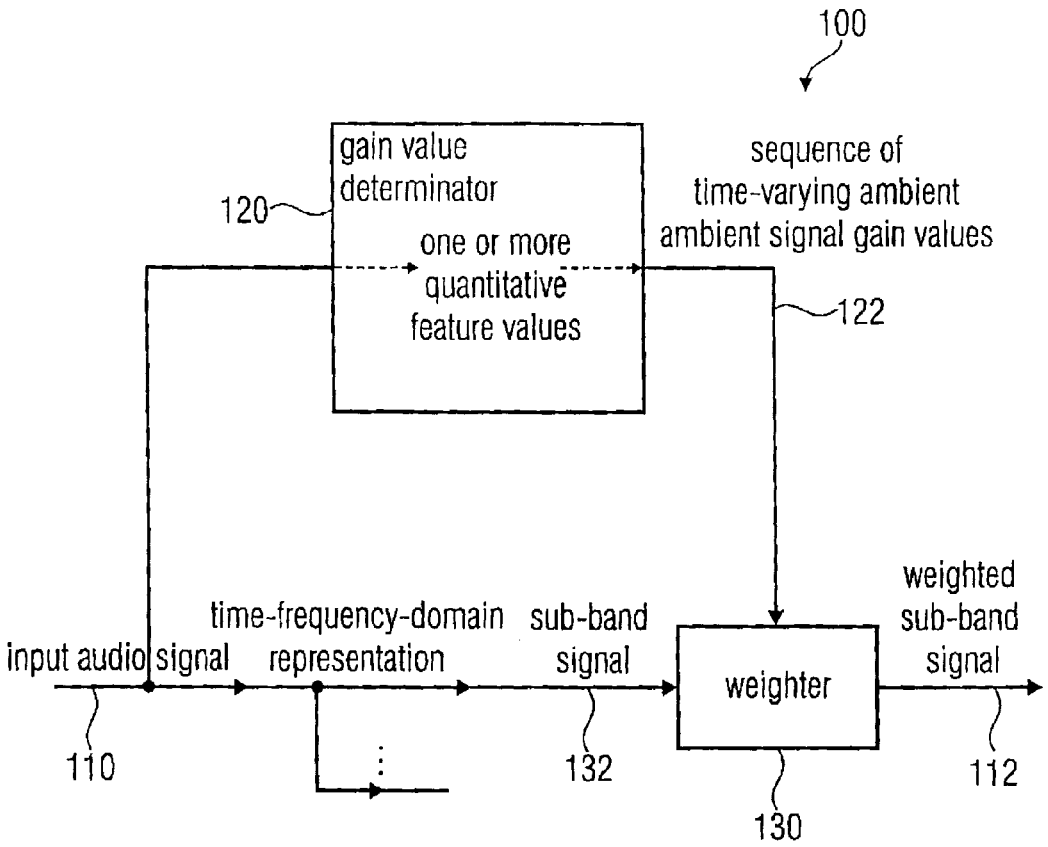
FIG. 1 shows a block schematic diagram of an apparatus for extracting an ambient signal, according to an embodiment according to the invention.

FIG. 1 shows a block schematic diagram of an apparatus for extracting an ambient signal from an input audio signal. The apparatus shown in FIG. 1 is designated in its entirety with 100. The apparatus 100 is configured to receive an input audio signal 110 and to provide at least one weighted sub-band signal on the basis of the input audio signal such that ambience components are emphasized over non-ambience components in the weighted sub-band signal. The apparatus 100 comprises a gain value determinator 120. The gain value determinator 120 is configured to receive the input audio signal 110 and to provide a sequence of time varying ambient signal gain values 122 (also briefly designated as gain-values) in dependence on the input audio signal 110. The gain-value determinator 120 comprises a weighter 130. The weighter 130 is configured to receive a time-frequency-domain representation of the input audio signal or at least one sub-band signal thereof. The sub-band signal may describe one frequency band or one frequency sub-band of the input audio signal. The weighter 130 is further configured to provide the weighted sub-band signal 112 in dependence on the sub-band signal 132, and also in dependence on the sequence of time-varying ambient signal gain values 122.

Based on the above structural description, the functionality of the apparatus 100 will be described in the following. The gain-value determinator 120 is configured to receive the input audio signal 110 and to obtain one or more quantitative feature values describing one or more features or characteristics of the input audio signal. In other words, the gain value determinator 120 may, for example, be configured to obtain a quantitative information characterizing one feature or characteristic of the input audio signal. Alternatively, the gain-value determinator 120 may be configured to obtain a plurality of quantitative feature values (or sequences thereof) describing a plurality of features of the input audio signal. Thus, certain characteristics of the input audio signal, also designated as features (or, in some embodiments, as "low-level features") may be evaluated for providing the sequence of gain-values. The gain-value determinator 120 is further configured to provide the sequence 122 of time-varying ambient signal gain-values as a function of the one or more quantitative feature values (or the sequences thereof).

In the following, the term "feature" will sometimes be used to designate a feature or a characteristic in order to shorten the description.

In some embodiments, the gain-value determinator 120 is configured to provide the time-varying ambient signal gain-values such that the gain-values are quantitatively dependent on the quantitative feature values. In other words, in some embodiments the feature values may take multiple values (in some cases more than two values, and in some cases even more than ten values, and in some cases even a quasi-continuous number of values), and the corresponding ambient signal gain-values may follow (at least over a certain range of feature values) the feature values in a linear or non-linear way. Thus, in some embodiments, a gain-value may increase monotonically with an increase of one of the one or more corresponding quantitative feature-values. In another embodiment, the gain-value may decrease monotonically with an increase of one of the one or more corresponding values.

In some embodiments, the gain-value determinator may be configured to generate a sequence of quantitative feature values describing a temporal evolution of a first feature. Accordingly, the gain-value determinator may, for example, be configured to map the sequence of feature-values describing the first feature on a sequence of gain-values.

In some other embodiments, the gain value determinator may be configured to provide or calculate a plurality of sequences of feature-values describing a temporal evolution of a plurality of different features of the input audio signal 110. Accordingly, the plurality of sequences of quantitative feature-values may be mapped to a sequence of gain-values.

To summarize the above, the gain-value determinator may evaluate one or more features of the input audio signal in a quantitative way and may provide the gain values based thereon.

The weighter 130 is configured to weight a portion of a frequency spectrum of the input audio signal 110 (or even the complete frequency spectrum) in dependence on the sequence of time-varying ambient signal gain-values 122. For this purpose, the weighter receives at least one sub-band signal 132 (or a plurality of sub-band signals) of a time-frequency-domain representation of the input audio signal.

The gain-value determinator 120 may be configured to receive the input audio signal either in a time-domain representation or in a time-frequency-domain representation. However, it has been found that the process of extracting the ambient signal can be performed in a particularly efficient manner if the weighting of the input signal is performed by the weighter using a time-frequency-domain of the input audio signal 110. The weighter 130 is configured to weight the at least one sub-band signal 132 of the input audio signal in dependence on the gain values 122. The weighter 130 is configured to apply the gain values of the sequence of gain values to the one or more sub-band signals 132 to scale the sub-band signals, to obtain one or more weighted sub-band signals 112.

In some embodiments, the gain-value determinator 120 is configured such that features of the input audio signal are evaluated, which characterize (or at least provide an indication) whether the input audio signal 110 or a sub-band thereof (represented by a sub-band signal 132) is likely to represent an ambient component or a non-ambient component of an audio signal. However, the feature values processed by the gain value determinator may be chosen to provide a quantitative information regarding a relationship between ambient components and non-ambient components within the input audio signal 110. For example, the feature values may carry an information (or at least an indication) regarding a relationship between ambient components and non-ambient components in the input audio signal 110, or at least an information describing an estimate thereof.

Accordingly, the gain-value determinator 130 may be configured to generate the sequence of gain-values such that ambience components are emphasized with respect to non-ambience components in the weighted sub-band signal 112, weighted in accordance with the gain-values 122.

To summarize the above, the functionality of the apparatus 100 is based on a determination of a sequence of gain-values on the basis of one or more sequences of quantitative feature-values describing features of the input audio signal 110. The sequence of gain-values is generated such that the sub-band signal 132 representing a frequency band of the input audio signal 110 is scaled with a large gain value if the feature-values indicate a comparatively large "ambience-likeliness" of the respective time-frequency bin and such that the frequency band of the input audio signal 110 is scaled with a comparatively small gain-value if the one or more features considered by the gain-value determinator indicate a comparatively low "ambience-likeliness" of the respective time-frequency bin.

Apparatus for Extracting an Ambient Signal—Second Embodiment

Figure 2:
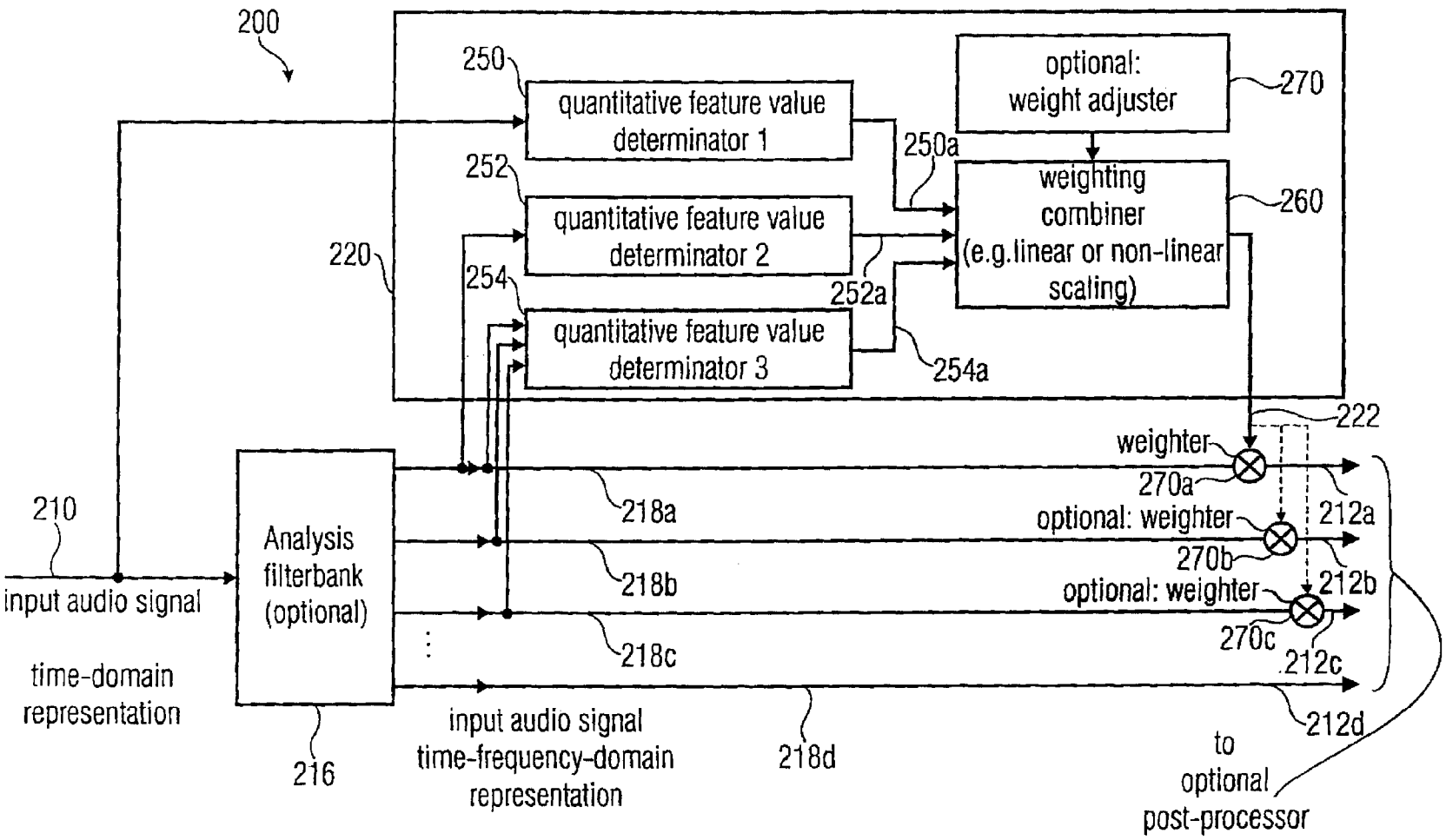
FIG. 2 shows a detailed block schematic diagram of an apparatus for extracting an ambient signal from an input audio signal, according to an embodiment according to the invention.

Taking reference now to FIG. 2, an optional extension of the apparatus 100 shown in FIG. 1 will be described. FIG. 2 shows a detailed block schematic diagram of an apparatus for extracting an ambient signal from an input audio signal. The apparatus shown in FIG. 2 is designed in its entirety with 200.

The apparatus 200 is configured to receive an input audio signal 210 and to provide a plurality of output sub-band signals 212*a* to 212*d*, some of which may be weighted.

The apparatus 200 may, for example, comprise an analysis filterbank 216, which may be considered as optional. The analysis filterbank 216 may, for example, be configured to receive the input audio signal content 210 in a time-domain representation and to provide a time-frequency-domain representation of the input audio signal. The time-frequency-domain representation of the input audio signal may, for example, describe the input audio signal in terms of a plurality of sub-band signals 218*a* to 218*d*. The sub-band signals

218*a* to 218*d* may, for example, represent a temporal evolution of an energy, which is present in different sub-bands or frequency bands of the input audio signal 210. For example, the sub-band signals 218*a* to 218*d* may represent a sequence of Fast Fourier transform coefficients for subsequent (temporal) portions of the input audio signal 210. For example, the first sub-band signal 218*a* may describe a temporal evolution of an energy, which is present in a given frequency sub-band of the input audio signal in subsequent temporal segments, which may be overlapping or non-overlapping. Similarly, the other sub-band signals 218*b* to 218*d* may describe a temporal evolution of energies present in other sub-bands.

The gain-value determinator may (optionally) comprise a plurality of quantitative feature value determinators 250, 252, 254. The quantitative feature value determinators 250, 252, 254 may, in some embodiments, be part of the gain-value determinator 220. However, in other embodiments, the quantitative feature value determinators 250, 252, 254 may be external to the gain-value determinator 220. In this case, the gain-value determinator 220 may be configured to receive quantitative feature values from external quantitative feature value determinators. Both receiving externally generated quantitative feature values and internally generating quantitative feature values will be considered as "obtaining" quantitative feature values.

The quantitative feature value determinators 250, 252, 254 may, for example, be configured to receive an information about the input audio signal and to provide quantitative feature values 250*a*, 252*a*, 254*a* describing, in a quantitative manner different features of the input audio signal.

In some embodiments, the quantitative feature value determinators 250, 252, 254 are chosen to describe, in terms of corresponding quantitative feature values 250*a*, 252*a*, 254*a*, features of the input audio signal 210, which provide an indication with respect to an ambience-component-content of the input audio signal 210 or with respect to a relationship between an ambience-component-content and a non-ambience-component-content of the input audio signal 210.

The gain value determinator 220 further comprises a weighting combiner 260. The weighting combiner 260 may be configured to receive the quantitative feature values 250*a*, 252*a*, 254*a* and to provide, on the basis thereof, a gain-value 222 (or a sequence of gain values). The gain value 222 (or the sequence of gain values) may be used by a weighter unit to weight one or more of the sub-band signals 218*a*, 218*b*, 218*c*, 218*d*. For example, the weighter unit (also sometimes designated briefly as "weighter") may comprise, for example, a plurality of individual scalers or individual weighters 270*a*, 270*b*, 270*c*. For example, a first individual weighter 270*a* may be configured to weight a first sub-band signal 218*a* in dependence on the gain value (or sequence of gain values) 222. Thus, the first weighted sub-band signal 212*a* is obtained. In some embodiments, the gain value (or sequence of gain values) 222 may be used to weight additional sub-band signals. In an embodiment, an optional second individual weighter 270*b* may be configured to weight the second sub-band signal 218*b* to obtain the second weighted sub-band signal 212*b*. Further, a third individual weighter 270*c* may be used to weight the third sub-band signal 218*c* to obtain the third weighted sub-band signal 212*c*. It can be seen from the above discussion that the gain value (or the sequence of gain values) 222 can be used to weight one or more of the sub-band signals 218*a*, 218*b*, 218*c*, 218*d* representing the input audio signal in the form of a time-frequency-domain representation.

Quantitative-Feature-Value Determinators

In the following, various details regarding the quantitative-feature-value determinators 250, 252, 254 will be described.

The quantitative feature value determinators 250, 252, 254 may be configured to use the different types of input information. For example, the first quantitative feature value determinator 250 may be configured to receive, as an input information, a time-domain representation of the input audio signal, as shown in FIG. 2. Alternatively, the first quantitative feature value determinator 250 may be configured to receive an input information describing the overall spectrum of the input audio signal. Thus, in some embodiments, at least one quantitative feature value 250*a* may (optionally) be calculated on the basis of the time-domain representation of the input audio signal or on the basis of another representation describing the input audio signal in its entirety (at least for a given period in time).

The second quantitative feature value determinator 252 is configured to receive, as an input information, a single sub-band signal, for example, the first sub-band signal 218*a*. Thus, the second quantitative-feature-value determinator may, for example, be configured to provide the corresponding quantitative-feature-value 252*a* on the basis of a single sub-band signal. In an embodiment in which the gain value 222 (or the sequence thereof) is applied only to a single sub-band signal, the sub-band signal to which the gain value 222 is applied, may then be identical to the sub-band signal used by the second quantitative feature value determinator 222.

The third quantitative feature value determinator 254 may, for example, be configured to receive, as an input information, a plurality of sub-band signals. For example, the third quantitative feature value determinator 254 is configured to receive, as an input information, the first sub-band signal 218*a*, the second sub-band signal 218*b* and the third sub-band signal 218*c*. Thus, the quantitative feature value determinator 254 is configured to provide the quantitative feature value 254*a* on the basis of a plurality of sub-band signals. In an embodiment in which the gain value 222 (or a sequence thereof) is applied to weight a plurality of sub-band signals (for example, the sub-band signals 218*a*, 218*b*, 218*c*), the sub-band signals to which the gain value 222 is applied, may be identical to the sub-band signals evaluated by the third quantitative feature value determinator 254.

To summarize the above, the gain value determinator 222 may, in some embodiments, comprise a plurality of different quantitative feature value determinators configured to evaluate different input information in order to obtain a plurality of different feature values 250*a*, 252*a* 254*a*. In some embodiments, one or more of the feature value determinators may be configured to evaluate features on the basis of a broad band representation of the input audio signal (for example, on the basis of the time-domain representation of the input audio signal), while other feature value determinators may be configured to evaluate only a portion of a frequency spectrum of the input audio signal 210, or even only a single frequency band or frequency sub-band.

Weighting

In the following, some details regarding the weighting of the quantitative feature values, which is performed, for example, by the weighting combiner 260, will be described.

The weighting combiner 260 is configured to obtain, on the basis of the quantitative feature values 250*a*, 252*a*, 254*a* provided by the quantitative feature value determinators 250, 252, 254, the gain values 222. The weighting combiner may, for example, be configured to linearly scale the quantitative feature values provided by the quantitative feature value determinators. In some embodiments, the weighting combiner may be considered to form a linear combination of the quantitative feature values, wherein different weights (which may, for example, be described by respective weighting coefficients) may be associated to the quantitative feature values. In some embodiments, the weighting combiner may also be configured to process the feature values provided by the quantitative feature value determinators in a non-linear way. The non-linear processing may, for example, be performed prior to the combination or as an integer part of the combination.

In some embodiments, the weighting combiner 260 may be configured to be adjustable. In other words, in some embodiments, the weighting combiner may be configured such that weights associated with the quantitative feature values of the different quantitative feature value determinators are adjustable. For example, the weighting combiner 260 may be configured to receive a set of weighting coefficients, which may, for example, have an impact on a non-linear processing of the quantitative feature values 250*a*, 252*a*, 254*a* and/or on a linear scaling of the quantitative feature values 250*a*, 252*a*, 254*a*. Details regarding the weighting process will be subsequently described.

In some embodiments, the gain value determinator 220 may comprise an optional weight adjuster 270. The optional weight adjuster 270 may be configured to adjust the weighting of the quantitative feature values 250*a*, 252*a*, 254*a* performed by the weighting combiner 260. Details regarding the determination of the weighting coefficients for the weighting of the quantitative feature values will be subsequently described, for example, taking reference to FIGS. 14 to 20. Said determination of the weighting coefficients may for example be performed by a separate apparatus or by the weight adjuster 270.

Apparatus for Extracting an Ambient Signal—Third Embodiment

Figure 3:
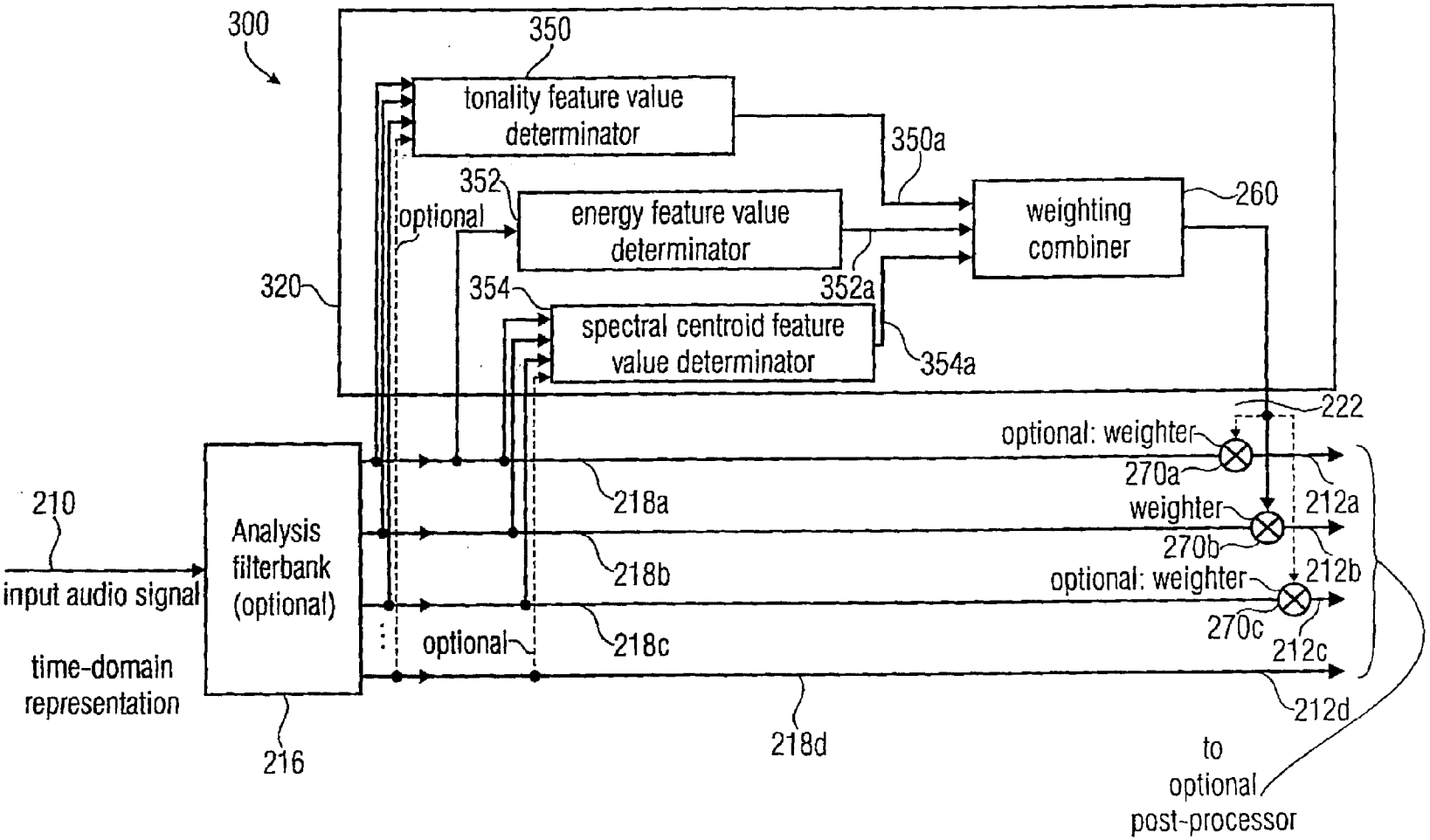
FIG. 3 shows a detailed block schematic diagram of an apparatus for extracting an ambient signal from an input audio signal, according to an embodiment according to the invention.

In the following, another embodiment according to the invention will be described. FIG. 3 shows a detailed block schematic diagram of an apparatus for extracting an ambient signal from an input audio signal. The apparatus shown in FIG. 3 is designated in its entirety with 300.

However, it should be noted that throughout the present description, identical reference numerals are chosen to designate identical means, signals or functionalities.

The apparatus 300 is very similar to the apparatus 200. However, the apparatus 300 comprises a particularly efficient set of feature value determinators.

As can be seen from FIG. 3, a gain value determinator 320, which takes the place of the gain value determinator 220 shown in FIG. 2, comprises, as a first quantitative feature value determinator, a tonality feature value determinator 350. The tonality feature value determinator 350 may, for example, be configured to provide, as a first quantitative feature value, a quantitative tonality feature value 350*a*.

Moreover, the gain value determinator 320 comprises, as a second quantitative feature value determinator, an energy feature value determinator 352, which is configured to provide, as a second quantitative feature value, an energy feature value 352*a*.

Furthermore, the gain value determinator 320 may comprise, as a third quantitative feature value determinator, a spectral centroid feature value determinator 354. The spectral centroid feature value determinator may be configured to provide, as a third quantitative feature value, a spectral centroid feature value describing a centroid of a frequency spectrum of the input audio signal or of a portion of the frequency spectrum of the input audio signal 210.

Accordingly, the weighting combiner 260 may be configured to combine, in a linearly and/or non-linearly weighted manner, the tonality feature value 350*a* (or a sequence thereof), the energy feature value 352*a* (or a sequence thereof) and the spectral centroid feature value 354*a* (or a sequence thereof) to obtain the gain value 222 for weighting the sub-band signals 218*a*, 218*b*, 218*c*, 218*d* (or, at least, one of the sub-band signals).

Apparatus for Extracting an Ambient Signal—Fourth Embodiment

In the following, a possible extension of the apparatus 300 will be discussed, taking reference to FIG. 4. However, the concepts described with reference to FIG. 4 can also be used independent on the configuration shown in FIG. 3.

Figure 4:
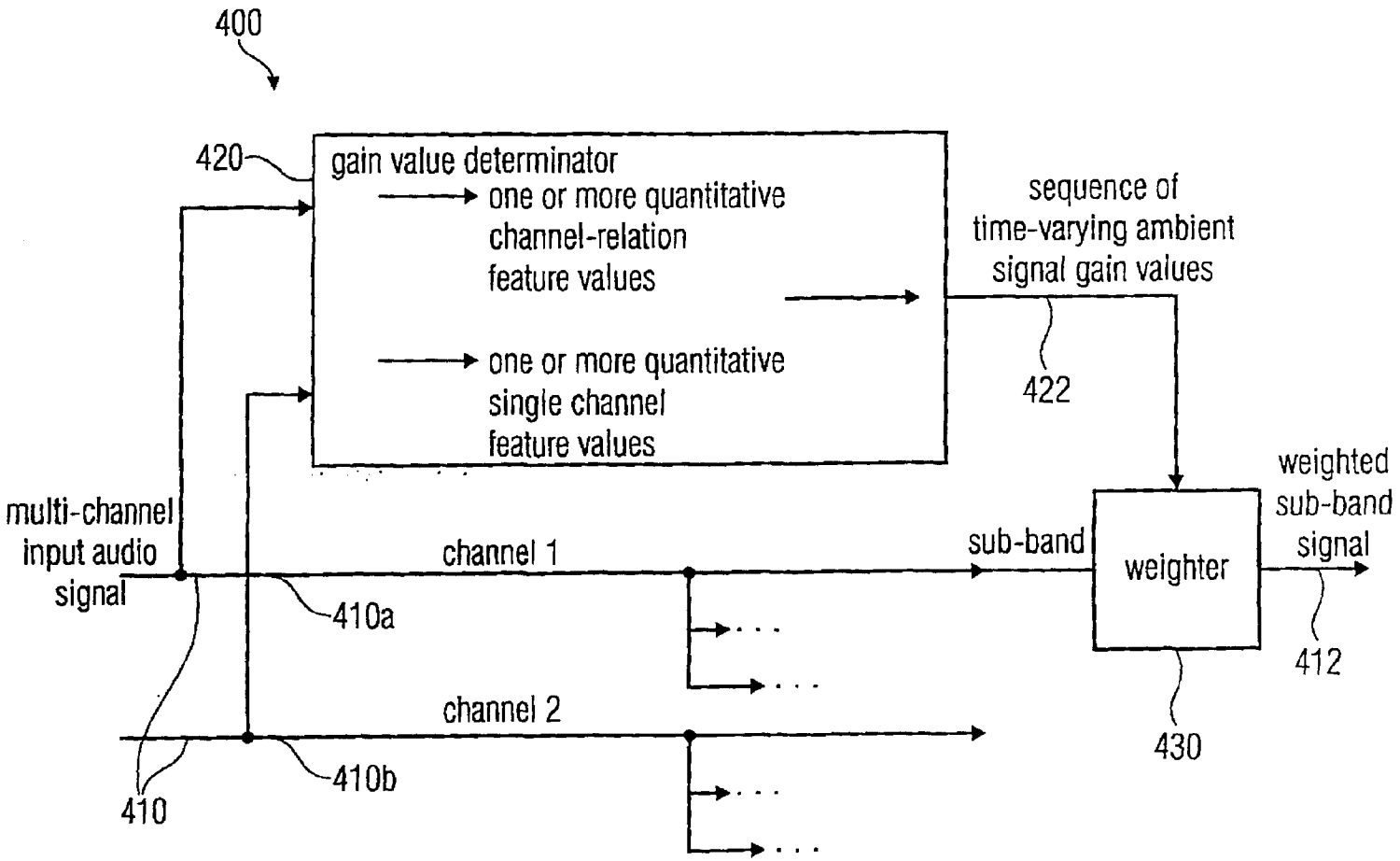
FIG. 4 shows a block schematic diagram of an apparatus for extracting an ambient signal from an input audio signal, according to an embodiment according to the invention.

FIG. 4 shows a block schematic diagram of an apparatus for extracting an ambient signal. The apparatus shown in FIG. 4 is designated in its entirety with 400. The apparatus 400 is configured to receive, as an input signal, a multi-channel input audio signal 410. In addition, the apparatus 400 is configured to provide at least one weighted sub-band signal 412 on the basis of the multi-channel input audio signal 410.

The apparatus 400 comprises a gain value determinator 420. The gain value determinator 420 is configured to receive an information describing a first channel 410*a* and a second channel 410*b* of the multi-channel input audio signal. Moreover, the gain value determinator 420 is configured to provide, on the basis of an information describing the first channel 410*a* and the second channel 410*b* of the multi-channel input audio signal, a sequence of time-varying ambient signal gain values 422. The time varying ambient signal gain values 422 may, for example, be equivalent to the time-varying gain values 222.

Moreover, the apparatus 400 comprises a weighter 430 configured to weight at least one sub-band signal describing the multi-channel input audio signal 410 in dependence on the time-varying ambient signal gain values 422.

The weighter 430 may, for example, comprise the functionality of the weighter 130 or of the individual weighters 270*a*, 270*b*, 270*c*.

Taking reference now to the gain value determinator 420, the gain value determinator 420 may be extended, for example, with reference to the gain value determinator 120, the gain value determinator 220 or the gain value determinator 320, in that the gain value determinator 420 is configured to obtain one or more quantitative channel-relationship feature values. In other words, the gain value determinator 420 may be configured to obtain one or more quantitative feature values describing a relationship between two or more of the channels of the multi-channel input signal 410.

For example, the gain value determinator 420 may be configured to obtain an information describing a correlation between two of the channels of the multi-channel input audio signal 410. Alternatively, or in addition, the gain value determinator 420 may be configured to obtain a quantitative feature value describing a relationship between intensities of signals of a first channel of the multi-channel input audio signal 410 and of a second channel of the input audio signal 410.

In some embodiments, the gain value determinator 420 may comprise one or more channel-relationship gain value determinators configured to provide one or more feature values (or sequences of feature values) describing one or more channel-relationship features. In some other embodiments, in the channel-relationship feature value determinators may be external to the gain value determinator 420.

In some embodiments, the gain value determinator may be configured to determine the gain values by combining, for example in a weighted manner, one or more quantitative channel relationship feature values describing different channel relationship features. In some embodiments, the gain value determinator 420 may be configured to determine the sequence of time-varying ambient signal gain values 422 only on the basis of one or more quantitative channel relation feature values, for example, without considering quantitative single-channel feature values. However, in some other embodiments, the gain value determinator 420 is configured to combine, for example in a weighted manner, one or more quantitative channel relationship feature values (describing one or more different channel-relationship features) and one or more quantitative single channel feature values (describing one or more single channel features). Thus, in some embodiments, both single channel features, which are based on a single channel of the multi-channel input audio signal 410, and channel relationship features, which describe a relationship between two or more channels of the multi-channel input audio signal 410, can be considered to determine the time-varying ambient signal gain values.

Thus, in some embodiments according to the invention, a particularly meaningful sequence of time varying ambient signal gain values can be obtained by taking into consideration both single channel features and channel relationship features. Accordingly, the time-varying ambient signal gain values can be adapted to the audio signal channel to be weighted with said gain values, while still taking into consideration precious information, which can be obtained from evaluating a relationship between multiple channels.

Gain Value Determinator Details

Figure 5:
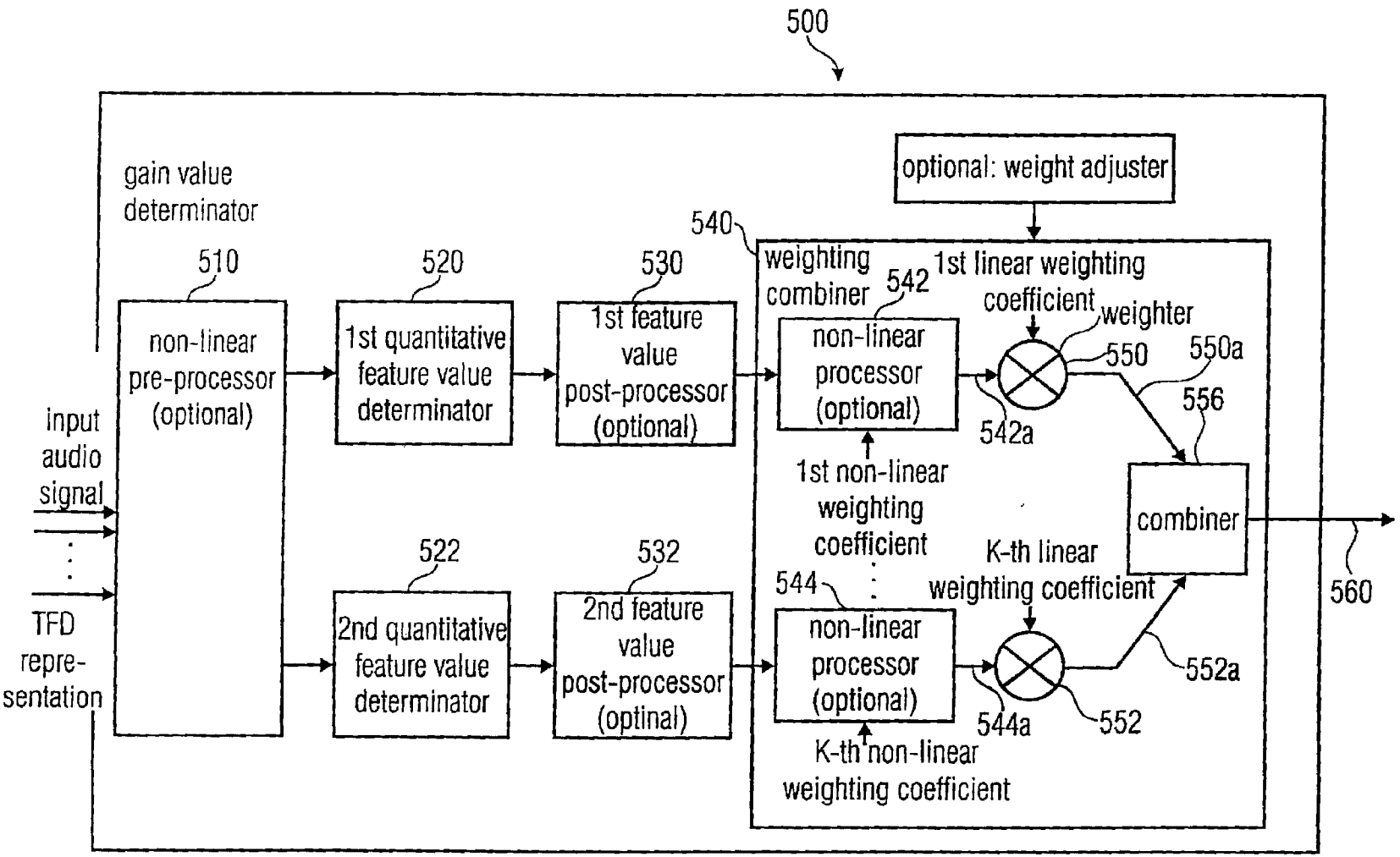
FIG. 5 shows a block schematic diagram of a gain value determinator, according to an embodiment according to the invention.

In the following, details regarding the gain value determinator will be described taking reference to FIG. 5. FIG. 5 shows a detailed block schematic diagram of a gain value determinator. The gain value determinator shown in FIG. 5 is designated in its entirety with 500. The gain value determinator 500 may, for example, take over the functionality of the gain value determinators 120, 220, 320, 420 described herein.

Non-Linear Preprocessor

The gain value determinator 500 comprises an (optional) non-linear pre-processor 510. The non-linear pre-processor 510 may be configured to receive a representation of one or more input audio signals. For example, the non-linear pre-processor 510 may be configured to receive a time-frequency-domain representation of an input audio signal. However, in some embodiments, the non-linear pre-processor 510 may be configured to receive, alternatively or additionally, a time-domain representation of the input audio signal. In some further embodiments, the non-linear pre-processor may be configured to receive a representation of a first channel of an input audio signal (for example, a time-domain representation or a time-frequency-domain representation) and a representation of a second channel of the input audio signal. The non-linear pre-processor may further be configured to provide a pre-processed representation of one or more channels of the input audio signal or at least a portion (for example, a spectral portion) of the pre-processed representation to a first quantitative feature value determinator 520. Moreover, the non-linear pre-processor may be configured to provide another pre-processed representation of the input audio signal (or a portion thereof) to a second quantitative feature value determinator 522. The representation of the input audio signal provided to the first quantitative feature value determinator 520 may be identical to, or different from, the representation of the input audio signal provided to the second quantitative feature value determinator 522.

However, it should be noted that the first quantitative feature value determinator 520 and the second quantitative feature value determinator may be considered as representing two or more feature value determinators, for example K feature value determinators, with K>=1 or K>=2. In other words, the gain value determinator 500 shown in FIG. 5 can be extended by further quantitative feature value determinators, as desired and described herein.

Details regarding the functionality of the non-linear preprocessor will be described below. However, it should be noted that the preprocessing may comprise a determination of magnitude values, energy values, logarithmic magnitude values, logarithmic energy values of the input audio signal or a spectral representation thereof or other nonlinear preprocessing of the input audio signal or a spectral representation thereof.

Feature Value Postprocessors

The gain value determinator 500 comprises a first feature value post-processor 530 configured to receive a first feature value (or a sequence of first feature values) from the first quantitative feature value determinator 520. Moreover, a second feature value post-processor 532 may be coupled to the second quantitative feature value determinator 522 to receive from the second quantitative feature value determinator 522 a second quantitative feature value (or a sequence of second quantitative feature values). The first feature value post-processor 530 and the second feature value post-processor 532 may, for example, be configured to provide respective post-processed quantitative feature values.

For example, the feature value post-processors may be configured to process the respective quantitative feature values such that a range of values of the post-processed feature values is limited.

Weighting Combiner

The gain value determinator 500 further comprises a weighting combiner 540. The weighting combiner 540 is configured to receive the post-processed feature values from the feature value post-processors 530, 532 and to provide, on the basis thereof, a gain value 560 (or a sequence of gain values). The gain value 560 may be equivalent to the gain value 122, the gain value 222, the gain value 322 or to the gain value 422.

In the following, some details regarding the weighting combiner 540 will be discussed. In some embodiments, the weighting combiner 540 may, for example, comprise a first non-linear processor 542. The first non-linear processor 542 may, for example, be configured to receive the first post-processed quantitative feature value and to apply a non-linear mapping to the post-processed first feature value, to provide non-linearly processed feature values 542*a*. Moreover, the weighting combiner 540 may comprise a second non-linear processor 544, which may be configured to be similar to the first non-linear processor 542. The second non-linear processor 544 may be configured to non-linearly map the post-processed second feature value to a non-linearly processed feature value 544*a*. In some embodiments, parameters of non-linear mappings performed by the non-linear processors 542, 544 may be adjusted in accordance with respective coefficients. For example, a first non-linear weighting coefficient may be used to determine the mapping of the first non-linear processor 542 and the second non-linear weighting coefficient may be used to determine the mapping performed by the second non-liner processor 544.

In some embodiments, the one or more of the feature value post-processors 530, 532 may be omitted. In other embodiments, one or all of the non-linear processors 542, 544 may be omitted. In addition, in some embodiments, the functionalities of the corresponding feature value post-processors 530, 532 and non-linear processors 542, 544 may be melted into one unit.

The weighting combiner 540 further comprises a first weighter or scaler 550. The first weighter 550 is configured to receive the first non-linearly processed quantitative feature value (or, in cases where the non-linear processing is omitted, the first quantitative feature value) 542*a* and to scale the first non-linearly processed quantitative value in accordance with a first linear weighting coefficient to obtain a first linearly scaled quantitative feature value 550*a*. The weighting combiner 540 further comprises a second weighter or scaler 552. The second weighter 552 is configured to receive the second non-linearly processed quantitative feature value 544*a* (or, in cases where the non-linear processing is omitted, the second quantitative feature value) and to scale said value in accordance with a second linear weighting coefficient to obtain a second linearly scaled quantitative feature value 552*a*.

The weighting combiner 540 further comprises a combiner 556. The combiner 556 is configured to receive the first linearly scaled quantitative feature value 550*a* and the second linearly scaled quantitative feature value 552*a*. The combiner 556 is configured to provide, on the basis of said values, the gain value 560. For example, the combiner 556 may be configured to perform a linear combination (for example, a summation or an averaging operation) of the first linearly scaled quantitative feature value 550*a* and of the second linearly scaled quantitative feature value 552*a*.

To summarize the above, the gain value determinator 500 may be configured to provide a linear combination of quantitative feature values determined by a plurality of quantitative feature value determinators 520, 522. Prior to the weighted linear combination, one or more non-linear post-processing steps may be performed on the quantitative feature values, for example to limit a range of values and/or to modify a relative weighting of small values and large values.

It should be noted that the structure is the gain value determinator 500 shown in FIG. 5 should be considered exemplary only in order to facilitate the understanding. However, any of the functionalities of the blocks of the gain value determinator 500 could be implemented in a different circuit structure. For example, some of the functionalities could be combined into a single unit. In addition, the functionalities described with reference to FIG. 5 could be performed by shared units. For example, a single feature value post-processor could be used to perform, for example in a time-sharing manner, the post-processing of the feature values provided by a plurality of quantitative feature value determinators. Similarly, the functionality of the non-linear processors 542, 544 could be performed, in a time-sharing manner, by a single non-linear processor. In addition, a single weighter could be used to fulfill the functionality of the weighters 550, 552.

In some embodiments, the functionalities described with reference to FIG. 5 could be performed by a single tasking or multi-tasking computer program. In other words, in some embodiments, a completely different circuit topology can be chosen to implement the gain value determinator, as long as the desired functionality is obtained.

Direct Signal Extraction

Figure 6:
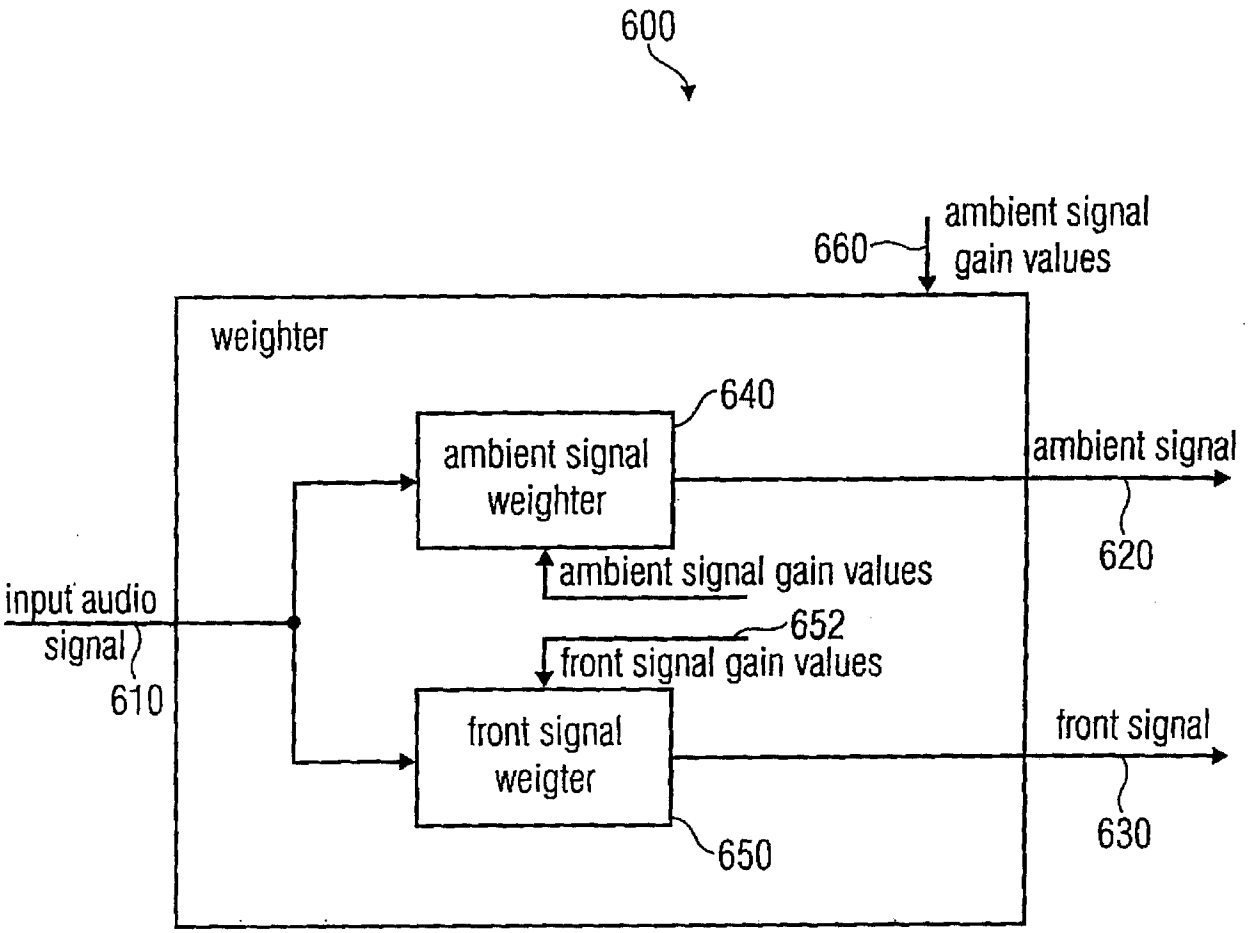
FIG. 6 shows a block schematic diagram of a weighter, according to an embodiment according to the invention.

In the following, some further details will be described with respect to an efficient extraction of both an ambient signal and a front signal (also designated as "direct signal") from an input audio signal. For this purpose, FIG. 6 shows a block schematic diagram of a weighter or weighter unit according to an embodiment according to the invention. The weighter or weighter unit shown in FIG. 6 is designated in its entirety with 600.

The weighter or weighter unit 600 may, for example, take the place of the weighter 130, of the individual weighters 270*a*, 270, 270*c* or of the weighter 430.

The weighter 600 is configured to receive a representation of the input audio signal 610 and to provide both a representation of an ambient signal 620 and of a front signal or a non-ambient signal or a "direct signal" 630. It should be noted that in some embodiments, the weighter 600 may be configured to receive a time-frequency-domain representation of the input audio signal 610 and to provide a time-frequency-domain representation of the ambient signal 620 and of the front signal or non-ambient signal 630.

However, naturally, the weighter 600 may also comprise, if desired, a time-domain to time-frequency-domain converter for converting a time-domain input audio signal into a time-frequency-domain representation and/or one or more time-frequency-domain to time-domain converters to provide time-domain output signals.

The weighter 600 may, for example, comprise an ambient signal weighter 640 configured to provide a representation of the ambient signal 620 on the basis of a representation of the input audio signal 610. In addition, the weighter 600 may comprise a front signal weighter 650 configured to provide a representation of the front signal 630 on the basis of a representation of the input audio signal 610.

The weighter 600 is configured to receive a sequence of ambient signal gain values 660. Optionally, the weighter 600 may be configured to also receive a sequence of front signal gain values. However, in some embodiments, the weighter 600 may be configured to derive the sequence of front signal gain values from the sequence of ambient signal gain values, as will be discussed in the following.

The ambient signal weighter 640 is configured to weight one or more frequency bands (which may, for example, be represented by one or more sub-band signals) of the input audio signal in accordance with the ambient signal gain values to obtain the representation of the ambient signal 620, for example in the form of one or more weighted sub-band signals. Similarly, the front signal weighter 650 is configured to weight one or more frequency bands or frequency sub-bands of the input audio signal 610, which may, for example, be represented in terms of one or more sub-band signals, to obtain a representation of the front signal 630, for example, in the form of one or more weighted sub-band signals.

However, in some embodiments, the ambient signal weighter 640 and the front signal weighter 650 may be configured to weight a given frequency band or frequency sub-band (represented, for example, by a sub-band signal) in a complementary way to generate the representation of the ambient signal 620 and the representation of the front signal 630. For example, if an ambient signal gain value for a specific frequency band indicates that the specific frequency band should be given a comparatively high weight in the ambient signal, the specific frequency band is weighted comparatively high when deriving the representation of the ambient signal 620 from the representation of the input audio signal 610, and the specific frequency band is weighted comparatively low when deriving the representation of the front signal 630 from the representation of the input audio signal 610. Similarly, if the ambient signal gain value indicates that the specific frequency band should be given a comparatively low weight in the ambient signal, the specific frequency band is given a low weight when deriving the representation of the ambient signal 620 from the representation of the input audio signal 610, and the specific frequency band is given a comparatively high weight when deriving the representation of the front signal 630 from the representation of the input audio signal 610.

In some embodiments, the weighter 600 may thus be configured to obtain, on the basis of the ambient signal gain values 660, the front signal gain values 652 for the front signal weighter 650, such that the front signal gain values 652 increase with decreasing ambient signal gain values 660 and vice-versa.

Accordingly, in some embodiments, the ambient signal 620 and the front signal 630 may be generated such that a sum of energies of the ambient signal 620 and of the front signal 630 is equivalent to (or proportional to) an energy of the input audio signal 610.

Post Processing

Taking reference now to FIG. 7, a post-processing will be described, which can, for example, be applied to the one or more weighted sub-band signals 112, 212*a* to 212*b*, 414.

Figure 7:
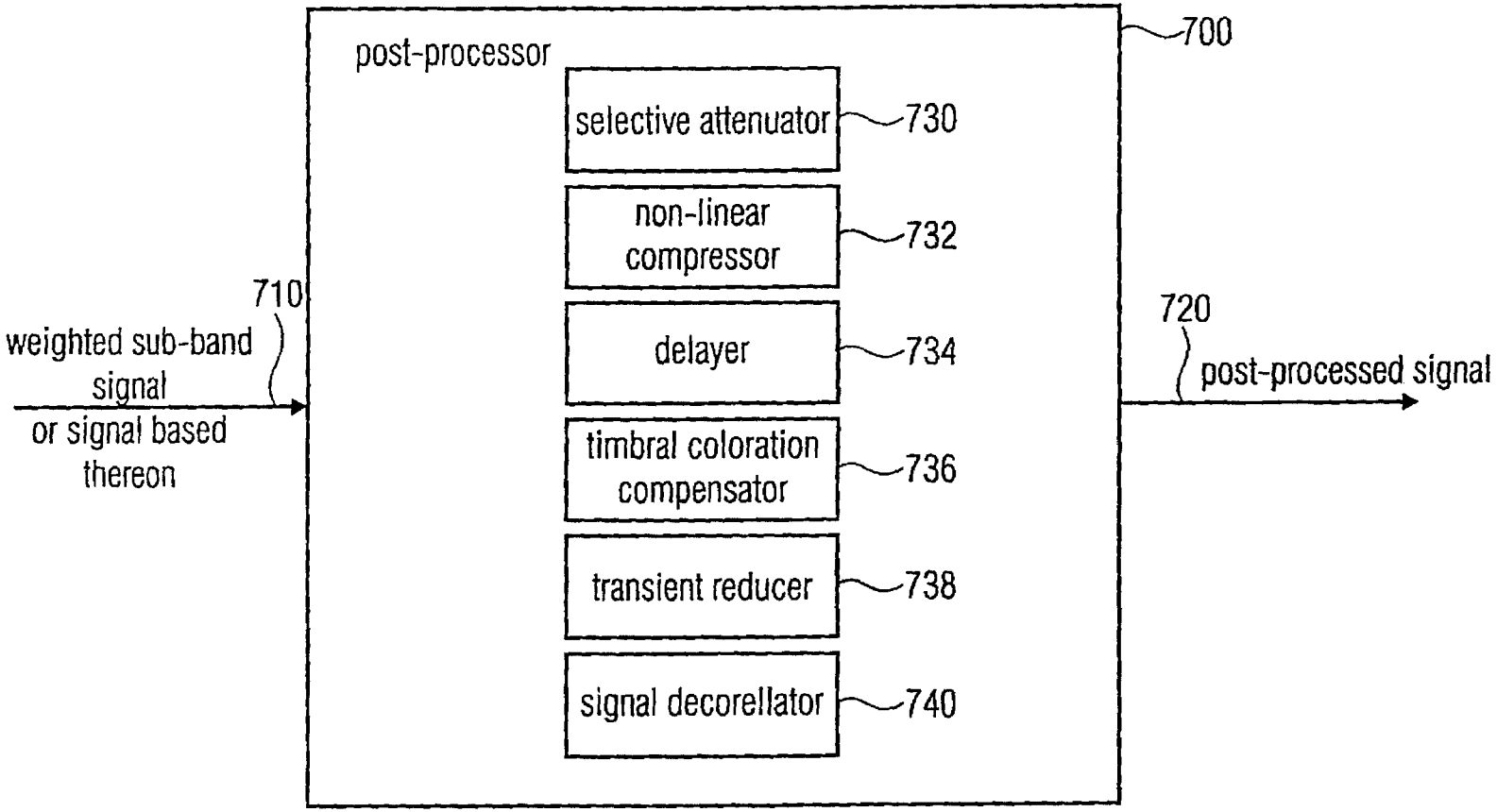
FIG. 7 shows a block schematic diagram of a post processor, according to an embodiment according to the invention.

For this purpose, FIG. 7 shows a block schematic diagram of a post-processor, according to an embodiment according to the invention. The post-processor shown in FIG. 7 is designated in its entirety with 700.

The post-processor 700 is configured to receive, as an input signal, one or more weighted sub-band signals 710 or a signal based thereon (for example, a time-domain signal based on one or more weighted sub-band signals). The post-processor 700 is further configured to provide, as an output signal, a post-processed signal 720. It should be noted here that the post-processor 700 should be considered to be optional.

In some embodiments, the post-processor may comprise one or more of the following functional units, which may, for example, be cascaded:

selective attenuator 730;
non-linear compressor 732;
delayer 734;
timbral coloration compensator 736;
transient reducer 738; and
signal decorelator 740.

Details regarding the functionality of the possible components of the post-processor 700 will be described later on.

However, it should be noted that one or more of the functionalities of the post-processor can be realized in software. In addition, some of the functionalities of the post-processor 700 may be performed in a combined way.

Taking reference now to FIGS. 8*a* and 8*b*, different post-processing concepts will be described.

Figure 8A:
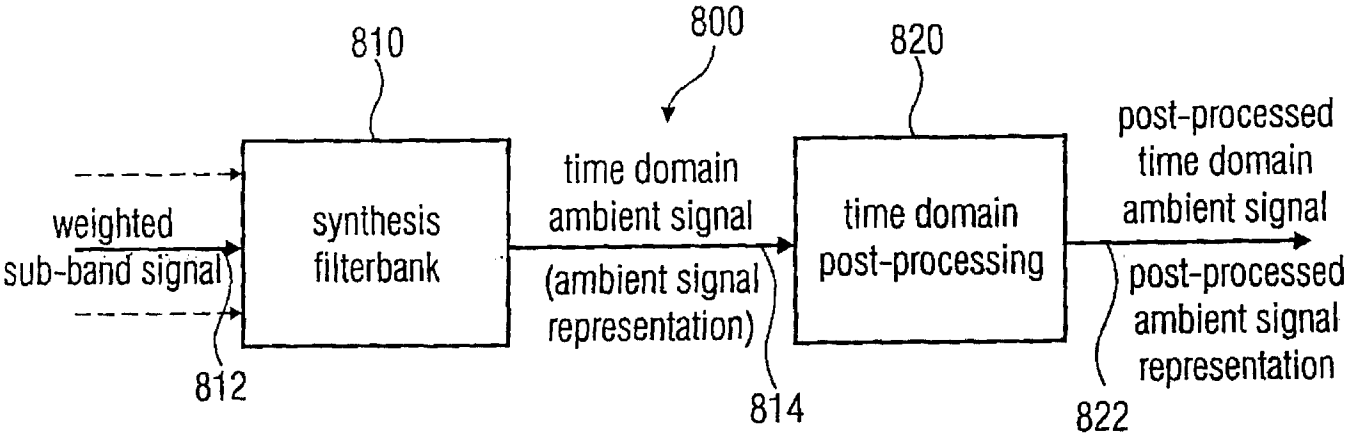
FIGS. 8*a* and 8*b* show extracts from a block schematic diagram of an apparatus for extracting an ambient signal, according to embodiments according to the invention.

FIG. 8 shows a block schematic diagram of a circuit portion for performing a time-domain post-processing. The circuit portion shown in FIG. 8*a* is designated in its entirety with 800. The circuit portion 800 comprises a time-frequency-domain to time-domain converter, for example, in the form of a synthesis filterbank 810. The synthesis filterbank 810 is configured to receive a plurality of weighted sub-band signals 812, which may, for example, be based on, or identical to, the weighted sub-band signals 112, 212*a* to 212*d*, 412. The synthesis filterbank 810 is configured to provide, as an ambient signal representation, a time-domain ambient signal 814. Moreover, the circuit portion 800 may comprise a time domain post-processor 820 configured to receive the time-domain ambient signal 814 from the synthesis filterbank 810. In addition, the time-domain post-processor 820 may be configured to perform, for example, one or more of the functionalities of the post-processor 700 shown in FIG. 7. Consequently, the post-processor 820 may be configured to provide, as an output signal, a post-processed time-domain ambient signal 822, which can be considered as a post-processed ambient signal representation.

To summarize the above, in some embodiments, the post-processing can be performed in the time-domain, if appropriate.

Figure 8B:
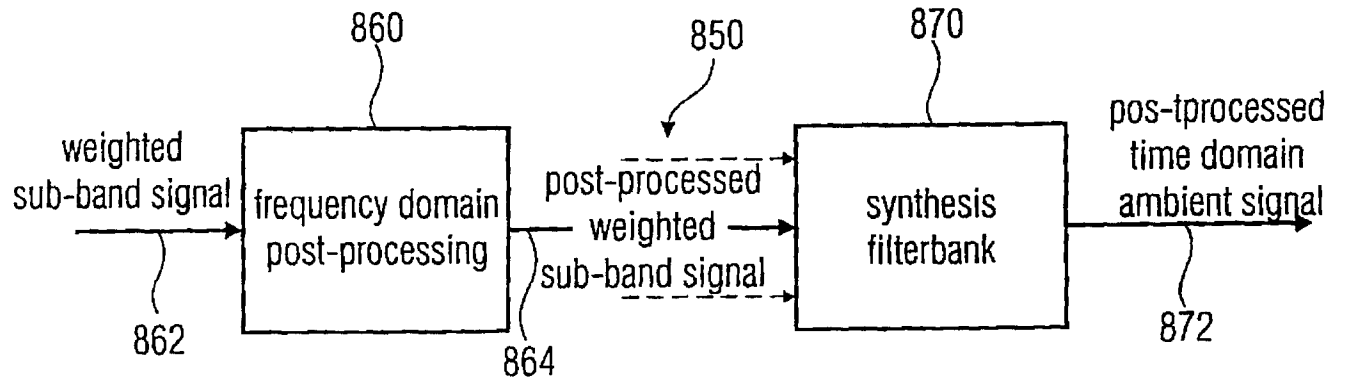

FIG. 8*b* shows a block schematic diagram of a circuit portion according to another embodiment according to the invention. The circuit portion shown in FIG. 8*b* is designated in its entirety with 850. The circuit portion 850 comprises a frequency-domain post-processor 860 configured to receive one or more weighted sub-band signals 862. For example, the frequency domain post-processor 860 may be configured to receive one or more of the weighted sub-band signals 112, 212*a* to 212*d*, 412. Moreover, the frequency-domain post-processor 816 may be configured to perform one or more of the functionalities of the post-processor 700. The frequency-domain post-processor 860 may be configured to provide one or more post-processed weighted sub-band signals 864. The frequency-domain post-processor 860 may be configured to process one or more of the weighted sub-band signals 862 individually. Alternatively, the frequency-domain post-processor 860 may be configured to post-process a plurality of weighted sub-band signals 862 together. The circuit portion 850 further comprises a synthesis filterbank 870 configured to receive a plurality of post-processed weighted sub-band signals 864 and to provide, on the basis thereof, a post-processed time-domain ambient signal 872.

To summarize the above, depending on the requirements, the post-processing can be performed either in the time-domain, as shown in FIG. 8*a*, or in the time-frequency domain, as shown in FIG. 8*b*.

Feature Value Determination

Figure 9:
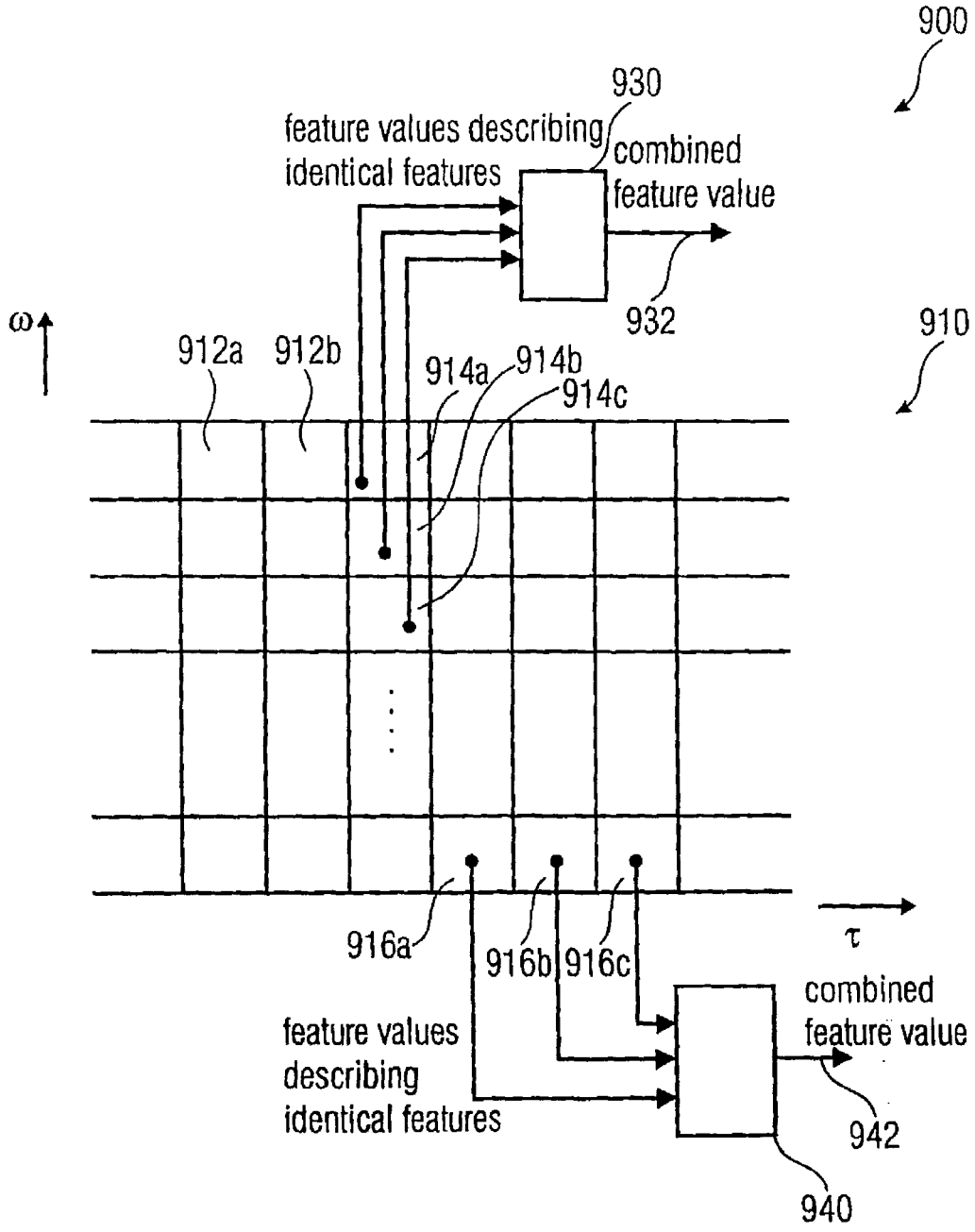
FIG. 9 shows a graphical representation of the concept of extracting feature values from a time-frequency-domain representation.

FIG. 9 shows a schematic representation of different concepts for obtaining feature values. The schematic representation of FIG. 9 is designated in its entirety with 900.

The schematic representation 900 shows a time-frequency-domain representation of an input audio signal. The time-frequency-domain representation 910 shows, in the form of a two-dimensional representation over a time index $\tau$ and a frequency index $\omega$, a plurality of time-frequency bins, two of which are designated with 912*a*, 912*b*.

The time-frequency-domain representation 910 may be represented in any appropriate form, for example in the form of a plurality of sub-band signals (for example, one for each frequency band) or in the form of a data structure for processing in a computer system. It should be noted here that any data structure representing such a time-frequency distribution shall be considered to be a representation of one or more sub-band signals. In other words, any data structure representing a temporal evolution of an intensity (for example, a magnitude or an energy) of a frequency sub-band of an input audio signal shall be considered as a sub-band signal.

Thus, receiving a data structure representing a temporal evolution of the intensity of a frequency sub-band of an audio signal shall be considered as receiving a sub-band signal.

Taking reference to FIG. 9, it can be seen that feature values associated with different time-frequency bins can be computed. For example, in some embodiments, different feature values associated with different time-frequency bins can be computed and combined. For example, frequency feature values can be computed, which are associated with simultaneous time-frequency bins 914*a*, 914*b*, 914*c* of different frequencies. In some embodiments, these (different) feature values describing identical features of different frequency bands can be combined, for example, in a combiner 930. Accordingly, a combined feature value 932 can be obtained, which may be further processed (for example, combined with other individual or combined feature values) in the weighting combiner. In some embodiments, a plurality of feature values can be computed, which are associated with subsequent time-frequency bins 916*a*, 916*b*, 916*c* of the same frequency band (or frequency sub-bands). These feature values describing identical features of subsequent time-frequency bins can, for example, be combined in a combiner 940. Accordingly, a combined feature value 942 can be obtained.

To summarize the above, in some embodiments, it may be desirable to combine a plurality of individual feature values describing the same feature, which are associated with different time-frequency bins. For example, individual feature values associated with simultaneous time-frequency bins and/or individual feature values associated with subsequent time-frequency bins can be combined.

Apparatus for Extracting an Ambient Signal—Fifth Embodiment

In the following, an ambient extractor according to another embodiment will be described taking reference to FIGS. 10, 11 and 12.

Upmixing Overview

Figure 10:
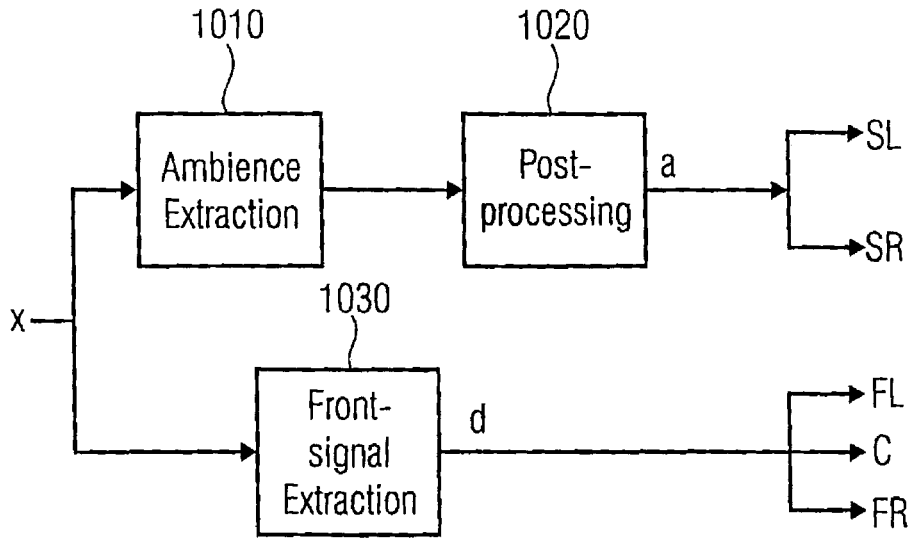
FIG. 10 shows a block diagram of an apparatus or a method for performing an 1-to-5 upmixing, according to an embodiment according to the invention.

FIG. 10 shows a block diagram of an upmix process. For example, FIG. 10 can be interpreted as a block schematic diagram of an ambient signal extractor. Alternatively, FIG. 10 can be interpreted as a flow chart of a method for extracting an ambient signal from an input audio signal.

As can be seen from FIG. 10, an ambient signal "a" (or even a plurality of ambient signals) and a front signal "d" (or a plurality of front signals) are computed from an input signal "x" and routed to appropriate output channels of a surround sound signal. The output channels are denoted to illustrate an example of upmixing to a 5.0 surround sound format: SL designates a left surround channel, SR designated a right surround channel, FL designates a left front channel, C designates a center channel and FR designates a right front channel.

In other words, FIG. 10 describes a generation of a surround signal comprising, for example, five channels on the basis of an input signal comprising, for example, only one or two channels. An ambience extraction 1010 is applied to the input signal x. A signal provided by the ambient extraction 1010 (and in which, for example, ambience-like components of the input signal x may be emphasized relative to non-ambience-like components) is fed to a post-processing 1020. As a result of the post-processing 1020, one or more ambient signals a are obtained. Consequently, the one or more ambient signals a may be provided as a left surround channel signal SL and as a right surround channel signal SR.

The input signal x may also be fed to a front signal extraction 1030 to obtain one or more front signals d. The one or more front signals d may, for example, be provided as a left front channel signal FL, as a center channel signal C and as a right front channel signal FR.

However, it should be noted that the ambience extraction and the front signal extraction may be coupled, for example, using the concept described with reference to FIG. 6.

Moreover, it should be noted that different upmixing configurations can be chosen. For example, the input signal x may be a single channel signal or a multi-channel signal. In addition, a variable number of output signals may be provided. For example, in a very simple embodiment, the front signal extraction 1030 may be omitted such that only one or more ambient signals are generated. For example, in some embodiments, it is sufficient to provide a single ambient signal. However, in some embodiments, two or even more ambient signals may be provided, which may, for example, be decorrelated at least partly.

In addition, the number of front signals extracted from the input signal x may depend on the application. While in some embodiments the extraction of a front signal may even be omitted, a plurality of front signals may be extracted in some other embodiments. For example, the extraction of three front signals may be performed. In some other embodiments, even five or more front signals may be extracted.

Ambience Extraction

In the following, details regarding the ambience extraction will be described taking reference to FIG. 11. FIG. 11 shows a block diagram of a process for the extraction of the ambient signal and for the extraction of the front signal. The block diagram shown in FIG. 11 can be considered either as a block schematic diagram of an apparatus for extracting an ambient signal or as a flow chart representation of a method for extracting an ambient signal.

Figure 11:
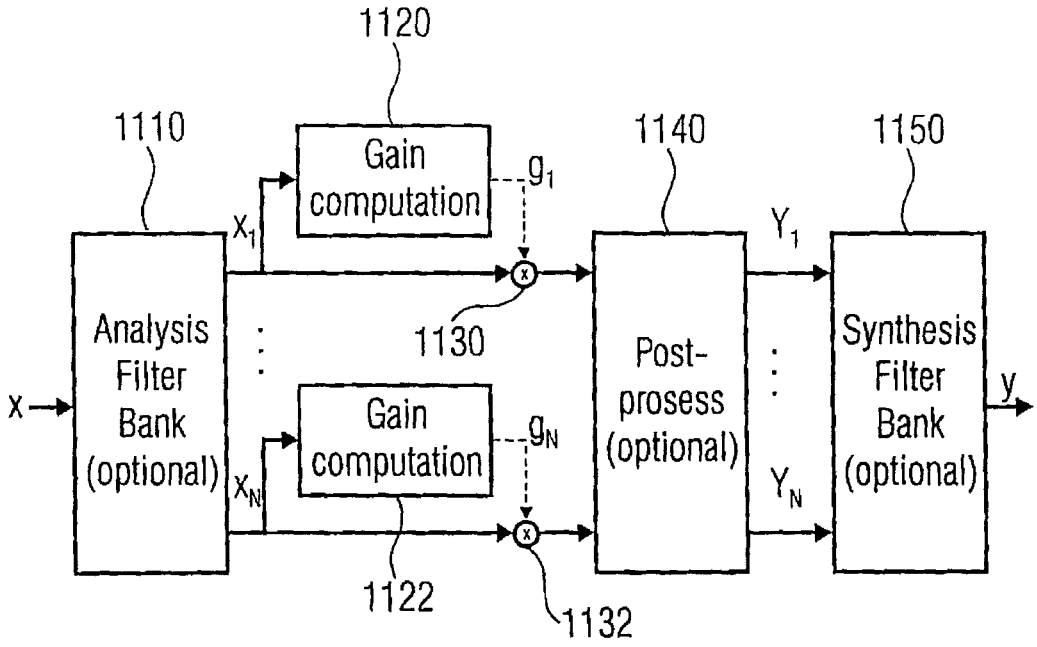
FIG. 11 shows a block diagram of an apparatus or of a method for extracting an ambient signal, according to an embodiment according to the invention.

The block diagram of FIG. 11 shows a generation 1110 of a time-frequency-domain representation of the input signal x. For example, a first frequency band or frequency sub-band of the input output signal x may be represented by a sub-band data structure or a sub-band signal $X_1$. An N-th frequency band or frequency sub-band of the input output signal x may be represented by a sub-band data structure or a sub-band signal $X_N$ The time-domain to time-frequency-domain conversion 1110 provides a plurality of signals describing intensities in different frequency bands of the input audio signal. For example, a signal X1 may represent A temporal evolution of intensities (and, optionally, additional phase information) of a first frequency band or frequency sub-band of the input audio signal. The signal X1 can, for example, be represented as an analog signal or as a sequence of values (which may, for example, be stored on a data carrier). Similarly, a N-th signal XN describes intensities in a N-th frequency band or frequency sub-band of the input audio signal. The signal X1 may also be designated as a first sub-band signal and the signal XN may be designated as a N-th sub-band signal.

The process shown in FIG. 11 further comprises a first gain computation 1120 and a second gain computation 1122. The gain computations 1120, 1122 may, for example, be implemented using respective gain value determinators, as described herein. The gain computation may, for example, be performed individually for the frequency sub-bands, as shown in FIG. 11. However, in some other embodiments, the gain computation may be performed for a group of sub-band signals. In addition, the gain computation 1120, 1122 may be performed on the basis of single sub-bands or on the basis of a group of sub-bands. As can be seen from FIG. 11, the first gain computation 1120 receives the first sub-band signal $X_1$, and is configured or performed to provide a first gain value $g_1$. The second gain computation 1122 is configured or performed to provide a N-th gain value $g_N$, for example, on the basis of the N-th sub-band signal $X_N$. The process shown in FIG. 11 also comprises a first multiplication or scaling 1130 and a second multiplication or scaling 1132. In the first multiplication 1130, the first sub-band signal $X_1$ is multiplied with the first gain value $g_1$ provided by the first gain computation 1120, to yield a weighted first sub-band signal. Moreover, the N-th sub-band signal $X_N$ is multiplied with the N-th gain value $g_N$ in the second multiplication 1032 to obtain a N-th weighted sub-band signal.

The process 1100 further optionally comprises a post-processing 1140 of the weighted sub-band signals to obtain post-processed sub-band signals Y1 to YN. Moreover, the process shown in FIG. 1 optionally comprises a time-frequency-domain to time-domain conversion 1150, which may, for example, be effected using a synthesis filterbank. Thus, a time-domain representation y of the ambient components of the input audio signal x is obtained on the basis of the time-frequency-domain representation Y1 to YN of the ambient components of the input audio signal.

However, it should be noted that the weighted sub-band signals provided by the multiplication 1130, 1132 may also serve as an output signal of the process shown in FIG. 11.

Gain Value Determination

In the following, the gain computation process will be described taking reference to FIG. 12. FIG. 12 shows a block diagram of a gain computation process for one sub-band of the ambient signal extraction process and of the front signal extraction process using low-level features extraction. Different low-level features are computed (for example designated with LLF1 to LLF n) from the input signal x. The gain factor (for example, designated with g) is computed as a function of the low-level features (for example, using a combiner).

Figure 12:
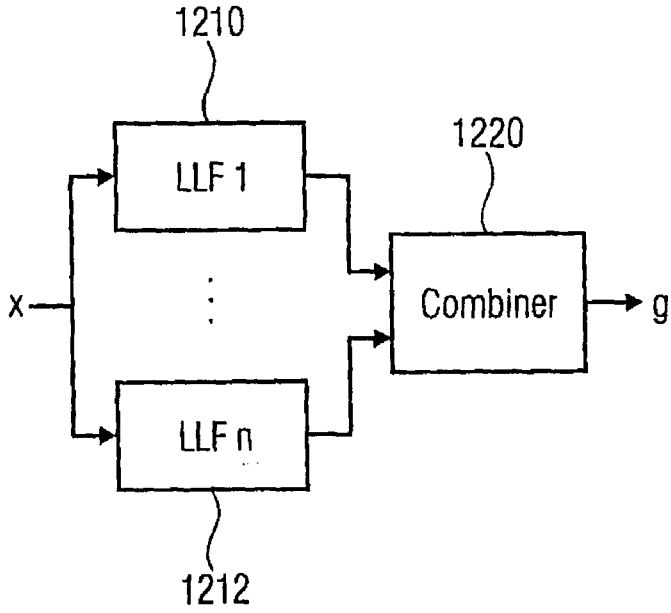
FIG. 12 shows a block diagram of an apparatus or a method for performing a gain computation, according to an embodiment according to the invention.

Taking reference to FIG. 12, a plurality of low-level feature computations is shown. For example, a first low-level feature computation 1210 and a n-th low-level feature computation 1212 are used in the embodiment shown in FIG. 12. The low-level feature computation 1210, 1212 is performed on the basis of the input signal x. For example, the calculation or determination of the low-level features may be performed on the basis of the time-domain input audio signal. However, alternatively, the computation or determination of the low-level features may be performed on the basis of one or more sub-band signals X1 to XN. Moreover, feature values (for example, quantitative feature values) obtained from the computation or determination 1210, 1212 of the low-level features may be combined, for example, using a combiner 1220 (which may for example be a weighting combiner). Thus, the gain value g may be obtained on the basis of a combination of the results of the low-level feature determination or a low-level feature calculation 1210, 1212.

Concept for Determining Weighting Coefficients

In the following, a concept for obtaining weighting coefficients for weighting a plurality of feature values, to obtain a gain value as a weighted combination of the feature values, will be described.

Apparatus for Determining Weighting Coefficients—First Embodiment

Figure 13:
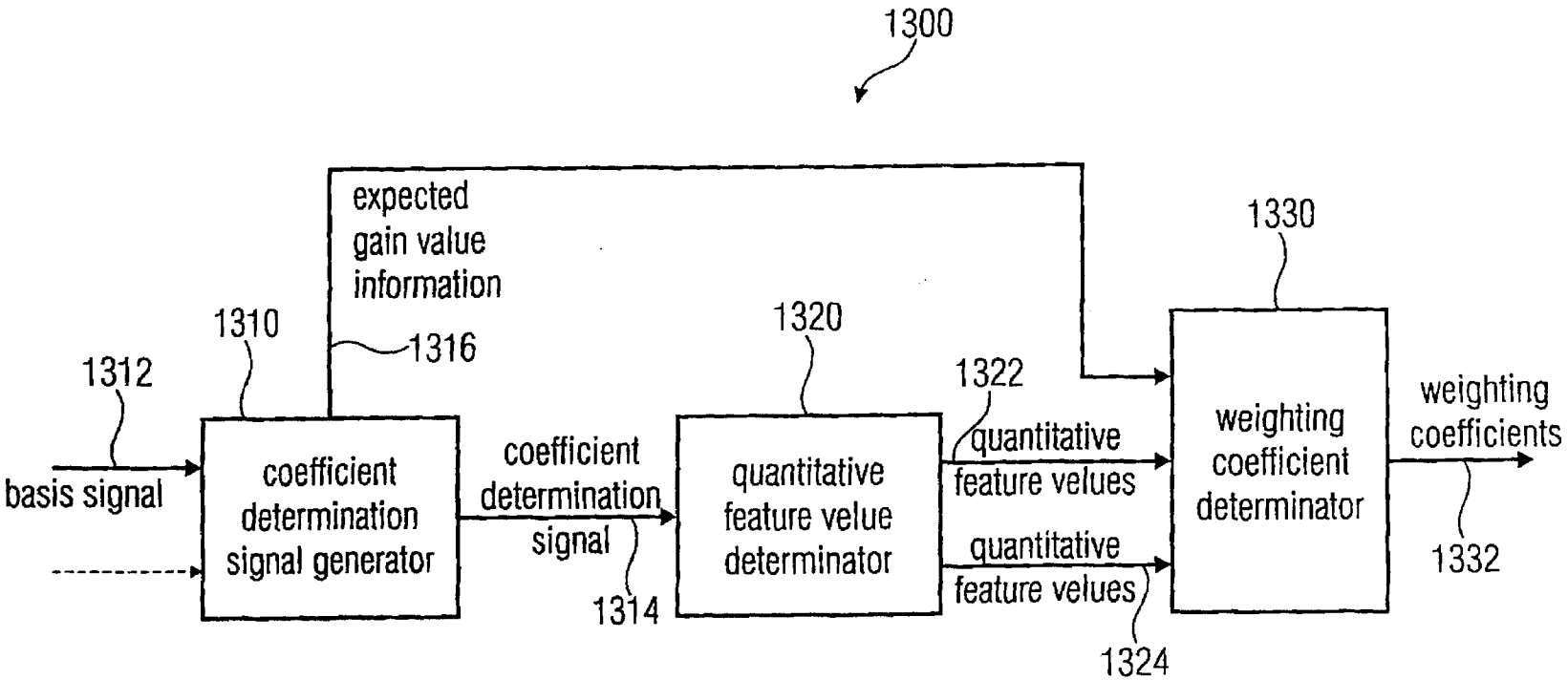
FIG. 13 shows a block schematic diagram of an apparatus for obtaining weighting coefficients, according to an embodiment according to the invention.

FIG. 13 shows a block schematic diagram of an apparatus for obtaining weighting coefficients. The apparatus shown in FIG. 13 is designated in its entirety with 1300.

The apparatus 1300 comprises a coefficient determination signal generator 1310, which is configured to receive a basis signal 1312 and to provide, on the basis thereof, a coefficient determination signal 1314. The coefficient determination signal generator 1310 is configured to provide the coefficient determination signal 1314 such that characteristics of the coefficient determination signal 1314 with respect to ambience components and/or with respect to non-ambience components and/or a relationship between ambience components and non-ambience components are known. In some embodiments, it is sufficient if an estimate of such an information related to ambience components or non-ambience components is known.

For example, the coefficient determination signal generator 1310 may be configured to provide, in addition to the coefficient determination signal 1314, an expected gain value information 1316. The expected gain value information 1316 describes, for example directly or indirectly, a relationship between ambience components and non-ambience components of the coefficient determination signal 1314. In other words, the expected gain value information 1316 can be considered as a side information describing ambience-component related characteristics of the coefficient determination signal. For example, the expected gain value information may describe an intensity of ambience components in the coefficient determination audio signal (for example for a plurality of time-frequency bins of the coefficient determination audio signal). Alternatively, the expected gain value information may describe an intensity of non-ambience components in the coefficient determination audio signal. In some embodiments, the expected gain value information may describe a ratio between intensities of ambience components and non-ambience components. In some other embodiments, the expected gain value information may describe a relationship between an intensity of an ambience component and a total signal intensity (ambience and non-ambience components) or a relationship between an intensity of a non-ambience component and a total signal intensity. However, other information derived from the above mentioned information may be provided as the expected gain value information. For example, an estimate of $R_{AD}$ (m,k) defined below or an estimate of G(m,k) may be obtained as the expected gain value information.

The apparatus 1300 further comprises a quantitative feature value determinator 1320 configured to provide a plurality of quantitative feature values 1322, 1324 describing, in a quantitative way, features of the coefficient determination signal 1314.

The apparatus 1300 further comprises a weighting coefficient determinator 1330, which may, for example, be configured to receive the expected gain value information 1316 and the plurality of quantitative feature values 1322, 1324 provided by the quantitative feature value determinator 1320.

The weighting coefficient determinator 1320 is configured to provide a set of weighting coefficients 1332 on the basis of the expected gain value information 1316 and the quantitative feature values 1322, 1324, as will be described in detail in the following.

Weighting Coefficient Determinator, First Embodiment

Figure 14:
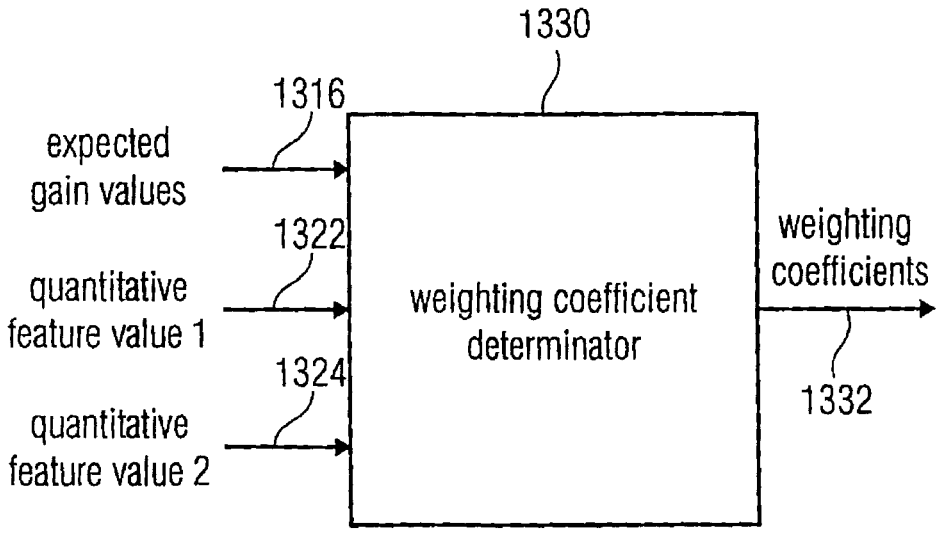
FIG. 14 shows a block schematic diagram of another apparatus for obtaining weighting coefficients, according to an embodiment according to the invention.

FIG. 14 shows a block schematic diagram of a weighting coefficient determinator according to an embodiment according to the invention.

The weighting coefficient determinator 1330 is configured to receive the expected gain value information 1316 and the plurality of quantitative feature values 1322, 1324. However, in some embodiments, the quantitative feature value determinator 1320 may be a part of the weighting coefficient determinator 1330. Moreover, the weighting coefficient determinator 1330 is configured to provide the weighting coefficient 1332.

Regarding the functionality of the weighting coefficient determinator 1330, it can generally be said that the weighting coefficient determinator 1330 is configured to determine the weighting coefficient 1332 such that gain values obtained, using the weighting coefficients 1332, on the basis of a weighted combination of the plurality of quantitative feature values 1322, 1324 (describing a plurality of features of the coefficient determination signal 1314, which can be considered as an input audio signal) approximate gain values associated with the coefficient determination audio signal. The expected gain values may, for example, be derived from the expected gain value information 1316.

In other words, the weighting coefficient determinator may, for example, be configured to determine which weighting coefficients are required to weight the quantitative feature values 1322, 1324 such that the result of the weighting approximates the expected gain values described by the expected gain value information 1316.

In other words, the weighting coefficient determinator may, for example, be configured to determine the weighting coefficients 1332 such that a gain value determinator configured according to the weighting coefficients 1332 provides a gain value, which deviates from an expected gain value described by the expected gain value information 1316 by no more than a predetermined maximum allowable deviation.

Weighting Coefficient Determinator, Second Embodiment

In the following, some specific possibilities for implementing the weighting coefficient determinator 1330 will be described.

Figure 15A:
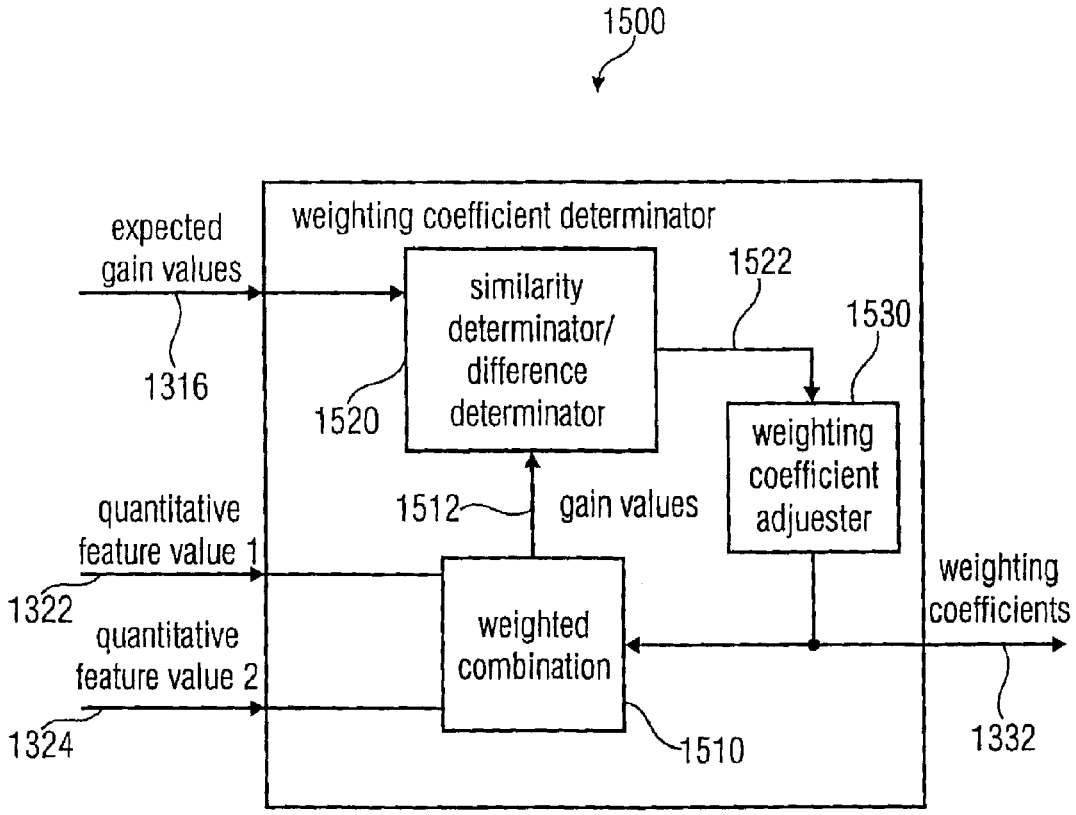
FIGS. 15*a* and 15*b* show block schematic diagrams of apparatus for obtaining weighting coefficients, according to embodiments according to the invention.

FIG. 15*a* shows a block schematic diagram of a weighting coefficient determinator according to an embodiment according to the invention. The weighting coefficient determinator shown in FIG. 15*a* is designated in its entirety with 1500.

The weighting coefficient determinator 1500 comprises, for example, a weighting combiner 1510. The weighting combiner 1510 may, for example, be configured to receive the plurality of quantitative feature values 1322, 1324 and a set of weighting coefficients 1332. Moreover, the weighting combiner 1510 may, for example, be configured to provide a gain value 1512 (or a sequence thereof) by combining the quantitative feature values 1322, 1324 in accordance with the weighting coefficients 1332. For example, the weighting combiner 1510 may be configured to perform a similar or identical weighting, like the weighting combiner 260. In some embodiments, the weighting combiner 260 may even be used to implement the weighting combiner 1510. Thus, the weighting combiner 1510 is configured to provide a gain value 1512 (or a sequence thereof).

The weighting coefficient determinator 1500 further comprises a similarity determinator or difference determinator 1520. The similarity determinator or difference determinator 1520 may, for example, be configured to receive the expected gain value information 1316 describing expected gain values and the gain values 1512 provided by the weighting combiner 1510. The similarity determinator/difference determinator 1520 may, for example, be configured to determine a similarity measure 1522 describing, for example in a qualitative or quantitative manner, the similarity between the expected gain values described by the information 1316 and the gain values 1512 provided by the weighting combiner 1510. Alternatively, the similarity determinator/difference determinator 1520 may be configured to provide a deviation measure describing a deviation therebetween.

The weighting coefficient determinator 1500 comprises a weighting coefficient adjuster 1530, which is configured to receive the similarity information 1522 and to determine, on the basis thereof, whether it is required to change the weighting coefficients 1332 or whether the weighting coefficients 1332 should be kept constant. For example, if the similarity information 1522 provided by the similarity determinator/difference determinator 1520 indicates that a difference or deviation between the gain values 1512 and the expected gain values 1316 is below a predetermined deviation threshold, the weighting coefficient adjuster 1530 may recognize that the weighting coefficients 1332 are appropriately chosen and should be maintained. However, if the similarity information 1522 indicates that the difference or deviation between the gain values 1512 and the expected gain values 1316 is larger than a predetermined threshold, the weighting coefficient adjuster 1530 may change the weighting coefficient 1332, aiming at a reduction of the difference between the gain values 1512 and the expected gain values 1316.

It should be noted here that different concepts for the adjustment of the weighting coefficients 1332 are possible. For example, gradient descent concepts can be used for this purpose. Alternatively, a random change of the weighting coefficients could also be performed. In some embodiments, the weighting coefficient adjuster 1530 may be configured to perform an optimization functionality. The optimization may, for example, be based on an iterative algorithm.

To summarize the above, in some embodiments, a feedback loop or a feedback concept may be used to determine weighting coefficients 1332, resulting in a sufficiently small difference between the gain values 1512 obtained by the weighting combiner 1510 and the expected gain values 1316.

Weighting Coefficient Determinator, Third Embodiment

Figure 15B:
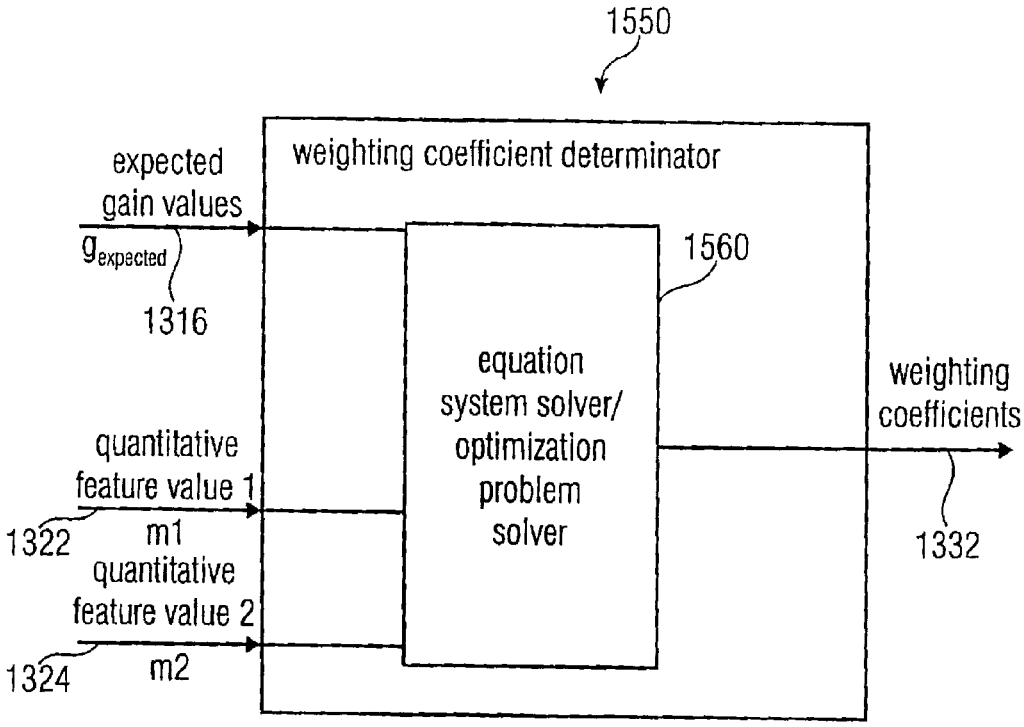

FIG. 15*b* shows a block schematic diagram of another implementation of a weighting coefficient determinator. The weighting determinator shown in FIG. 15*b* is designated in its entirety with 1550.

The weighting coefficient determinator 1550 comprises an equation system solver 1560 or an optimization problem solver 1560. The equation system solver or optimization problem solver 1560 is configured to receive an information 1316 describing expected gain values, which may be designated with $g_{expected}$. The equation system solver/optimization problem solver 1560 may further be configured to receive a plurality of quantitative feature values 1322, 1324. The equation system solver/optimization problem solver 1560 may be configured to provide a set of weighting coefficients 1332.

Assuming that the quantitative feature values received by the equation system solver 1560 are designated with $m_i$ and further assuming that weighting coefficients are, for example, designated with $\alpha_i$ and $\beta_i$, the equation system solver may, for example, be configured to solve a non-linear system of equations of the form:

$$g_{expected,l} = \sum_{i=1}^{K} \alpha_i m_{l,i}^{\beta_i}$$

for l=1, . . . , L $g_{expected,l}$ may designate an expected gain value for a time-frequency bin having index l. $m_{l,i}$ designates an i-th feature value for the time-frequency bin having index l. A plurality of L time-frequency bins may be considered for solving the system of equations.

Accordingly, linear weighting coefficients $\alpha_i$ and non-linear weighting coefficients (or exponent weighting coefficients) $\beta_i$ can be determined by solving a system of equations.

In an alternative embodiment, an optimization can be performed. For example, a value determined by $$\left\| \begin{pmatrix} g_{expected,1} - \sum_{i=1}^{K} \alpha_i m_{1,i}^{\beta_i} \\ \vdots \\ g_{expected,L} - \sum_{i=1}^{K} \alpha_i m_{L,i}^{\beta_i} \end{pmatrix} \right\|$$

can be minimized by determining a set of appropriate weighting coefficient $\alpha_i$, $\beta_i$. Here, (.) designates a vector of differences between expected gain values and gain values obtained by weighting feature values $m_{l,i}$. The entries of the vector of differences may relate to different time-frequency bins, designated with index l=1 . . . L. ||.|| designates a mathematical distance measure, for example a mathematical vector norm.

In other words, the weighting coefficients may be determined such that the difference between the expected gain values and the gain value obtained from a weighted combination of the quantitative feature values 1322, 1324 is minimized. However, it should be noted that the term "minimized" should not be considered here in a very strict way. Rather, the term minimizing expresses that the difference is brought below a certain threshold.

Weighting Coefficient Determinator, Fourth Embodiment

Figure 16:
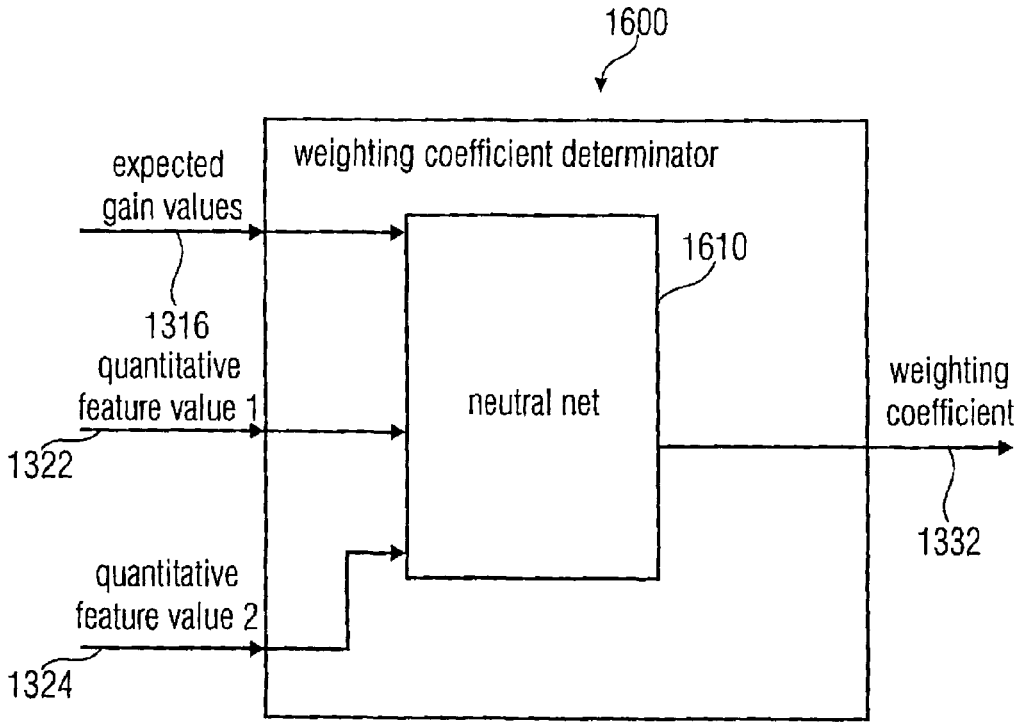
FIG. 16 shows a block schematic diagram of an apparatus for obtaining weighting coefficients, according to an embodiment according to the invention.

FIG. 16 shows a block schematic diagram of another weighting coefficient determinator, according to an embodiment according to the invention. The weighting coefficient determinator shown in FIG. 16 is designated in its entirety with 1600.

The weighting coefficient determinator 1600 comprises a neural net 1610. The neural net 1610 may, for example, be configured to receive the information 1316 describing the expected gain values as well as a plurality of quantitative feature values 1322, 1324. Moreover, the neural net 1610 may, for example, be configured to provide the weighting coefficients 1332. For example, the neural net 1610 may be configured to learn weighting coefficients, which result, when applied to weight the quantitative feature values 1322, 1324, in a gain value, which is sufficiently similar to an expected gain value described by the expected gain value information 1316.

Further details will subsequently be described.

Apparatus for Determining Weighting Coefficients—Second Embodiment

Figure 17:
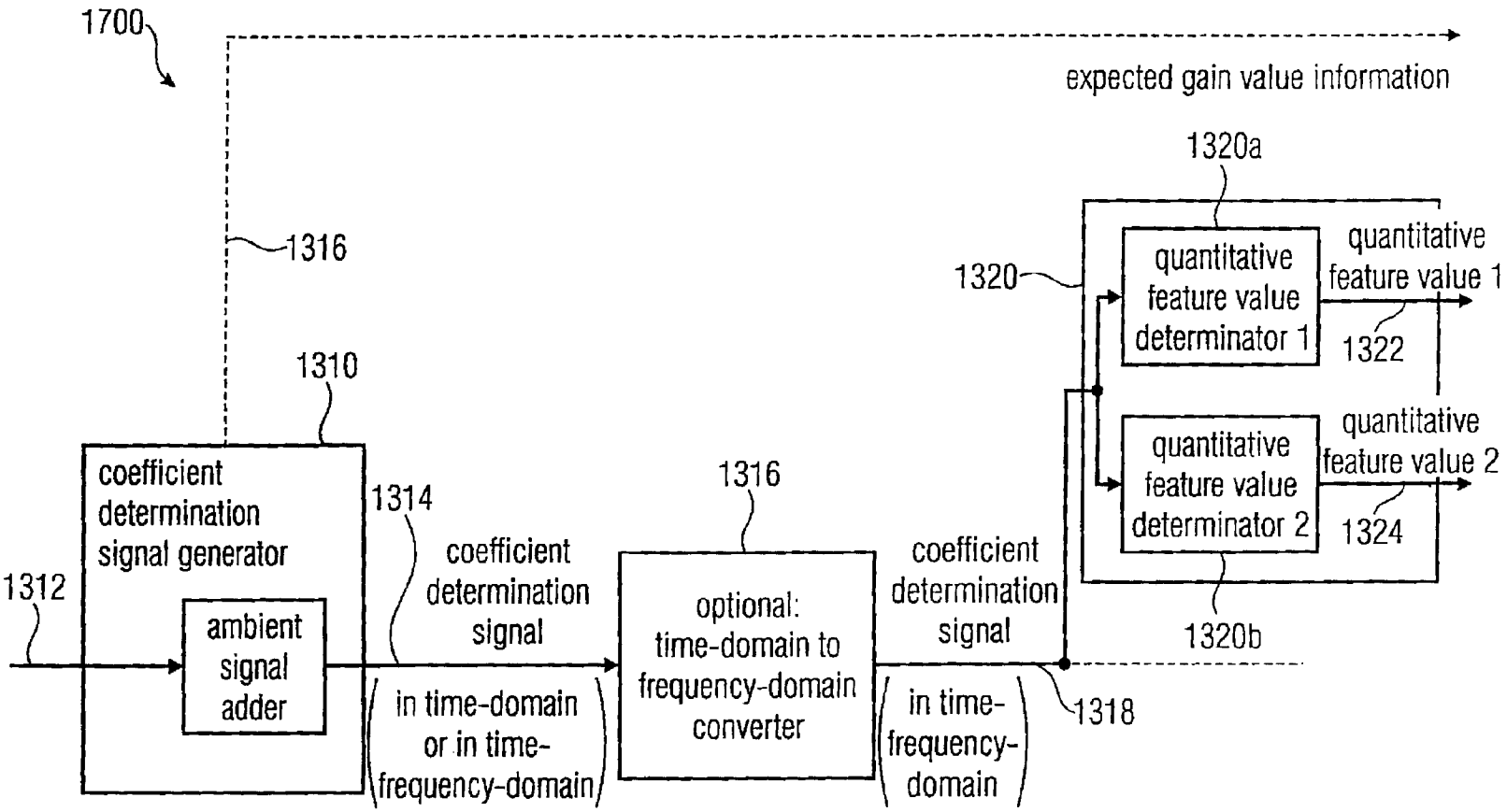
FIG. 17 shows an extract of a block schematic diagram of an apparatus for obtaining weighting coefficients, according to an embodiment according to the invention.

FIG. 17 shows a block schematic diagram of an apparatus for determining weighting coefficients according to an embodiment according to the invention. The apparatus shown in FIG. 17 is similar to the apparatus shown in FIG. 13. Accordingly, identical means and signals are designated with identical reference numerals.

The apparatus 1700 shown in FIG. 17 comprises a coefficient determination signal generator 1310, which may be configured to receive a basis signal 1312. In an embodiment, the coefficient determination signal generator 1310 may be configured to add an ambient signal to the basis signal 1312 to obtain the coefficient determination signal 1314. The coefficient determination signal 1314 may, for example, be provided in a time-domain representation or in a time-frequency-domain representation.

The coefficient determination signal generator may further be configured to provide the expected gain value information 1316 describing expected gain values. For example, the coefficient determination signal generator 1310 may be configured to provide the expected gain value information on the basis of internal knowledge regarding an addition of the ambient signal to the basis signal.

Optionally, the apparatus 1700 may further comprise a time-domain to time-frequency-domain converter 1316, which may be configured to provide the coefficient determination signal 1318 in a time-frequency-domain representation. Moreover, the apparatus 1700 comprises a quantitative feature value determinator 1320, which may, for example, comprise a first quantitative feature value determinator 1320*a* and a second quantitative feature value determinator 1320*b*. Thus, the quantitative feature value determinator 1320 is configured to provide a plurality of quantitative feature values 1322, 1324.

Coefficient Determination Signal Generator—First Embodiment

In the following, different concepts of providing the coefficient determination signal 1314 will be described. The concepts described with reference to FIGS. 18*a*, 18*b*, 19 and 20 are applicable both to a time-domain representation and to a time-frequency-domain representation of the signal.

Figure 18A:
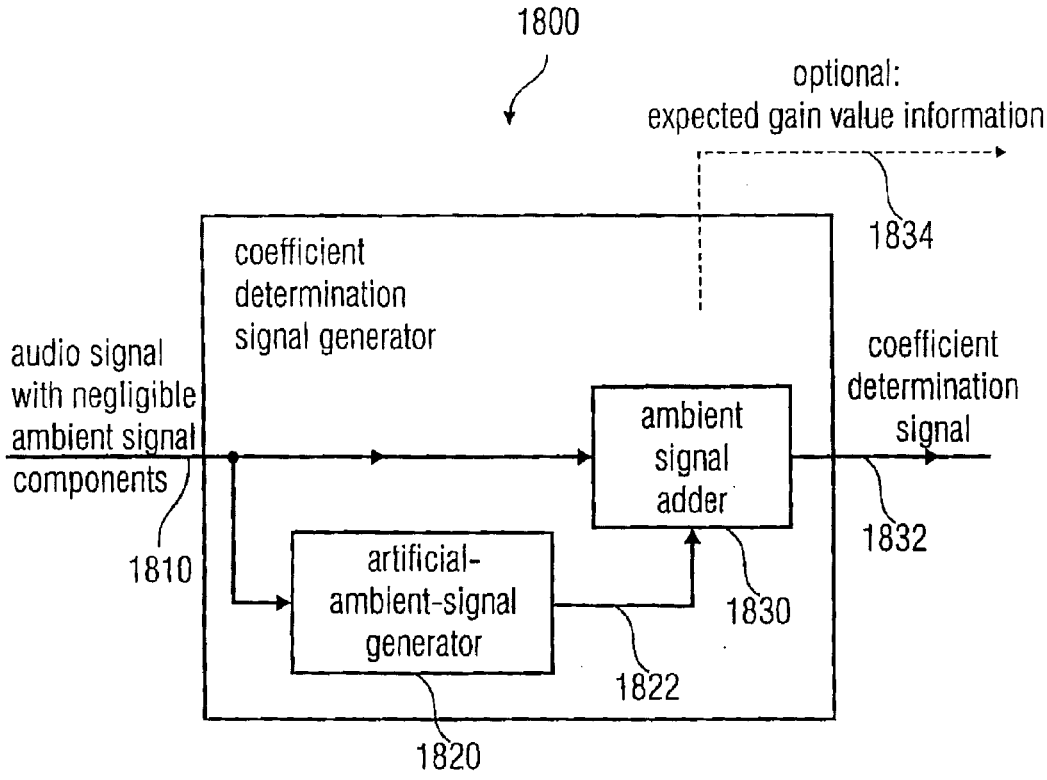
FIGS. 18*a* and 18*b* show block schematic diagrams of coefficient determination signal generators, according to embodiments according to the invention.

FIG. 18*a* shows a block schematic diagram of a coefficient determination signal generator. The coefficient determination signal generator shown in FIG. 18*a* is designated in its entirety with 1800. The coefficient determination signal generator 1800 is configured to receive, as an input signal 1810, an audio signal with negligible ambient signal components.

Moreover, the coefficient determination signal generator 1800 may comprise an artificial-ambient-signal generator 1820 configured to provide an artificial ambient signal on the basis of the audio signal 1810. The coefficient-determination-signal generator 1800 also comprises an ambient signal adder 1830 configured to receive the audio signal 1810 and the artificial ambient signal 1822 and to add the artificial ambient signal 1822 to the audio signal 1810 to obtain the coefficient determination signal 1832.

Moreover, the coefficient determination signal generator 1800 may be configured to provide, for example, on the basis of parameters used for generating the artificial ambient signal 1822 or used for combining the audio signal 1810 with the artificial ambient signal 1822, an information about the expected gain value. In other words, the knowledge regarding modalities of the generation of the artificial ambient signal and/or about the combination of the artificial ambient signal with the audio signal 1810 is used to obtain the expected gain value information 1834.

The artificial-ambient-signal generator 1820 may, for example, be configured to provide, as the artificial ambient signal 1822, a reverberation signal based on the audio signal 1810.

Coefficient Determination Signal Generator—Second Embodiment

Figure 18B:
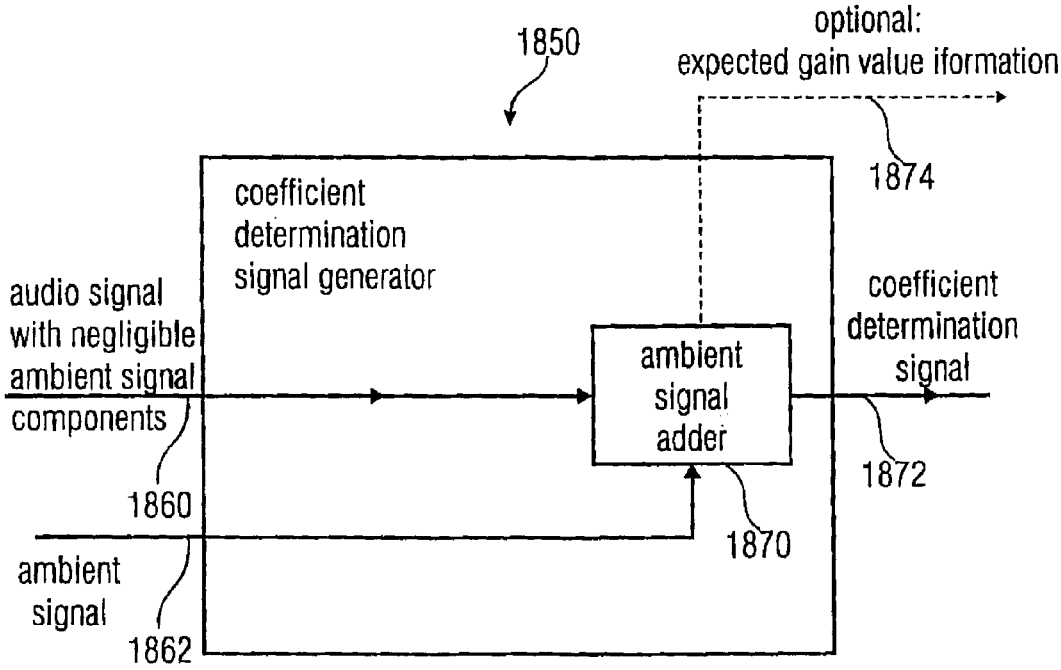

FIG. 18*b* shows a block schematic diagram of a coefficient determination signal generator according to another embodiment according to the invention. The coefficient determination signal generator shown in FIG. 18*b* is designated in its entirety with 1850.

The coefficient determination signal generator 1850 is configured to receive an audio signal 1860 with negligible ambient signal components and, in addition, an ambient signal 1862. The coefficient determination signal generator 1850 also comprises an ambient signal adder 1870 configured to combine the audio signal 1860 (having negligible ambient signal components) with the ambient signal 1862. The ambient signal adder 1870 is configured to provide the coefficient determination signal 1872.

Moreover, as the audio signal with negligible ambient signal components and the ambient signal are available in an isolated form in the coefficient determination signal generator 1850, an expected gain value information 1874 can be derived therefrom.

For example, the expected gain value information 1874 may be derived such that the expected gain value information is descriptive of a ratio of magnitudes of the audio signal and the ambient signal. For example, the expected gain value information may describe such ratios of intensities for a plurality of time-frequency bins of a time-frequency-domain representation of the coefficient determination signal 1872 (or of the audio signal 1860). Alternatively, the expected gain value information 1874 may comprise an information about intensities of the ambient signal 1862 for a plurality of time-frequency bins.

Coefficient Determination Signal Generator—Third Embodiment

Figure 19:
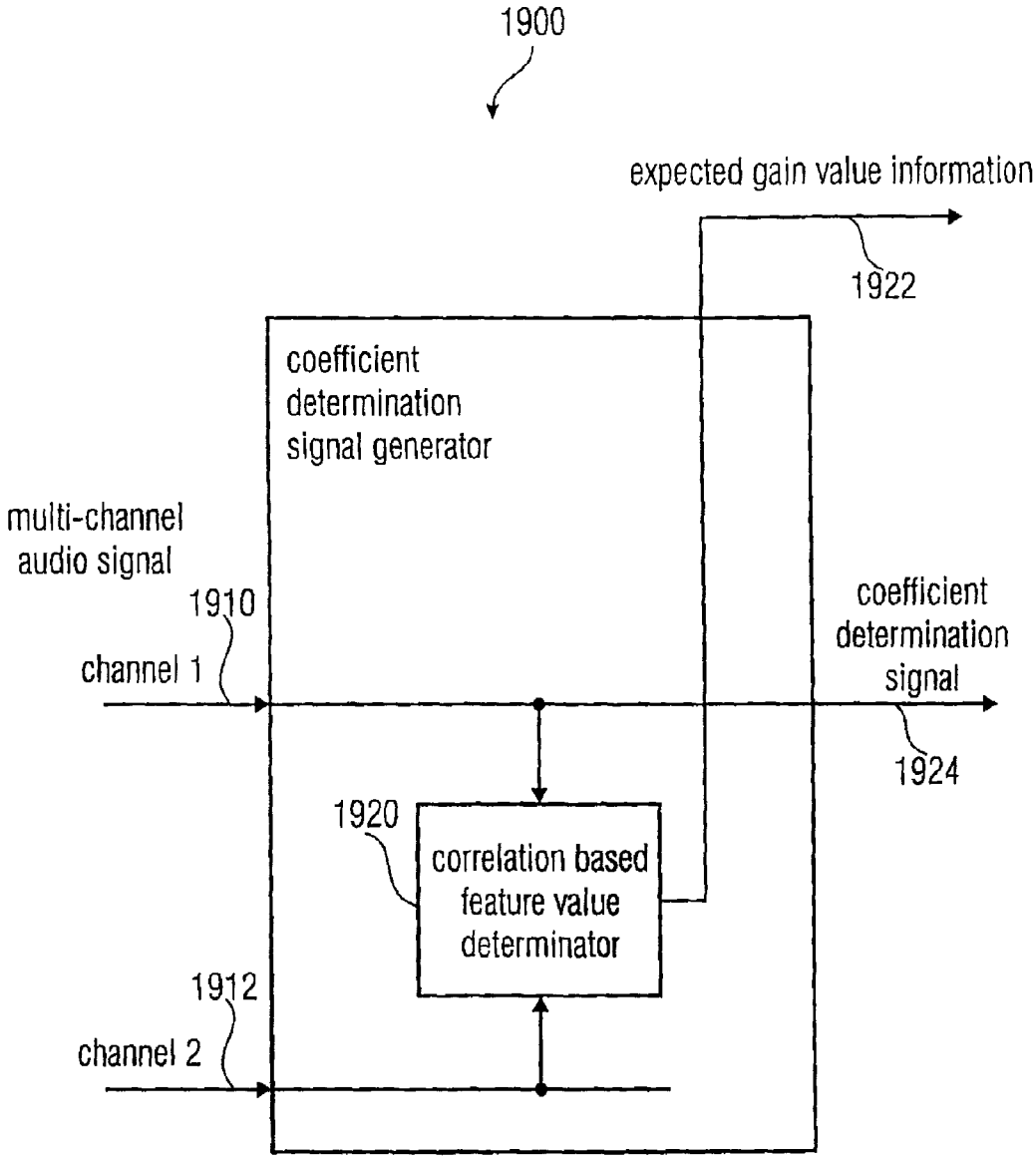
FIG. 19 shows a block schematic diagram of a coefficient-determination signal generator, according to an embodiment according to the invention.

Taking reference now to FIGS. 19 and 20, another approach for determining the expected gain value information will be discussed. FIG. 19 shows a block schematic diagram of a coefficient determination signal generator according to an embodiment according to the invention. The coefficient determination signal generator shown in FIG. 19 is designated in its entirety with 1900.

The coefficient determination signal generator 1900 is configured to receive a multi-channel audio signal. For example, the coefficient determination signal generator 1900 may be configured to receive a first channel 1910 and a second channel 1912 of the multi-channel audio signal. Moreover, the coefficient determination signal generator 1910 may comprise a channel-relationship based feature-value determinator, for example, a correlation-based feature-value determinator 1920. The channel relationship-based feature value determinator 1920 may be configured to provide a feature value, which is based on a relationship between two or more of the channels of the multi-channel audio signal.

In some embodiments, such a channel-relationship-based feature-value may provide a sufficiently reliable information regarding an ambience-component content of the multi-channel audio signal without requiring additional pre-knowledge. Thus, the information describing the relationship between two or more channels of the multi-channel audio signal obtained by the channel-relationship-based feature-value determinator 1920 may serve as an expected-gain-value information 1922. Moreover, in some embodiments, a single audio channel of the multi-channel audio signal may be used as a coefficient determination signal 1924.

Coefficient Determination Signal Generator—Fourth Embodiment

A similar concept will be subsequently described with reference to FIG. 20. FIG. 20 shows a block schematic diagram of a coefficient determination signal generator according to an embodiment according to the invention. The coefficient determination signal generator shown in FIG. 20 is designated in its entirety with 2000.

The coefficient determination signal generator 2000 is similar to the coefficient determination signal generator 1900 such that identical signals are designated with identical reference numerals.

However, the coefficient determination signal generator 2000 comprises a multi-channel to single-channel combiner 2010 configured to combine the first channel 1910 and the second channel 1912 (which are used for determining the channel-relationship-based feature value by the channel-relationship-based feature value determinator 1920) to obtain the coefficient determination signal 1924. In other words, rather than using a single channel signal of the multi-channel audio signal, a combination of the channel signals is used to obtain the coefficient determination signal 1924.

Figure 20:
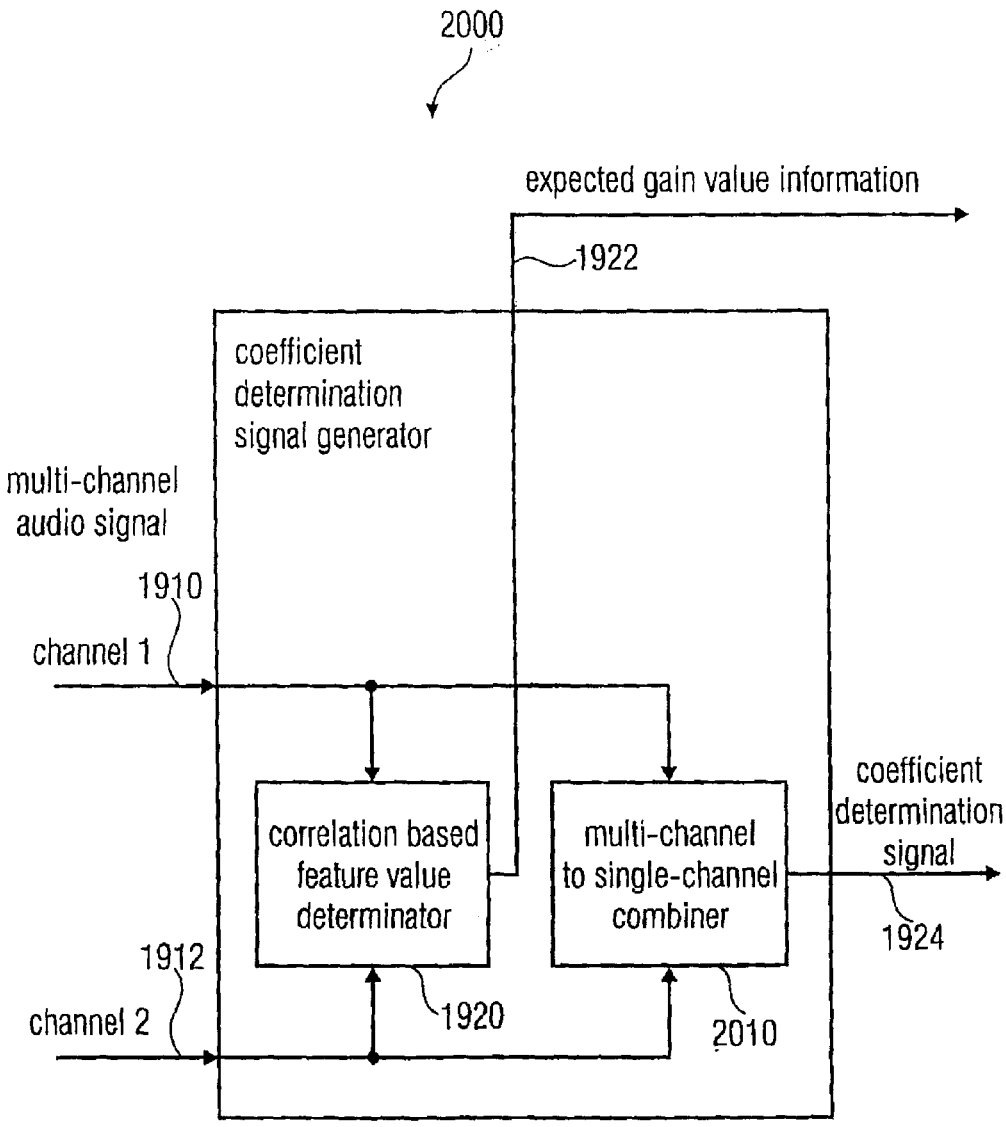
FIG. 20 shows a block schematic diagram of a coefficient-determination signal generator, according to an embodiment according to the invention.

Taking reference to the concept described with respect to FIGS. 19 and 20, it can be noted that a multi-channel audio signal can be used to obtain the coefficient determination signal. In typical multi-channel audio signals, a relationship between the individual channels provides an information with respect to an ambience-component content of the multi-channel audio signal. Accordingly, a multi-channel audio signal can be used for obtaining the coefficient determination signal and for providing an expected gain value information characterizing the coefficient determination signal. Therefore, a gain value determinator, which operates on the basis of a single channel of an audio signal, can be calibrated (for example, by determining respective coefficients) making use of a stereo signal or a different type of multi-channel audio signal. Thus, by using a stereo signal or a different type of multi-channel audio signal, coefficients for an ambient extractor can be obtained, which coefficients may be applied (for example after obtaining the coefficients) for the processing of a single channel audio signal.

Method for Extracting an Ambient Signal

Figure 21:
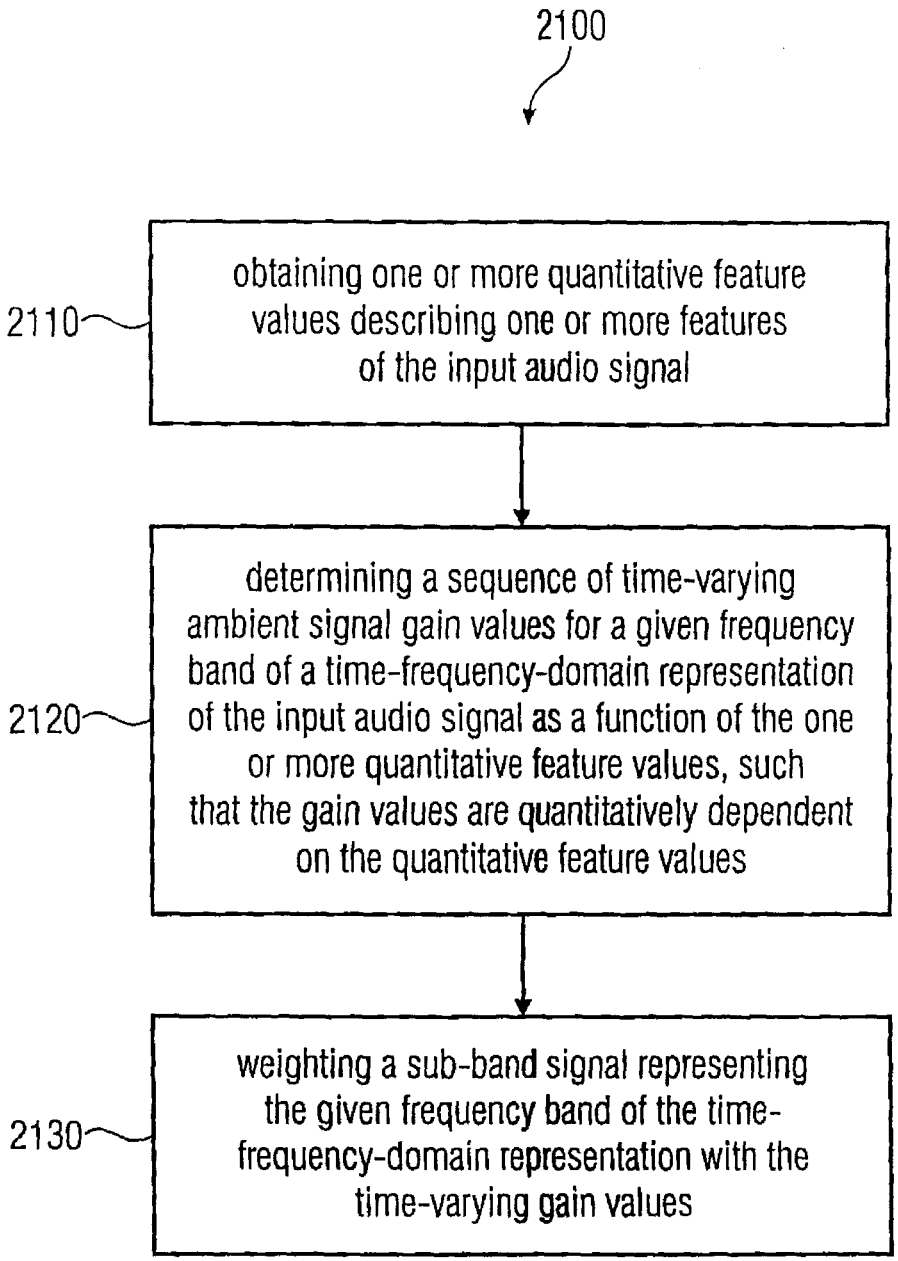
FIG. 21 shows a flow chart of a method for extracting an ambient signal from an input audio signal, according to an embodiment according to the invention.

FIG. 21 shows a flowchart of a method for extracting an ambient signal on the basis of a time-frequency-domain representation of an input audio signal, the representation representing the input audio signal in terms of a plurality of subband signals describing a plurality of frequency bands. The method shown in FIG. 21 is designated in its entirety with 2100.

The method 2100 comprises obtaining 2110 one or more quantitative feature values describing one or more features of the input audio signal.

The method 2100 further comprises determining 2120 a sequence of time-varying ambient signal gain values for a given frequency band of a time-frequency-domain representation of the input audio signal as a function of the one or more quantitative feature values, such that the gain values are quantitatively dependent on the quantitative feature values.

The method 2100 further comprises weighting 2130 a subband signal representing the given frequency band of the time-frequency-domain representation with the time-varying gain values.

In some embodiments, the method 2100 may be operational to perform the functionality of the apparatus described herein.

Method for Obtaining Weighting Coefficients

Figure 22:
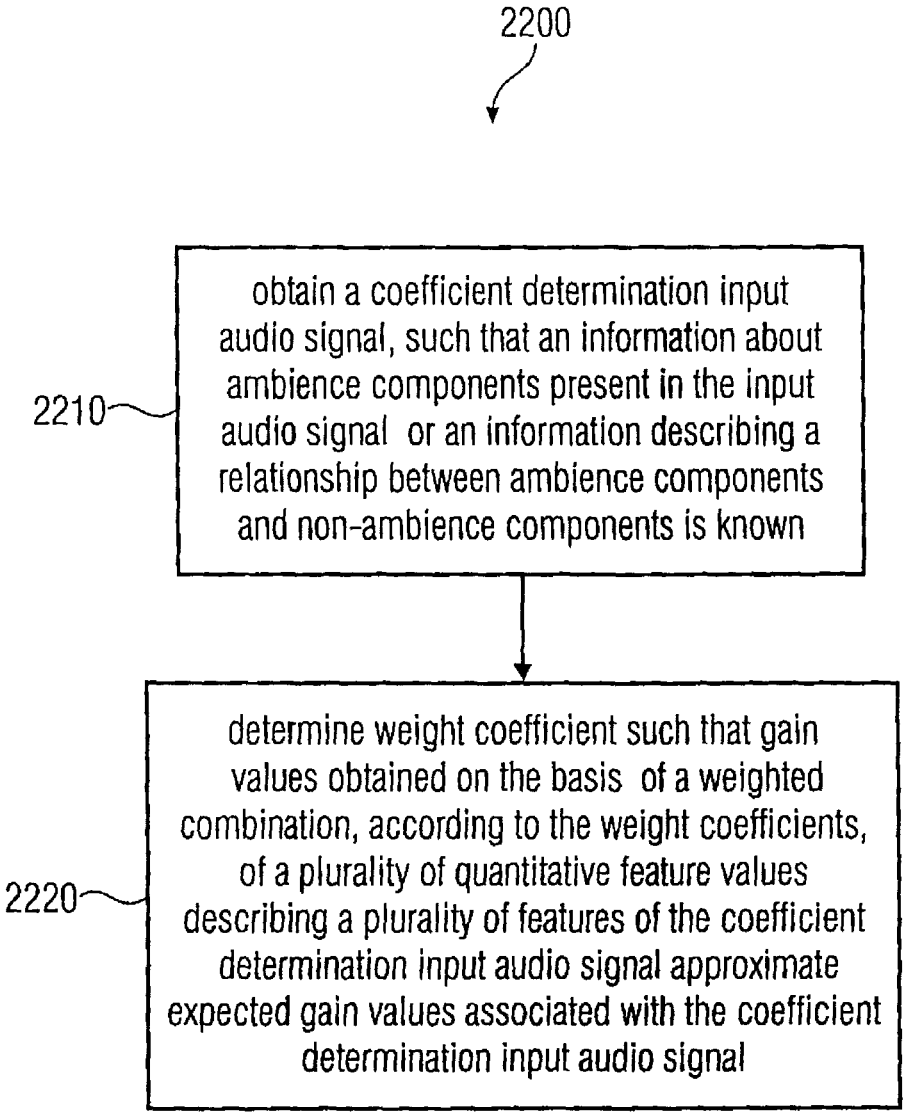
FIG. 22 shows a flow chart of a method for determining weighting coefficients, according to an embodiment according to the invention.
Figure 23:
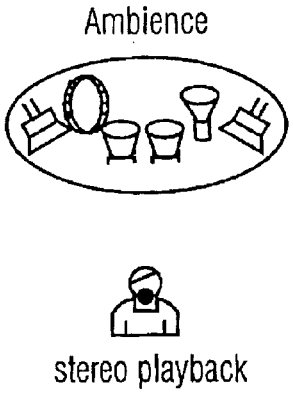
FIG. 23 shows a graphical representation illustrating a stereo playback.
Figure 24:
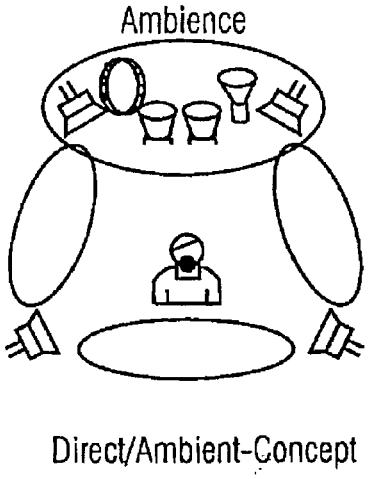
FIG. 24 shows a graphical representation illustrating a direct/ambient concept.
Figure 25:
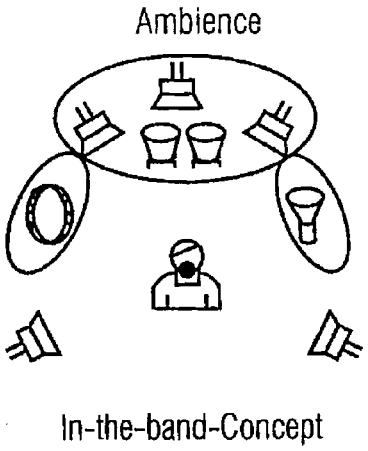
FIG. 25 shows a graphical representation illustrating an in-the-band-concept.

FIG. 22 shows a flowchart of a method for obtaining weighting coefficients for parameterizing a gain value determinator for extracting an ambient signal from an input audio signal. The method shown in FIG. 22 is designated in its entirety with 2200.

The method 2200 comprises obtaining 2210 a coefficient determination input audio signal, such that an information about ambience components present in the input audio signal or an information describing a relationship between ambience components and non-ambience components is known.

The method 2200 further comprises determining 2220 weighting coefficients such that gain values obtained on the basis of a weighted combination, according to the weighting coefficients, of a plurality of quantitative feature values describing a plurality of features of the coefficient determination input audio signal approximate expected gain values associated with the coefficient determination input audio signal.

The methods described herein may be supplemented by any of the features and functionalities described also with respect to the inventive apparatus.

Computer Programs

Depending on certain implementation requirements of the inventive methods, the inventive methods can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate with a programmable computer system such that the inventive method is performed. Generally, the present invention is, therefore, a computer program product with a program code stored on a machine readable carrier, the program code being operative for performing the inventive method when the computer program product runs on a computer. In other words, the inventive method is, therefore, a computer program having a program code for performing the inventive method when the computer program runs on a computer.

3 Description of a Method According to Another Embodiment 3.1 Problem Description A method according to an embodiment aims at the extraction of a front signal and an ambient signal suited for blind upmixing of audio signals. The multi-channel surround sound signal may be obtained by feeding the front channels with the front signal and by feeding the rear channels with the ambient signal.

Various Methods for the Extraction of an Ambient Signal Already Exist:

1. using NMF (see Section 2.1.3)
2. using a time-frequency mask depending on the correlation of the left and right input signal (see Section 2.2.4)
3. using PCA and a multi-channel input signal (see Section 2.3.2)

Method 1 relies on an iterative numeric optimization technique whereas a segment of a few seconds length (e.g. 2 . . . 4 seconds) is processed at a time. Consequently, the method is of high computational complexity and has an algorithmic delay of at least the aforementioned segment length. In contrast, the inventive method is of low computational complexity and has a low algorithmic delay compared to Method 1.

Methods 2 and 3 rely on distinct differences between the input channel signals, i.e. they do not produce an appropriate ambience signal if all input channel signals are identical or nearly identical. In contrast, the inventive method is able to process mono signals or multi-channel signals which are identical or nearly identical.

In summary, the advantages of the proposed method are as follows:

- Low complexity
- Low delay
- Works for monophonic and nearly monophonic input signals as well as for stereophonic input signals 3.2 Method Description A multi-channel surround signal (e.g. in 5.1 or 7.1 format) is obtained by extracting an ambient signal and a front signal from the input signal. The ambient signal is fed into the rear channels. The center channel is used to enlarge the sweet spot and plays back the front signal or the original input signal. The other front channels play back the front signal or the original input signal (i.e. the left front channel plays back the original left front signal or a processed version of the original left front signal). FIG. 10 shows a block diagram of the upmix process.

The extraction of the ambient signal is carried out in the time-frequency domain. The inventive method computes time-varying weights (also designated as gain values) for each sub-band signal using low-level features (also designated as quantitative feature values) measuring the "ambience-likeliness" of each subband signal. These weights are applied prior to the re-synthesis to compute the ambient signal. Complementary weights are computed for the front signal.

Examples for typical characteristics of ambience are:

- Ambient sounds are rather quiet sounds compared to direct sounds.
- Ambient sounds are less tonal than direct sounds.

Appropriate low-level features for the detection of such characteristic are described in Section 3.3:

- Energy features measure the quietness of a signal component
- Tonality features measure the noisiness of a signal component The time-varying gain factors $g(\omega,\tau)$ with sub-band index $\omega$ and time index $\tau$ are derived from the computed features $m_i(\omega,\tau)$ using for instance Equation 1

$$g(\omega, \tau) = \sum_{i=1}^{K} \alpha_i m_i(\omega, \tau)^{\beta_i} \tag{1}$$

with K being the number of features and the parameters $\alpha_i$ and $\beta_i$ used for the weighting of the different features.

FIG. 11 illustrates a block diagram of the ambience extraction process using low-level feature extraction. The input signal x is a one-channel audio signal. For the processing of signals with more channels, the processing may be applied to each channel separately. The analysis filter-bank separates the input signal into N frequency bands (N>1), e.g. using for instance an STFT (Short-Term Fourier Transform) or digital filters. The output of the analysis filter-bank are N sub-band signals $X_i$, $1 \le i \le N$. The gain factors $g_i$, $1 \le i \le N$, are obtained by computing one ore more low-level features from sub-band signals $X_i$ and combining the feature values, as illustrated in FIG. 11. Each sub-band signal $X_i$ is then weighted using the gain factor $g_i$.

A preferred extension to the described process is the use of groups of sub-band signals instead of single sub-band signals: Sub-band signals can be grouped to form groups of sub-band signals. The processing described here can be carried out using groups of sub-band signals, i.e. low-level features are computed from one or more groups of sub-band signals (whereas each group contains one or more sub-band signals) and the derived weighting factors are applied to the corresponding sub-band signals (i.e. to all sub-bands belonging to the particular group).

An estimate for a spectral representation of the ambience signal is obtained by weighting one or more of the sub-bands with the corresponding weight $g_i$. The signal which will feed the front channels of the multi-channel surround signal is processed in a similar way with complementary weights as used for the ambient signal.

The additional play-back of the ambient signal results in more ambient signal components (compared to the original input signal). The weights for the computation of the front signal are computed as being in an inverse proportion to the weights for the computation of the ambient signal. Consequently, each resulting front signal contains less ambient signal components and more direct signal components compared to the corresponding original input signal.

The ambient signal is (optionally) further enhanced (with respect to the perceived quality of the resulting surround sound signal) using additional post-processing in the spectral domain and resynthesized using the inverse process of the analysis filter-bank (i.e. the synthesis filter-bank), as shown in FIG. 11.

The post-processing is detailed in Section 7. It should be noted that some postprocessing algorithms can be carried out in either the spectral domain or the temporal domain.

FIG. 12 shows a block diagram of the gain computation process for one sub-band (or one group of sub-band signals) based on the extraction of low-level features. Various low-level features are computed and combined, yielding the gain factor.

The resulting gains can be further post-processed using dynamic compression and low-pass filtering (both in time and in frequency).

3.3 Features

The following section describes features that are suitable for characterizing ambience-like signal quality. In general, the features characterize an audio signal (broad-band) or a particular frequency region (i.e. a sub-band) or a group of sub-bands of an audio signal. The computation of features in sub-bands requires the use of a filter-bank or time-frequency transform.

The computation is explained here using a spectral representation $X(\omega,\tau)$ of the audio signal x[k], with $\omega$ being the sub-band index and time index $\tau$. A spectrum (or one range of a spectrum) is denoted by Sk, with k being the frequency index.

Feature computation using the signal spectrum may process different representations of the spectrum, i.e. magnitudes, energy, logarithmic magnitudes or energy or any other non-linear processed spectrum (e.g. $X^{0.23}$). If not noted otherwise, the spectral representation is assumed to be real-valued.

Features computed in adjacent sub-bands can be subsumed to characterize a group of sub-bands, e.g. by averaging the feature values of the sub-bands. Consequently, the tonality for a spectrum can be computed from the tonality values for each spectral coefficient of the spectrum, e.g. by computing their mean value.

It is desired that values range of the computed features is [0, 1] or a different predetermined interval. Some feature computations described below do not result in values within that range. In these cases, appropriate mapping functions are applied, for example to map values describing a feature to a predetermined interval. A simple example for a mapping function is given in Equation 2.

$$y = \begin{cases} 0, & x < 0 \\ x, & 0 \le x \le 1 \\ 1, & x > 1 \end{cases} \tag{2}$$

The mapping can for example be performed using the post-processor 530, 532.

3.3.1 Tonality Features

The term Tonality as used here describes "a feature distinguishing noise versus tone quality of sounds".

Tonal signals are characterized by a non-flat signal spectrum, whereas noisy signals have a flat spectrum. Consequently, tonal signals are more periodic than noisy signals, whereas noisy are more random than tonal signals. Therefore, tonal signal are predictable from preceding signal values with a small prediction error, whereas noisy signals are not well-predicable.

In the following, a plurality of features will be described which can be used to quantitatively describe a tonality. In other words, the features described here can be used to determine a quantitative feature value, or can serve as a quantitative feature value.

Spectral Flatness Measure:

Spectral Flatness Measure (SFM) is computed as the ratio of the geometric mean value and the arithmetic mean value of the spectrum S.

$$SFM(S) = \frac{\sqrt[N]{\prod_{i=1}^{N} S_i}}{\frac{1}{N}\sum_{i=1}^{N} S_i} \tag{3}$$

Alternatively, Equation 4 can be used, yielding the identical result.

$$SFM(S) = \frac{e^{\left(\sum_{i=1}^{N} \log S_i\right)/N}}{\frac{1}{N}\sum_{i=1}^{N} S_i} \tag{4}$$

A feature value may be derived from SFM(S).

Spectral Crest Factor:

The Spectral Crest Factor is computed as the ratio of the maximum value and the mean value of the spectrum X (or S).

$$SCF(S) = \frac{\max(S)}{\frac{1}{N}\sum_{i=1}^{N} S_i} \tag{5}$$

A quantitative feature value may be derived from SCF(S).

Tonality Computation Using Peak Detection:

In ISO/IEC 11172-3MPEG-1 Psychoacoustic Model 1 (recommended for Layers 1 and 2) [ISO93] a method is described to discriminate between tonal and non-tonal components, which is used to determine of the masking threshold for perceptual audio coding. The tonality of a spectral coefficient $S_i$ is determined by examining the levels of spectral values within a frequency range $\Delta f$ surrounding the frequency corresponding to $S_i$. Peaks (i.e. local maxima) are detected if the energy of $X_i$ exceeds the energies of its surrounding values $S_{i+k}$, with e.g. k $\epsilon$[−4, −3, −2, 2, 3, 4]. If the local maximum exceeds its surrounding values by 7 dB or more, it is classified as tonal. Otherwise, the local maximum may be classified as not tonal.

A feature value can be derived describing whether a maximum is tonal or not. Also, a feature value may be derived describing, for example, how many tonal time-frequency bins are present within a given neighbourhood.

Tonality Computation Using the Ratio of Nonlinearly Processed Copies:

The non-flatness of a vector is measured as ratio of two nonlinearly processed copies of the spectrum S as shown in Equation 6 with $\alpha>\beta$.

$$F(S) = \frac{\sqrt[\alpha]{\sum_{i=1}^{N} |S_i|^{\alpha}}}{\sqrt[\beta]{\sum_{i=1}^{N} |S_i|^{\beta}}} \tag{6}$$

Two particular implementations are shown in Equation 7 and 8.

$$F(S) = \frac{\sum_{i=1}^{N} |S_i|}{\sqrt[\beta]{\sum_{i=1}^{N} |S_i|^{\beta}}}, 0 < \beta < 1 \tag{7}$$

$$F(S) = \frac{\sqrt[\alpha]{\sum_{i=1}^{N} |S_i|^{\alpha}}}{\sum_{i=1}^{N} |S_i|}, \alpha > 1 \tag{8}$$

A quantitative feature value may be derived from F(S).

Tonality Computation Using the Ratio of Differently Filtered Spectra:

The following tonality measure is described in U.S. Pat. No. 5,918,203 [HEG+99].

The tonality of a spectral coefficient $S_k$ for frequency line k is computed from the ratio Θ of two filtered copies of the spectrum S, whereas the first filter function H has a differentiating characteristic and the second filter function G has an integrating characteristic or a characteristic which is less strongly differentiating than the first filter, and c and d are integer constants which, depending on the filters parameters, are chosen such that the delays of the filters are compensated for in each case.

$$\Theta_k = \frac{H(S_{k+c})}{G(S_{k+d})} \tag{9}$$

A particular implementation is shown in Equation 10, where H is the transfer function of a differentiating filter.

$$\Theta(k)=H(S_{k+c}) \tag{10}$$

A quantitative feature value can be derived from $\theta_k$ or from θ(k).

Tonality Computation Using Periodicity Functions:

The aforementioned tonality measures use the spectrum of the input signal and derive a measure of tonality from the non-flatness of the spectrum. The tonality measures (from which a feature value can be derived) can also be computed using a periodicity function of the input time signal instead of its spectrum. A periodicity function is derived from the comparison of a signal with its delayed copy.

The similarity or difference of both are given as a function of the lag (i.e. the time delay between both signals). A high degree of similarity (or a low difference) between a signal and its (by lag τ) delayed copy indicates a strong periodicity of the signal with period τ.

Examples for periodicity functions are the autocorrelation function and the Average Magnitude Difference Function [dCK03]. The autocorrelation function $r_{xx}(\tau)$ of a signal x is shown in Equation 11, with integration window size W.

$$r_{xx}(\tau) = \sum_{j=t+1}^{t+W} x_j x_{j+r} \tag{11}$$

Tonality Computation Using the Prediction of Spectral Coefficients:

The tonality estimation using the prediction of the complex spectral coefficients $X_i$ from preceding coefficients bins $X_{i-1}$ and $X_{i-2}$ is described in ISO/IEC 11172-3 MPEG-1 Psychoacoustic Model 2 (recommended for Layer 3).

The current values for the magnitude $X_0(\omega,\tau)$ and phase $\phi(\omega,\tau)$ of the complex spectral coefficient $X(\omega,\tau)=X_0(\omega,\tau)e^{-j\phi(\omega\tau)}$ can be estimated from the previous values according to Equations 12 and 13.

$$\hat{X}_0(\omega,\tau)=X_0(\omega,\tau-1)+(X_0(\omega,\tau-1)-X_0(\omega,\tau-2)) \tag{12}$$

$$\hat{\phi}(\omega,\tau)=\phi(\omega,\tau-1)+(\phi(\omega,\tau-1)-\phi(\omega,\tau-2)) \tag{13}$$

The normalized Euclidean distance between the estimated and actually measured values (as shown in Equation 14) is a measure for the tonality, and can be used to derive a quantitative feature value.

$$c(\omega, \tau) = \frac{\left(\hat{X}_0(\omega, \tau) - X_0(\omega, \tau)\right)^2 + \left(\hat{\phi}(\omega, \tau) - \phi(\omega, \tau)\right)^2}{\hat{X}_0(\omega, \tau) + X_0(\omega, \tau)} \tag{14}$$

The tonality for one spectral coefficient can also be computed from the prediction error P(ω) (see Equation 15, with X(ω,τ) being complex-valued) such that large prediction errors result in small tonality values.

$$P(\omega,\tau)=X(\omega,\tau)-2X(\omega,\tau-1)+X(\omega,\tau-2) \tag{15}$$

Tonality Computation Using Prediction in the Time Domain:

The signal x[k] a time index k can be predicted from preceding samples using Linear Prediction, whereas the prediction error is small for periodic signals and large for random signals. Consequently, the prediction error is in inverse proportion to the tonality of the signal.

Accordingly, a quantitative feature value can be derived from the prediction error.

3.3.2 Energy Features

Energy features measure the instantaneous energy within a sub-band. The weighting factor for the ambience extraction of a particular frequency band will be lower at times when the energy content of the frequency band is high, i.e. the particular time-frequency tile is very likely to be a direct signal component.

Additionally, energy features can also be computed from adjacent (with respect to time) sub-band samples of the same sub-band. Similar weighting is applied if the sub-band signal features high energy in the near past or future. An example is shown in Equation 16. The feature M(ω,τ) is computed from the maximum value of adjacent sub-band samples within the interval τ−k<τ<τ+k with τ determining the observation window size.

$$M(\omega,\tau)=\max([X(\omega,\tau-k)\ X(\omega,\tau+k)]) \tag{16}$$

Both, the instantaneous sub-band energy and the maximum of the sub-band energy measured in the near past or future are treated as separate features (i.e. different parameters for the combination as described in Equation 1 are used).

In the following, some extensions to a low-complexity extraction of a front signal and an ambient signal from an audio signal for upmixing will be described.

The extensions concern the feature extraction, the post-processing of the features and the method of the derivation of the spectral weights from the features.

3.3.3. Extensions to the Feature Set

In the following, optional extensions of the above described feature set will be described.

The above description describes the usage of tonality features and energy features. The features are computed (for example) in the Short-term Fourier transform (STFT) domain and are functions of time index m and frequency index k. The representation in the time-frequency domain (as obtained e.g. by means of the STFT) of a signal x[n] is written as X(m,k). In the case of processing stereo signals, the left channel signal is termed $x_1[k]$ and the right channel signal is $x_2[k]$. The superscript "*" denotes complex conjugation.

One or more of the following features may optionally be used:

3.3.3.1 Features Evaluating the Inter-Channel Coherence or Correlation

Definition of Coherence:

Two signals are coherent if they are equal with possibly a different scaling and delay, i.e. their phase difference is constant.

Definition of Correlation:

Two signals are correlated if they are equal with possibly a different scaling.

Correlation between two signals of length N each is often measured by means of the normalized cross-correlation coefficient r $$r = \frac{\sum_{k=1}^{N}(x_1[k]-\bar{x}_1)(x_2[k]-\bar{x}_2)}{\sqrt{\sum_{k=1}^{N}(x_1[k]-\bar{x}_1)\sum_{k=1}^{N}(x_2[k]-\bar{x}_2)}} \tag{20}$$

where $\bar{x}$ denotes the mean value of x[k]. To track the changes of the signal characteristic over time, the sum operator is often replaced by a first order recursive filter in practice, e.g. the computation of $z[k]=z[k]=\Sigma_{j=k-N}^{k}x[j]$ may be approximated by $$\tilde{z}[k]=\lambda\tilde{z}[k-1]+(1-\lambda)x[k] \tag{21}$$

with "forgetting factor" λ. This computation is in the following termed "moving average estimation (MAE)", $f_{mae}(z)$.

Ambient signal components in the left and right channel of a stereo recording are in general weakly correlated. When recording a sound source in a reverberant room with a stereo microphone technique, both microphone signals are different because the paths from the sound source to the microphones are different (mainly because of the differences in the reflection patterns). In artificial recordings the decorrelation is introduced by means of artificial stereo reverberation. Consequently, an appropriate feature for ambience extraction measures the correlation or coherence between the left and right channel signals.

The inter-channel short-time coherence (ICSTC) function described in [AJ02] is a suitable feature. The ICSTC ϕ is computed from the MAE of the cross-correlation $\phi_{12}$ between the left and right channel signals and the MAE of the energies $\phi_{11}$ of the left signal and $\phi_{22}$ of the right signal.

$$\Phi(m,k) = \frac{\Phi_{12}(m,k)}{\sqrt{\Phi_{11}(m,k)\Phi_{22}(m,k)}} \tag{22}$$

with $$\Phi_{ij}(m,k) = f_{MAE}(X_1(m,k)X_2^*(m,k)) \tag{23}$$

In fact, the formula of the ICSTC described in [AJ02] is nearly identical to the normalized cross-correlation coefficient, where the only difference is that no centering of the data is applied (centering means removing the mean as shown in Equation 20: $x_{centered}=x-\bar{x}$)

In [AJ02], an ambience index (that is a feature indication the degree of "ambience-likeness") is computed from the ICSTC by non-linear mapping, e.g. using the hyperbolic tangent.

3.3.3.2 Inter-Channel Level Difference

Features based on the inter-channel level differences (ICLD) are used to determine the prominent position of a sound source within the stereo image (panorama). A source s[k] is amplitude-panned to a particular direction by applying a panning coefficient α to weight the magnitude of s[k] in $x_1[k]$ and $x_2[k]$ according to $$x_1[k]=(1-\alpha)s[k] \tag{24}$$

$$x_2[k]=\alpha s[k] \tag{25}$$

When computed for a time-frequency bin, the ICLD-based features deliver a cue to determine the position (and the panning coefficient α) of the sound source which dominates the particular time-frequency bin.

One ICLD-based feature is the panning index Ψ(m,k) as described in [AJ04].

$$\Psi(m,k) = \left(1 - 2\frac{X_1(m,k)X_2^*(m,k)}{X_1(m,k)X_1^*(m,k) + X_2(m,k)X_2^*(m,k)}\right)\cdot \operatorname{sign}(X_1(m,k)X_1^*(m,k) - X_2(m,k)X_2^*(m,k)) \tag{26}$$

A computationally more efficient alternative to the panning index as described above is computed using $$\Xi(m,k) = \frac{1}{2}\left(\frac{|X_1(m,k)| - |X_2(m,k)|}{|X_1(m,k)| + |X_2(m,k)|} + 1\right) \tag{27}$$

The additional advantage of Ξ(m,k) compared to Ψ(m,k) is that it is identical to the panning coefficient α, whereas Ψ(m,k) only approximates α. The formula in Equation 27 is inspired by the computation of the centroid (center of gravity) of a function f(x) of the discrete variable $x \in \{-1, 1\}$ and $f(-1)=|X_1(m,k)|$ and $f(1)=|X_2(m,k)|$.

3.3.3.3 Spectral Centroid

The spectral centroid Γ of a magnitude spectrum or a range of a magnitude spectrum $|S_k|$ of length N is computed according to $$\Upsilon = \frac{\sum_{k=1}^{N}|S_k|f_k}{\sum_{k=1}^{N}|S_k|} \tag{28}$$

The spectral centroid is a low-level feature that correlates (when computed over the whole frequency range of a spectrum) to the perceived brightness of a sound. The spectral centroid is measured in Hz or dimensionless when normalized to the maximum of the frequency range.

4 Feature Grouping

Feature grouping is motivated by the desire to reduce the computational load of the further processing of the features and/or to evaluate the progression of the features over time.

The described features are computed for each block of data (from which the Discrete Fourier transform is computed) and for each frequency bin or set of adjacent frequency bins. Feature values computed from adjacent blocks (which usually overlap) might be grouped together and represented by one or more of the following functions f(x), whereas the feature values computed over a group of adjacent frames (a "super-frame") are taken as arguments x:

variance or standard deviation filtering (e.g. first or higher order differences, weighted mean value or other low-pass filtering)

Fourier transform coefficients

The feature grouping may for example be performed by one of the combiners 930, 940.

5 Computation of the Spectral Weights Using Supervised Regression or Classification In the following, we assume that an audio signal x[n] is additively composed of a direct signal component d[n] and an ambient signal component a[n]

$$x[n]=d[n]+a[n] \tag{29}$$

The present application describes the computation of the spectral weights as a combination of the feature values with parameters, which may for example be heuristically determined parameters (confer, for example, section 3.2).

Alternatively, the spectral weights may be determined from an estimate of the ratio of the magnitude of the ambient signal components to the magnitude of the direct signal components. We define the magnitude ratio of ambient signal to direct signal $R_{AD}$ (m,k)

$$R_{AD}(m,k)=\frac{|A(m,k)|}{|D(m,k)|} \tag{30}$$

The ambient signal is computed using an estimate of the magnitude ratio of ambient signal to direct signal $\hat{R}_{AD}$(m,k). Spectral weights G(m,k) for the ambience extraction are computed using $$G(m,k)=\frac{\hat{R}_{AD}(m,k)}{1+\hat{R}_{AD}(m,k)} \tag{31}$$

and the magnitude spectrogram of the ambient signal is derived by spectral weighting $$|A(m,k)|=G(m,k)|X(m,k)| \tag{32}$$

This approach is similar to the spectral weighting (or short-term spectral attenuation) for noise reduction of speech signals, whereas the spectral weights are computed from estimates of the time-varying SNR in sub-bands, see e.g. [Sch04].

The main issue is the estimation of $\hat{R}_{AD}$(m,k). Two possible approaches are described in the following: (1) supervised regression and (2) supervised classification.

It should be noted that these approaches are able to process features computed from frequency bins and from sub-bands (i.e. groups of frequency bins) together.

For example: The ambience index and the panning index are computed per frequency bin. The spectral centroid, spectral flatness and energy are computed for bark bands. Although these features are computed using different frequency resolution, there are process together using the same classifier/regression method.

5.1 Regression

A neural net (multi-layer perceptron) is applied to the estimation of $\hat{R}_{AD}$ (m,k). There are two options: to estimate $\hat{R}_{AD}$(m,k) for all frequency bins using one neural net or two use more neural net whereas each neural net estimates $\hat{R}_{AD}$ (m,k) for one or more frequency bins.

Each feature is fed into one input neuron. The training of the net is described in Section 6. Each output neuron is asigned to the $\hat{R}_{AD}$(m,k) of one frequency bin.

5.2 Classification

Similar to the regression approach, the estimation of $\hat{R}_{AD}$ (m,k) using the classification approach is done by means of neural nets. The reference values for the training are quantized into intervals of arbitrary size, whereas each interval represents one class (e.g., one class could include all $\hat{R}_{AD}$ (m,k) in the interval [0.2, 0.3)). With n being the number of intervals, the number of output neurons is n-times larger compared to the regression approach.

6. Training

The main issue for the training is the proper choice of reference values $R_{AD}$ (m,k). We propose two options (whereas the first option is the preferred one):

1. using reference values measured from signals where the direct signal and the ambient signal are separately available
2. using correlation-based features computed from stereo signals as reference values fro the processing of mono signals 6.1 Option 1

This option requires audio signals with prominent direct signals components and negligible ambient signal (x[n]≈d [n]) components, e.g. signals recorded in a dry environment.

For example, the audio signal 1810, 1860 may be considered as such signals with dominant direct components.

An artificial reverberation signal a[n] is generated by means of a reverberation processor or by convolution with a room impulse response (RIR), which might be sampled in a real room. Alternatively, other ambient signals can be used, e.g. recordings of applause, wind, rain, or other environmental noises.

The reference values used for the training are then obtained from the STFT representation of d[n] and a[n] using Equation 30.

In some embodiments, based on a knowledge of the direct signal component and of the ambient signal component the magnitude ratio can be determined according to equation 30. Subsequently, an expected gain value can be obtained on the basis of the magnitude ration, for example using equation 31. This expected gain value can be used as the expected gain value information 1316, 1834.

6.2 Option 2

The features based on the correlation between the left and right channel of a stereo recording deliver powerful cues for the ambience extraction processing. However, when processing mono signals, these cues are not available. The presented approach is able to process mono signals.

A valid option for choosing the reference values for training is to use stereo signals, from which the correlation based features are computed and used as reference values (for example for obtaining expected gain values).

The reference values may for example be described by the expected gain value information 1920, or the expected gain value information 1920 may be derived from the reference values.

The stereo recordings may then be down-mixed to mono for the extraction of the other low-level features, or the low-level features may be computed from the left and right channel signals separately.

Some embodiments applying the concept described in this section are shown in FIGS. 19 and 20.

An alternative solution is to compute the weights G(m,k) from the reference values $R_{AD}(m,k)$ according to Equation 31 and to use G(m,k) as reference values for the training. In this case, the classifier/regression method outputs the estimates for the spectral weights $\hat{G}$ (m,k).

7. Post-Processing of the Ambient Signal

The following section describes appropriate post-processing methods for the enhancement of the perceived quality of the ambient signal.

In some embodiments, the post processing may be performed by the post processor 700.

7.1 Nonlinear Processing of Sub-Band Signals

The derived ambient signal (for example represented by weighted sub-band signals) does not contain ambience components only, but also direct signal components (i.e. the separation of ambience and direct signal components is not perfect). The ambient signal is post-processed in order to enhance its ambient-to-direct ratio, i.e. the ratio of the amount of ambient components to direct components. The applied post-processing is motivated by the observation, that ambient sounds are rather quiet compared to direct sounds. A simple method for attenuating loud sounds while preserving quiet sound is to apply a non-linear compression curve to the coefficients of the spectrogram (e.g. to the weighted sub-band signals).

An example for an appropriate compression curve is given in Equation 17, where c is a threshold and the parameter p determines the degree of compression, with 0<p<1.

$$y = \begin{cases} x, & x < c \\ p(x-c)+c, & x \geq c \end{cases} \tag{17}$$

Another example for a nonlinear modification is $y=x^p$, with 0<p<1, whereas small values are more increased than large values. One example for this function is $y=\sqrt{x}$, wherein x may for example represent values of the weighted sub-band signals and y may for example represent values of the post processed weighted sub-band signals.

In some embodiments, the nonlinear processing of the sub-band signals described in this section may be performed by the nonlinear compressor 732.

7.2 Introduction of a Time Delay

A few milliseconds (e.g. 14 ms) delay is introduced into the ambient signal (for example compared to the front signal or direct signal) to improve the stability of the front image. This is a result of the precedence effect, which occurs if two identical sounds are presented such that the onset of one sound A is delayed relative to the onset of the other sound B and both are presented at different directions (with respect to the listener). As long as the delay is within an appropriate range, the sound is perceived as coming from the direction from where sound B is presented [LCYG99].

By introducing the delay to the ambient signal, the direct sound sources are better localized in the front of the listener even if some direct signal components are contained in the ambient signal.

In some embodiments, the introduction of a time delay described in this section may be performed by the delayer 734.

7.3 Signal Adaptive Equalization

To minimize the timbral coloration of the surround sound signal, the ambient signal (for example represented in terms of weighted sub-band signals) is equalized to adapt its long-term power spectral density (PSD) to the input signal. This is carried out in a two-stage process.

The PSD of both, the input signal x[k] and the ambience signal a[k] are estimated using the Welch method, yielding $I_{xx}^{W}(\omega)$ and $I_{aa}^{W}(\omega)$, respectively. The frequency bins of $|A(\omega, \tau)|$ are weighted prior to the resynthesis using the factors $$H(\omega) = \sqrt{\frac{I_{xx}^{W}(\omega)}{I_{aa}^{W}(\omega)}} \tag{18}$$

The signal adaptive equalization is motivated by the observation that the extracted ambient signal tends to feature a smaller spectral tilt than the input signal, i.e. the ambient signal may sound brighter than the input signal. In many recordings, the ambient sounds are mainly produced by room reverberations. Since many rooms used for recordings have smaller reverberation time for higher frequencies than for lower frequencies, it is reasonable to equalize the ambient signal accordingly. However, informal listening tests have shown that the equalization to the long-term PSD of the input signal turns out to be a valid approach.

In some embodiments, the signal adaptive equalization described in this section may be performed by the timbral coloration compensator 736.

7.4 Transient Suppression

The introduction of a time delay into the rear channel signals (see Section 7.2) evokes the perception of two separate sounds (similar to an echo) if transient signal components are present [WNR73] and the time delay exceeds a signal-dependent value (the echo threshold [LCYG99]). This echo can be attenuated by suppressing the transient signal components in the surround sound signal or in the ambient signal. Additional stabilization of the front image is achieved by the transient suppression since the appearance of localizable point sources in the rear channels is significantly reduced.

Considering that ideal enveloping ambient sounds are smoothly varying over time, a suitable transient suppression method reduces transient components without affecting the continuous character of the ambience signal. One method that fulfils this requirement has been proposed in [WUD07] and is described here.

First, time instances where transients occur (for example in the ambient signal represented in terms of weighted sub-band signals) are detected. Subsequently, the magnitude spectrum belonging to a detected transient region is replaced by an extrapolation of the signal portion preceding the onset of the transient.

Therefore all values $|X(\omega,\tau_t)$ exceeding the running mean $\mu(\omega)$ by more than a defined maximum deviation are replaced by a random variation of $\mu(\omega)$ within a defined variation interval. Here, subscript t indicates frames belonging to a transient region.

To assure smooth transitions between modified and unmodified parts, the extrapolated values are cross-faded with the original values.

Other transient suppression methods are described in [WUD07].

In some embodiments, transient suppression described in this section can be performed by the transient reducer 738.

7.5 Decorrelation

The correlation between the two signals arriving at the left and right ear influences the perceived width of a sound source and the ambience impression. To improve the spaciousness of the impression, the inter-channel correlation between the front channel signals and/or between the rear channel signals (e.g. between two rear channel signals based on the extracted ambient signals) is decreased.

Various methods for the decorrelation of two signals are appropriate and are described in the following.

Comb Filtering:

Two decorrelated signals are obtained by processing two copies of a one-channel input signal by a pair of complementary comb filters [Sch57].

Allpass Filtering:

Two decorrelated signals are obtained by processing two copies of a one-channel input signal by a pair of different allpass filters.

Filtering with Flat Transfer Functions:

Two decorrelate signals are obtained by filtering two copies of a one-channel input signal with two different filters with a flat transfer function (i.e. impulse response has a white spectrum).

The flat transfer function ensures that the timbral coloration of the output signals is small. Appropriate FIR filters can be constructed by using a white random numbers generator and applying a decaying gain factor to each filter coefficient.

An example is shown in Equation 19, where $h_k$,k<N are the filter coefficients, $r_k$ are outputs of a white random process, and a and b are constant parameters determining the envelope of $h_k$ such that b≥aN $$h_k=r_k(b-ak) \tag{19}$$

Adaptive Spectral Panoramization:

Two decorrelated signals are obtained by processing two copies of a one-channel input signal by ASP [VZA06] (see Section 2.1.4). The application of ASP for the decorrelation of the rear channel signals and of the front channel signals is described in [UWI07].

Delaying the Sub-Band Signals:

Two decorrelated signals are obtained by decomposing the two copies of a one-channel input signal into sub-bands (e.g. using a filter-bank of a STFT), introducing different time delays to the sub-band signals and re-synthesizing the time signals from the processed sub-band signals.

In some embodiments, the decorrelation described in this section may be performed by the signal decorrelator 740.

In the following, some aspects of embodiments according to the invention will be briefly summarized.

Embodiments according to the invention create a new method for the extraction of a front signal and an ambient signal suited for blind upmixing of audio signals. The advantages of some embodiments of the method according to the invention are multi-faceted: Compared to a previous method for one-to-n upmixing, some methods according to the invention are of low computational complexity. Compared to previous methods for two-to-n upmixing, some methods according to the invention perform successfully even if both input channel signals are identical (mono) or nearly identical. Some methods according to the invention do not depend on the number of input channels and are therefore well-suited for any configuration of input channels. Some methods according to the invention are preferred by many listeners when listening to the resulting surround sound signal in listening tests.

To summarize, some embodiments are related to a Low-complexity extraction of a front signal and an ambient signal from an audio signal for upmixing.

Glossary

ASP Adaptive Spectral Panoramization
NMF Non-negative Matrix Factorization
PCA Principal Component Analysis
PSD Power spectral density
STFT Short-term Fourier Transform
TFD Time-frequency Distribution

REFERENCES

[AJ02] Carlos Avendano and Jean-Marc Jot. Ambience extraction and synthesis from stereo signals for multi-channel audio upmix. In *Proc. of the ICASSP,* 2002.

[AJ04] Carlos Avendano and Jean-Marc Jot. A frequency-domain approach to multi-channel upmix. *J. Audio Eng. Soc.,* 52, 2004.

[dCK03] Alain de Cheveigné and Hideki Kawahara. Yin, a fundamental frequency estimator for speech and music. *Journal of the Acoustical Society of America,* 111(4):1917-1930, 2003.

[Dre00] R. Dressler. Dolby Surround Pro Logic 2 Decoder: Principles of operation. *Dolby Laboratories Information,* 2000.

[DTS] DTS. An overview of DTS NEo:6 multichannel. http://www.dts.com/media/uploads/pdfs/DTS%20Neo6%20Overview.pdf.

[Fa105] C. Faller. Pseudostereophony revisited. In *Proc. of the AES* 118*nd Convention,* 2005.

[GJ07a] M. Goodwin and Jean-Marc Jot. Multichannel surround format conversion and generalized upmix. In *Proc. of the AES* 30*th Conference,* 2007.

[GJ07b] M. Goodwin and Jean-Marc Jot. Primary-ambient signal decomposition and vector-based localization for spatial audio coding and enhancement. In *Proc. of the ICASSP,* 2007.

[HEG+99] J. Herre, E. Eberlein, B. Grill, K. Brandenburg, and H. Gerhäuser. U.S. Pat. No. 5,918,203, 1999.

[IA01] R. Irwan and R. M. Aarts. A method to convert stereo to multichannel sound. In *Proc. of the AES* 19*th Conference,* 2001.

[ISO93] ISO/MPEG. ISO/IEC 11172-3 MPEG-1. International Standard, 1993.

[Kar] Harman Kardon. Logic 7 explained. Technical report.

[LCYG99] R. Y. Litovsky, H. S. Colburn, W. A. Yost, and S. J. Guzman. *The precedence effect.* JAES, 1999.

[LD05] Y. Li and P. F. Driessen. An unsupervised adaptive filtering approach of 2-to-5 channel upmix. In *Proc. of the AES* 119*th Convention,* 2005.

[LMT07] M. Lagrange, L. G. Martins, and G. Tzanetakis. Semi-automatic mono to stereo upmixing using sound source formation. In *Proc. of the AES* 122*th Convention,* 2007.

[MPA+05] J. Monceaux, F. Pachet, F. Armadu, P. Roy, and A. Zils. Descriptor based spatialization. In *Proc. of the AES* 118*th Convention,* 2005.

[Sch04] G. Schmidt. Single-channel noise suppression based on spectral weighting. *Eurasip Newsletter,* 2004.

[Sch57] M. Schroeder. An artificial stereophonic effect obtained from using a single signal. *JAES,* 1957.

[Sou04] G. Soulodre. Ambience-based upmixing. In *Workshop at the AES* 117*th Convention,* 2004.

[UWHH07] C. Uhle, A. Walther, O. Hellmuth, and J. Herre. Ambience separation from mono recordings using Non-negative Matrix Factorization. In *Proc. of the AES* 30*th Conference,* 2007.

[UWI07] C. Uhle, A. Walther, and M. Ivertowski. Blind one-to-n upmixing. In *AudioMostly,* 2007.

[VZA06] V. Verfaille, U. Zölzer, and D. Arfib. Adaptive digital audio effects (A-DAFx): A new class of sound transformations. *IEEE Transactions on Audio, Speech, and Language Processing,* 2006.

[WNR73] H. Wallach, E. B. Newman, and M. R. Rosenzweig. The precedence effect in sound localization. *J. Audio Eng. Soc.,* 21:817-826, 1973.

[WUD07] A. Walther, C. Uhle, and S. Disch. Using transient suppression in blind multi-channel upmix algorithms. In *Proc. of the AES* 122*nd Convention,* 2007.

The invention claimed is:

1. An apparatus for extracting an ambient signal on the basis of a time-frequency-domain representation of an input audio signal, the time-frequency-domain representation representing the input audio signal in terms of a plurality of sub-band signals describing a plurality of frequency bands, the apparatus comprising:

a gain-value determinator configured to determine a sequence of time-varying ambient signal gain-values for a given frequency band of the time-frequency-domain representation of the input audio signal in dependence on the input audio signal;

a weighter configured to weight one of the sub-band signals representing the given frequency band of the time-frequency-domain representation with the gain-values, to obtain a weighted sub-band signal; wherein the gain-value determinator is configured to obtain one or more quantitative feature values describing one or more features or characteristics of the input audio signal and to provide the gain-values as a function of the one or more quantitative feature values, such that the gain-values are quantitatively dependent on the quantitative feature values, to provide fine-tuned extraction of ambience components from the input audio signal; and the gain-value determinator is configured to provide the gain-values such that the ambience components are emphasized over non-ambience components in the weighted sub-band signal;

the gain-value determinator is configured to obtain a plurality of different quantitative feature values describing a plurality of different features or characteristics of the input audio signal and to combine the different quantitative feature values to obtain the sequence of gain-values, such that the gain-values are quantitatively dependent on the quantitative feature values;

the gain-value determinator is configured to weight the different quantitative feature values differently according to weighting coefficients; and the gain-value determinator is configured to combine at least a tonality feature value describing a tonality of the input audio signal and an energy feature value describing an energy within a sub-band of the input audio signal, to obtain the gain-values.

2. The apparatus according to claim 1, wherein the gain-value determinator is configured to determine the gain-values on the basis of the time-frequency-domain representation of the input audio signal.

3. The apparatus according to claim 1, wherein the gain-value determinator is configured to obtain at least one of the different quantitative feature values describing an ambience-likeliness of the sub-band signal representing the given frequency band.

4. The apparatus according to claim 1, wherein the gain-value determinator is configured to scale the different quantitative feature values in a non-linear way.

5. The apparatus according to claim 1, wherein the gain-value determinator is configured to combine the different quantitative feature values using the relationship $$g(\omega, \tau) = \sum_{i=1}^{K} \alpha_i m_i(\omega, \tau)^{\beta_i}$$

to obtain the gain-values, wherein $\omega$ designates a sub-band index, wherein $\tau$ designates a time index, wherein i designates a running variable, wherein K represents a number of feature values to be combined, wherein $m_i(\omega,\tau)$ designates a i-th feature value for a sub-band having frequency index $\omega$ and a time having time index $\tau$, wherein $\alpha_i$ designates a linear weighting coefficient for the i-th feature value, wherein $\beta_i$ designates an exponential weighting coefficient for the i-th feature value, wherein g $(\omega,\tau)$ designates a gain-value for a sub-band having frequency index $\omega$ and a time having time index $\tau$.

6. The apparatus according to claim 1, wherein the gain-value determinator comprises a weight adjuster configured to adjust weights of different features to be combined.

7. The apparatus according to claim 1, wherein the gain-value determinator is configured to combine at least the tonality feature value, the energy feature value and a spectral centroid feature value describing a spectral centroid of a spectrum of the input audio signal or of a portion of the spectrum of the input audio signal, to obtain the gain-values.

8. The apparatus according to claim 1, wherein the gain-value determinator is configured to obtain at least one quantitative single-channel feature value describing a feature of a single audio signal channel, to provide the gain-values using the at least one single-channel feature value.

9. The apparatus according to claim 1, wherein the gain-value determinator is configured to provide the gain-values on the basis of a single audio channel.

10. The apparatus according to claim 1, wherein the gain-value determinator is configured to obtain a multi-band feature value describing the input audio signal over a frequency range comprising a plurality of frequency bands.

11. The apparatus according to claim 1, wherein the gain-value determinator is configured to obtain a narrow-band feature value describing the input audio signal over a frequency range comprising a single frequency band.

12. The apparatus according to claim 1, wherein the gain-value determinator is configured to obtain a broad-band feature value describing the input audio signal over a frequency range comprising an entirety of frequency bands of the time-frequency-domain representation.

13. The apparatus according to claim 1, wherein the gain-value determinator is configured to combine different quantitative feature values describing portions of the input audio signal having different bandwidths, to obtain the gain-values.

14. The apparatus according to claim 1, wherein the gain-value determinator is configured to preprocess the time-frequency-domain representation of the input audio signal in a non-linear way, and to obtain at least one of the one or more quantitative feature values on the basis of the preprocessed time-frequency-domain representation.

15. The apparatus according to claim 1, wherein the gain-value determinator is configured to post process the obtained different quantitative feature values in a non-linear way, to limit a range of values of the feature values, to obtain post processed feature values.

16. The apparatus according to claim 1, wherein the gain-value determinator is configured to combine the plurality of different quantitative feature values describing identical features or characteristics associated with different time-frequency-bins of the time-frequency domain representation, to obtain a combined feature value.

17. The apparatus according to claim 1, wherein the gain-value determinator is configured to obtain the tonality feature value, to determine the gain-values.

18. The apparatus according to claim 17, wherein the gain-value determinator is configured to obtain, as the tonality feature value, a spectral flatness measure, or a spectral crest factor, or a ratio of at least two spectral values obtained using different non-linear processing of copies of a spectrum of the input audio signal, or a ratio of at least two spectral values obtained using different non-linear filtering of copies of a spectrum of the input signal, or a value indicating a presence of a spectral peak, a similarity value describing a similarity between the input audio signal and a time-shifted version of the input audio signal, or a prediction error value describing a difference between a predicted spectral coefficient of the time-frequency-domain representation and an actual spectral coefficient of the time-frequency-domain representation.

19. The apparatus according to claim 1, wherein the gain-value determinator is configured to obtain the energy feature value, to determine the gain-values.

20. The apparatus according to claim 19, wherein the gain-value determinator is configured to determine the gain-values such that the gain-value for a given time-frequency bin of the time-frequency-domain description decreases with increasing energy in the given time-frequency bin, or with increasing energy in a time-frequency bin within a neighborhood of the given time-frequency bin.

21. The apparatus according to claim 19, wherein the gain-value determinator is configured to treat an energy in a given time-frequency bin and a maximum energy or average energy in a predetermined neighborhood of the given time-frequency bin as separate features.

22. The apparatus according to claim 21, wherein the gain-value determinator is configured to obtain a first quantitative feature value describing an energy of the given time-frequency bin and a second quantitative feature value describing a maximum energy or an average energy in a predetermined neighborhood of the given time-frequency bin, and to combine the first quantitative feature value and the second quantitative feature value to obtain the gain-value.

23. The apparatus according to claim 1, wherein the gain-value determinator is configured to obtain one or more quantitative channel-relationship values describing a relationship between two or more channels of the input audio signal.

24. The apparatus according to claim 23, wherein one of the one or more quantitative channel-relationship values describes a correlation or a coherence between the two or more channels of the input audio signal.

25. The apparatus according to claim 23, wherein one of the one or more quantitative channel-relationship values describes an inter-channel short-time coherence.

26. The apparatus according to claim 23, wherein one of the one or more quantitative channel-relationship values describes a position of a sound source on the basis of the two or more channels of the input audio signal.

27. The apparatus according to claim 26, wherein one of the one or more quantitative channel-relationship values describes an inter-channel level difference between the two or more channels of the input audio signal.

28. The apparatus according to claim 23, wherein the gain-value determinator is configured to obtain, as one of the one or more quantitative channel-relationship values, a panning index.

29. The apparatus according to claim 28, wherein the gain-value determinator is configured to determine a ratio between a spectral value difference and a spectral value sum for a given time-frequency bin, to obtain a panning index for the given time-frequency bin.

30. The apparatus according to claim 1, wherein the gain-value determinator is configured to obtain a spectral-centroid feature-value describing a spectral centroid of a spectrum of the input audio signal or of a portion of the spectrum of the input audio signal.

31. The apparatus according to claim 1, wherein the gain-value determinator is configured to provide a gain-value, for weighting a given one of the sub-band signals, in dependence on a plurality of sub-band signals represented by the time-frequency-domain representation.

32. The apparatus according to claim 1, wherein the weighter is configured to weight a group of sub-band signals with a common sequence of time-varying gain-values.

33. The apparatus according to claim 1, wherein the apparatus further comprises a signal post processor configured to post process the weighted sub-band signal or a signal based thereon, to enhance an ambient-to-direct radio and to obtain a post processed signal in which an ambient-to-direct ratio is enhanced.

34. The apparatus according to claim 33, wherein the signal post processor is configured to attenuate loud sounds in the weighted sub-band signal or in the signal based thereon while preserving quite sounds, to obtain the post processed signal.

35. The apparatus according to claim 33, wherein the signal post processor is configured to apply a non-linear compression to the weighted sub-band signal or to the signal based thereon.

36. The apparatus according to claim 1, wherein the apparatus further comprises a signal post processor configured to post process the weighted sub-band signal or a signal based thereon, to obtain a post processed signal, wherein the signal post processor is configured to delay the weighted sub-band signal or the signal based thereon in a range between 2 milliseconds and 70 milliseconds, to obtain a delay between a front signal and an ambient signal based on the weighted sub-band signal.

37. The apparatus according to claim 1, wherein the apparatus further comprises a signal post processor configured to post process the weighted sub-band signal or a signal based thereon, to obtain a post processed signal, wherein the post processor is configured to perform a frequency-dependent equalization with respect to an ambient signal representation based on the weighted sub-band signal, to counteract a timbral coloration of the ambient signal representation.

38. The apparatus according to claim 37, wherein the post processor is configured to perform the frequency dependent equalization with respect to the ambient signal representation based on the weighted sub-band signal, to obtain, as the post processed ambient signal representation, an equalized ambient signal representation, wherein the post processor is configured to perform the frequency dependent equalization to adapt a long term power spectral density of the equalized ambient signal representation to the input audio signal.

39. The apparatus according to claim 1, wherein the apparatus further comprises a signal post processor configured to post process the weighted sub-band signal or a signal based thereon, to obtain a post processed signal, wherein the signal post processor is configured to reduce transients in the weighted sub-band signal or in the signal based thereon.

40. The apparatus according to claim 1, wherein the apparatus further comprises a signal post processor configured to post process the weighted sub-band signal or a signal based thereon, to obtain a post processed signal, wherein the post processor is configured to obtain, on the basis of the weighted sub-band signal or the signal based thereon, a left ambient signal and a right ambient signal, such that the left ambient signal and the right ambient signal are at least partially de-correlated.

41. The apparatus according to claim 1, wherein the apparatus is configured to also provide a front signal on the basis of the input audio signal, wherein the weighter is configured to weight one of the sub-band signals representing the given frequency band of the time-frequency-domain representation with varying front-signal gain-values, to obtain a weighted front-signal sub-band signal, wherein the weighter is configured such that the time-varying front-signal gain-values decrease with increasing ambient-signal gain-values.

42. The apparatus according to claim 41, wherein the weighter is configured to provide the time-varying front-signal gain-values such that the front-signal gain-values are complementary to the ambient-signal gain-values.

43. The apparatus according to claim 1, wherein the apparatus comprises a time-frequency-domain to time-domain converter configured to provide a time-domain representation of the ambient signal in dependence on the one or more weighted sub-band signals.

44. The apparatus according to claim 1, wherein the apparatus is configured to extract the ambient signal on the basis of a mono input audio signal.

45. A method for extracting an ambient signal on the basis of a time-frequency-domain representation of an input audio signal, the time-frequency-domain representation representing the input audio signal in terms of a plurality of sub-band signals describing a plurality of frequency bands, the method comprising:

obtaining one or more quantitative feature-values describing one or more features or characteristics of the input audio signal;

determining a sequence of time-varying ambient-signal gain-values for a given frequency band of the time-frequency-domain representation of the input audio signal as a function of the one or more quantitative feature-values, such that the gain-values are quantitatively dependent on the quantitative feature-values, to provide fine-tuned extraction of ambience components from the input audio signal; and weighting a sub-band signal representing the given frequency band of the time-frequency-domain representation with the time-varying gain-values; wherein the gain-values are determined such that the ambience components are emphasized over non-ambience components in the weighted sub-band signal;

a plurality of different quantitative feature values describing a plurality of different features or characteristics of the input audio signal are determined and combined to obtain the sequence of gain-values, such that the gain-values are quantitatively dependent on the different quantitative feature values;

the different quantitative feature values are weighted differently according to weighting coefficients; and at least a tonality feature value describing a tonality of the input audio signal is combined with an energy feature value describing an energy within a sub-band of the input audio signal, to obtain the gain-values.

46. A computer readable medium storing a computer program for performing a method for extracting an ambient signal on the basis of a time-frequency-domain representation of an input audio signal, the time-frequency-domain representation representing the input audio signal in terms of a plurality of sub-band signals describing a plurality of frequency bands, when the computer program runs on a computer, the method comprising:

obtaining one or more quantitative feature-values describing one or more features or characteristics of the input audio signal;

determining a sequence of time-varying ambient-signal gain-values for a given frequency band of the time-frequency-domain representation of the input audio signal as a function of the one or more quantitative feature-values, such that the gain-values are quantitatively dependent on the quantitative feature-values, to provide fine-tuned extraction of ambience components from the input audio signal; and weighting a sub-band signal representing the given frequency band of the time-frequency-domain representation with the time-varying gain-values; wherein the gain-values are determined such that the ambience components are emphasized over non-ambience components in the weighted sub-band signal;

a plurality of different quantitative feature values describing a plurality of different features or characteristics of the input audio signal are determined and combined to obtain the sequence of gain-values, such that the gain-values are quantitatively dependent on the different quantitative feature values;

the different quantitative feature values are weighted differently according to weighting coefficients; and at least a tonality feature value describing a tonality of the input audio signal is combined with an energy feature value describing an energy within a sub-band of the input audio signal, to obtain the gain-values.

* * * * *